US006169240B1

(12) United States Patent
Suzuki

(10) Patent No.: US 6,169,240 B1
(45) Date of Patent: Jan. 2, 2001

(54) TONE GENERATING DEVICE AND METHOD USING A TIME STRETCH/ COMPRESSION CONTROL TECHNIQUE

(75) Inventor: Hideo Suzuki, Hamamatsu (JP)

(73) Assignee: Yamaha Corporation, Hamamatsu (JP)

( * ) Notice: Under 35 U.S.C. 154(b), the term of this patent shall be extended for 0 days.

(21) Appl. No.: 09/014,417

(22) Filed: Jan. 27, 1998

(30) Foreign Application Priority Data

Jan. 31, 1997 (JP) ..... 9-032908
May 2, 1997 (JP) ..... 9-130394

(51) Int. Cl.[7] ..... G10H 7/00
(52) U.S. Cl. ..... 84/605; 84/629; 704/503
(58) Field of Search ..... 84/604, 605, 629; 704/503

(56) References Cited

U.S. PATENT DOCUMENTS 5,086,685 2/1992 Hanzawa et al. .
5,367,118 * 11/1994 Iwaooji .
5,386,493 1/1995 Degen et al. .
5,412,152 * 5/1995 Kageyama et al. ..... 84/629 X
5,522,010 5/1996 Toyama .
5,559,300 9/1996 Fujita .

FOREIGN PATENT DOCUMENTS 58-142396 8/1983 (JP) .
59-97195 6/1984 (JP) .

* cited by examiner

*Primary Examiner*—Jeffrey Donels
(74) *Attorney, Agent, or Firm*—Morrison & Foerster

(57) ABSTRACT

A pitch of a tone to be generated is designated, and simultaneously control information to be used for time-axis stretch/compression control is generated. Discrete locations of waveform data to be read out from memory are designated with the time axis of the waveform data controlled to be stretched or compressed in accordance with the control information, and part of the waveform data at the designated locations are read out at a rate corresponding to the designated pitch. For example, virtual read addresses corresponding to the control information and actual read addresses corresponding to the designated pitch are generated, and the actual read addresses are controlled, at the individual discrete locations, to follow the virtual addresses. Thus, the rate at which the waveform data are read out from the memory is variably controlled to generate a desired pitch, during which time the waveform memory can be optionally controlled to be stretched or compressed along the time axis independently of the readout rate or pitch control. By applying the time-axis stretch/compression control to various performance styles, real-time control, modulation control or tone-generating-time control, it is possible to significantly enhance expression and controllability of the generated tone.

47 Claims, 30 Drawing Sheets

702

| CONTENTS / PROCESS | UPDATE OF rp | UPDATE OF dif | UPDATE OF INDEX COUNTER | APPLIED CYCLE LENGTH | OFST OF 2ND CHANNEL |
|---|---|---|---|---|---|
| S PROCESS | rp_now + O | dif_now + ($T_{pre}$ *CRate) | Index Count_now + 0 | $T_{pre}$ | $-T_{pre}$ |
| N PROCESS | rp_now + $T_{now}$ | dif_now + (T now * CR ate) − T now | Index Count_now + 1 | $T_{now}$ | O |
| C PROCESS | rp_now + T now + T next | dif_now + (Tnext*CRate) − (T now + T next) | Index Count_now + 2 | Tnext | + $T_{now}$ |

CRate = 1.5 (SIX DATA DIVI. COMPRESSED INTO 2/3 OF ORIGINAL)

CRate = 1.0 ( REPRO. OF SIX DATA DIVI WITH ORIGINAL TIME LENGTH )

CRate = 0.75 (SIX DATA DIVI. STRETCHED INTO 4/3 OF ORIGINAL)

| COLOR NAME "A" |
| --- |
| WAVEFORM DATA FILE 1 |
| CRate VARIATION 2 |
| TONE VOLUME (EG) |
| OTHERS |

| COLOR NAME "B" |
| --- |
| WAVEFORM DATA FILE 2 |
| VAD VARIATION 3 |
| TONE VOLUME (EG) |
| OTHERS |

TONE GENERATING DEVICE AND METHOD USING A TIME STRETCH/ COMPRESSION CONTROL TECHNIQUE

BACKGROUND OF THE INVENTION

The present invention relates to a tone generating device and method for performing control to optionally stretch or compress a time-axis length (reproducing time length) of tone waveform data in whole or in part independently of pitch control of the waveform data, to thereby enhance expression and controllability of the tone in the time-axis direction. The present invention is applicable extensively as a tone generating device and method for not only electronic musical instruments but also various other tone or sound generating instruments such as game machines, personal computers and various multimedia equipment.

In the conventionally-known tone generators based on the waveform memory reading method (PCM or Pulse Code Modulation method) which are used in electronic musical instruments and the like, a pitch of each tone waveform to be generated have been controlled by adjusting the rate of the waveform data readout from a waveform memory. More specifically, when sequentially reading out the waveform data with read addresses generated by accumulating so-called "F numbers" (frequency numbers which are constants proportional to a tone pitch frequency), the pitch can be controlled to become higher by increasing the value of the F number and become lower by decreasing the value of the F number. In this case, when a set of waveform data of limited quantity is read out, the tone-reproducing or tone-generating time length of the waveform data would undesirably vary depending on the readout rate of the waveform data (waveform samples). Namely, the tone-generating time length would become shorter as the pitch becomes higher. Thus, the conventional PCM tone generators were not satisfactory in that it could not perform control to freely stretch or compress the time length, i.e., tone-generating time length of the waveform data to be read out from the waveform memory, independently of the pitch.

Further, with these PCM tone generators, it has been conventional to control three different tonal factors: pitch; volume; and color (or timbre), when a user desires to impart particular expression to a tone to be generated (which will be sometimes referred to as "to-be-generated tone") by applying some modification to the waveform read out from the memory rather than merely generating the read-out waveform directly as a tone. For the tone pitch, a pitch modulation effect, such as a vibrato or attack pitch, is imparted by modulating the waveform data readout rate as necessary. For the tone volume, a tremolo effect or the like is imparted by imparting a volume amplitude envelope, based on a given envelope waveform, to the read-out waveform data or by periodically modulating the volume amplitude of the read-out waveform data. Further, for the tone color, suitable tone color control is performed by subjecting the read-out waveform data to a filtering process. As noted above, the known tone controlling technique for imparting expression to a to-be-generated tone comprises performing some control on the three major tonal factors: pitch; volume; and color. However, there has never been proposed so far an idea of controlling waveform data of a to-be-generated tone along the time-axis to thereby impart expression to the to-be-generated tone for enhanced tonal expression and controllability.

Further, quality of natural instrument tones can not be easily approximated by the above-mentioned external control of the three tonal factors in the PCM tone generator: variation of the readout rate; control of the volume amplitude of the read output; and filtering of the tone color. Thus, to enhance the quality of tones generated by the PCM tone generator, it has been conventional to prestore in the waveform memory plural-cycle waveforms with various modulation effects, such as a vibrato and tremolo, previously imparted thereto so that tones having these modulation effects can be generated, with as good quality as that of natural instrument tones, by just reading out the stored waveforms. However, in the case where the waveform data of tones having modulation effects imparted thereto are read out from the memory, the modulating cycle and modulating time would undesirable vary as the waveform data data readout rate is changed; that is, the modulating cycle, modulating time, etc. could not be controlled independently of the waveform data readout rate, i.e, tone pitch.

Further, although the PCM tone generators can prestore, in the waveform memory, high-quality waveform data corresponding to desired tonal effects and characteristics by sampling them directly from a natural musical instrument, they preset the problem in that if they are read out with the pitch controlled (i.e., with the readout rate varied), the time axis of a generated tone would vary in response to the varied readout rate. Such a disadvantage may be avoided by preventing variation of the readout rate, but where a multiplicity of pitches are to be reproduced precisely in cents as in the case of musical instrument tones, an extremely great memory capacity would be required if a multiplicity of sorts (sets) of plural-cycle waveform data having various effects imparted thereto are prestored for each of the pitches. Thus, this approach is very impractical.

Further, in the field of voice processing, the PICOLA method is currently known as one of the speech speed converting techniques. For example, when applied to a situation where waveform blocks A, B, C, D and E for five wave cycles are read out in the mentioned order at a predetermined reproducing sampling frequency to output a voice waveform, the PICOLA method may use, for the first cycle, a waveform obtained by adding together a waveform for fading out block A and another waveform for fading in block B and then output blocks C, D and E for the second to fourth cycles. In this way, without varying the predetermined reproducing sampling frequency, the PICOLA method can output the waveform, originally having a total time length of five cycles, with the time axis compressed to just four cycles. When applied to another situation where waveform blocks A, B and C for three cycles are read out in the mentioned order at a predetermined reproducing sampling frequency to output a voice waveform and if time-length expansion or stretch is desired, the PICOLA method may use block A for the first cycle, then use, for the second cycle, a waveform obtained by adding together a waveform for fading out block A and another waveform for fading in block B, and then output blocks B and C for the third and fourth cycles. In this way, without varying the predetermined reproducing sampling frequency, the PICOLA method can output the waveform, originally having a total time length of three cycles, with the time length expanded or stretched to four cycles. However, this speech speed converting technique can merely read out the recorded voice signal at the predetermined reproducing sampling frequency and is never intended for variably reading the voice signal at an optional pitch (tone pitch). In other words, the conventional technique provides no countermeasures or solution to the above-mentioned problem.

As set forth above, the conventional waveform-memory-based tone generators for electronic musical instruments have the problem that the time length of the read-out waveform data is invariably determined depending on the readout rate and hence can not be stretched and compressed freely. Further, the conventional voice processing technology is in no way intended for precise pitch control in cents, and it is difficult to apply such voice processing technology directly to the waveform-memory tone generators.

SUMMARY OF THE INVENTION

It is therefore an object of the present invention to provide a technique suitably applicable to a tone generator based on waveform data readout from a waveform memory, which can perform optional variable control of the data readout rate (pitch) and also perform control for optionally stretching and compressing the waveform data along a time axis independently of the readout rate.

It is another object of the present invention to provide a technique suitably applicable to a tone generator based on waveform data readout from a waveform memory, which can impart expression to a tone to be generated and significantly enhance expression and controllability of the tone with a simple structure requiring no substantial increase in memory capacity, by just introducing, as one tone control factor, control for stretching and compressing the waveform data in the time axis direction.

It is still another object of the present invention to provide a device and method suitably applicable to a case where high-quality waveform data of a plural-cycle waveform corresponding to an optional performance style are stored in a waveform memory so that a tone is reproduced by reading out the stored waveform data, which can variably control a waveform data readout rate to reproduce a tone at a desired pitch so as to allow the same stored waveform data to be shared for a plurality of different tone pitches and thereby allow the memory capacity to be substantially saved and which also performs control for stretching and compressing readout locations of the waveform data along a time axis independently of the control of the waveform data readout rate to thereby provide a time-axis control parameter as an additional tone control parameter for the optional performance style, thus achieving suitable tone generation and tone control for the optional performance style with enhanced expression and controllability that have never been achieved to date. The waveform data corresponding to an optional performance style to stored in the waveform memory may include those with modulation, such as a vibrato or tremolo, imparted thereto, those with pitch modulation, such as a pitch bend, imparted thereto, and those with transient pitch fluctuation, such as a transient tone or ornament, imparted thereto.

It is still another object of the present invention to provide a device and method suitably applicable to a case where waveform data of a plural-cycle waveform are stored in a waveform memory so that a tone is reproduced by reading out the stored waveform data, which can variably control a waveform data readout rate to reproduce a tone at a desired pitch so as to allow the same stored waveform data to be shared for a plurality of different tone pitches and thereby allow the memory capacity to be substantially saved and which also performs control for stretching and compressing readout locations of a desired portion (whole or part) of the waveform data along a time axis independently of the control of the waveform data readout rate to thereby optionally control a tone-reproducing or tone-generating time length of the desired portion, thus achieving a variety of variations of a tone waveform so as to achieve tone generation and tone control with enhanced expression and controllability that have never been achieved to date.

Namely, the present invention seeks to provide a device and method which can freely perform variable control of a tone-generating time length of a rising portion, falling portion or the like of a tone so as to achieve a variety of variations of a tone waveform and tone generation and tone control with enhanced expression and controllability that have never been achieved to date.

It is still another object of the present invention to provide a tone generating device and method which can variably control a total time length of a to-be-generated tone by time axis control of waveform data to thereby freely control a tone-generating time length in conformity with a note length or the like.

It is still another object of the present invention to provide a tone generating device and method which can selectively generate a time-axis stretching/compressing control parameter of a time-varying characteristic in accordance with information designating a tone color or the like, so as to achieve a variety of variations of a tone waveform corresponding to the designated tone color or the like and thereby create, through the time axis control, a variety of waveform variations from same waveform data of one plural-cycle waveform.

It is still another object of the present invention to provide a device and method suitably applicable to a case where waveform data of a same waveform portion are read out in a repetitive or looped manner from a waveform memory, which achieves a variety of variations of a tone waveform and can carry out tone generation and tone control with monotonousness due to the looped readout effectively eliminated, by performing control for stretching and compressing readout locations of a desired portion of the waveform data along a time axis to thereby optionally control a tone-generating time length of the desired portion.

It is still another object of the present invention to provide a device and method which achieves a variety of variations of a tone waveform, by performing control for stretching and compressing readout locations of a desired portion as well as a repetitively read-out portion, of waveform data along a time axis to thereby impart positive control, such as a swing, to a tone to be generated.

It is still another object of the present invention to provide a tone generating device and method which, even in the course of reproduction of a tone waveform, can preform control for stretching and compressing waveform data along a time axis in real-time response to dynamically changing ratios of compression and stretch along the time axis.

It is still another object of the present invention to provide a tone generating device and method which, in performing control for stretching and compressing readout locations of waveform data along a time axis, achieve time-axis stretch and compression control providing for a smooth waveform variation through cross-fade synthesis.

It is yet another object of the present invention to provide various improvements in cross-fade synthesis of waveform data in relation to the foregoing.

According to a first aspect of the present invention, there is provided a tone generating device which comprises: a waveform memory having stored therein waveform data of a waveform of a plurality of cycles; a designating section that designates a pitch of a tone tone be generated; a control information generating section that generates control information specifying, in a time function, an address location of the waveform data to be read out from the waveform memory; an address generating section that generates a read address advancing at a rate corresponding to the pitch designated by the designating section; a control unit that makes a comparison between the address location specified by the control information and a location of the read address generated by the address generating section and controls shifting of the read address in accordance with a result of the comparison; and a section that reads out the waveform data on the basis of the read address controlled by the control unit.

The control information generated by the control information generating section specifies, in a time function, an address location of the waveform data to be read out from the waveform memory. Read address progressing or advancing rate (i.e., read address varying or advancing slope) is designated by a read address generated by the address generating section. Comparison is made, by the control unit, between the address location specified by the control information (a sort of target or virtual readout location) and the location of the read address generated by the address generating section (i.e., an actual readout location), and the control unit shifts the read address in accordance with the comparison result. This way, the read address advancing rate (i.e., read address varying or advancing slope) is controlled in correspondence with the desired pitch of the tone to be generated, and relationship between the readout location of the waveform data and the time is controlled by the control information. As a result, the waveform data corresponding to the desired pitch tone can be read out from the waveform memory with the data freely stretched or compressed along the time axis in accordance with the control information independently of control of the readout rate (i.e., pitch control of the tone to be generated).

In the preferred embodiments of the present invention to be set forth hereinafter, the control information, specifying an address location of the waveform data to be read out from the waveform memory, is presented as a virtual read address, while the read address advancing at a rate corresponding to a designated pitch is presented as an actual read address.

Preferably, the waveform data stored in the waveform memory are divided into a plurality of data divisions and managed in such a manner that respective first waveform data of the data divisions generally coincide with each other in phase, and when a difference between the address location specified by the control information and the location of the read address generated by the address generating section has exceeded a predetermined value, the control unit shifts the read address by an amount corresponding to one or more of the data divisions. When readout locations of the waveform data are stretched or compressed along the time axis, there would occur some discontinuity in the readout locations. However, with the arrangement that the read address by an amount corresponding to one or more of the data divisions, a smooth waveform interconnection or interlinking is achieved even in the case where discrete waveform segments are interconnected by the stretch or compression.

In another preferred implementation, there is also provided a cross-fading section which, when the read address is to be shifted by the control unit, performs cross-fade synthesis between the waveform read out from the waveform memory on the basis of the read address generated before the shift and the waveform read out from the waveform memory on the basis of the read address generated after the shift. Also in this case, a smooth waveform interconnection or link is achieved even in the case where discrete waveform segments are interconnected by stretching or compressing the readout locations of the waveform data along the time axis.

The present invention also provides a method of generating a tone on the basis of readout from a waveform memory having stored therein waveform data of a plural-cycle waveform, which comprises: a step of designating a pitch of a tone to be generated; a step of generating control information; a control step of designating, in response to passage of time, discrete locations of the waveform data to be read out from the waveform memory with a time axis of the waveform data controlled to be stretched or compressed in accordance with the control information; and a step of reading out from the waveform memory the waveform data at the locations designated by the control step at a rate corresponding to the pitch designated by the step of designating. This way, a tone is generated which has the designated pitch and waveform data of a characteristic controlled to be stretched or compressed along a time axis in accordance with the control information.

The control step designates, in response to passage of time, discrete locations of the waveform data to be read out from the waveform memory and controls the designated discrete locations to be stretched or compressed along the time axis in accordance with the generated control information. Namely, the locations, of the waveform data to be read out from the waveform memory, designated by the control step do not necessarily have to be sequentially designated, for every address of the memory, as in normal readout of waveform data samples, and may be designated discretely at appropriate spaced-apart points or over an appropriate section or range. During the designation of the discrete locations of the waveform data to be read out from the waveform memory, sequential readout of the individual waveform data samples from the designated locations, i.e., designation of actual read addresses in the waveform memory is carried out by the reading step at a rate corresponding to the designated pitch. Thus, the waveform data are read out from the designated locations, at appropriate spaced-apart points or over an appropriate section or range, of the waveform memory, at the rate corresponding to the designated pitch. This way, the pitch of the read-out waveform data is controlled in accordance with the designated pitch, while the locations of the waveform data to be read out from the waveform memory are designated with its time-axis controlled to be stretched or compressed in accordance with the control information independently of the readout rate (pitch control). As a consequence, the time-axis locations of the waveform data to be read out from the waveform memory can be optionally controlled to be stretched or compressed independently of the readout rate (pitch control). Here, in order to not impair the impression of the pitch of the read-out waveform and the tone color characteristic of one cycle of the read-out waveform, it is preferable that the above-mentioned spaced-apart points or the appropriate section or range be set to cover at least one cycle of the waveform data.

Further, a machine-readable recording medium in accordance with the present invention contains a computer program for executing the above-mentioned tone generating method.

According to another aspect of the present invention, there is provided a tone generating device which comprises:

a waveform memory having stored therein waveform data of a waveform of a plurality of cycles, the waveform data having a modulation effect imparted thereto; a designating section that designates a pitch of a tone tone be generated;

a section that generates control information to control a time axis of modulation; a control unit that designates, in response to passage of time, discrete locations of the waveform data to be read out from the waveform memory with a time axis of the waveform data controlled, by the control unit, to be stretched or compressed in accordance with the control information control unit; and a readout section that reads out from the waveform memory the waveform data at the locations designated by the control unit at a rate corresponding to the pitch designated by the designating section.

High-quality waveform data of a plural-cycle waveform having modulation, such as a vibrato or tremolo, imparted thereto are stored in the waveform memory. As the waveform data are read out for generation of a tone, the readout rate is variably controlled to reproduce the tone at a desired pitch, which allows the stored waveform data to be shared for a plurality of different tone pitches and thereby allow the memory capacity to be substantially saved. Also, as the waveform data are read out for generation of a tone, control is performed for stretching and compressing readout locations of the waveform data along a time axis independently of the control of the waveform data readout rate, which achieves tone generation and tone control with enhanced expression and controllability that have never been achieved to date.

According to still another aspect of the present invention, there is provided a tone generating device which comprises: a waveform memory having stored therein waveform data of a plural-cycle waveform; a designating section that designates a pitch of a tone to be generated; a section that generates control information in correspondence with a predetermined portion of the waveform data to be repetitively read out from the waveform memory; a control unit that designates, in response to passage of time, discrete locations of the waveform data to be read out from the waveform memory with a time axis of the waveform data controlled, by the control unit, to be stretched or compressed in accordance with the control information; and a readout section that reads out the waveform memory from the waveform memory at a rate corresponding to the pitch designated by the designating section, wherein when the predetermined portion is to be read out repetitively, the readout section reads out the waveform data at the locations designated by the control unit at the rate corresponding to the designated pitch.

In the case where the waveform data of a same waveform portion are read out in a repetitive or looped manner from the waveform memory, the tone generating device achieves a variety of variations of the tone waveform and can carry out tone generation and tone control with monotonousness due to the looped readout effectively eliminated, by performing control for stretching and compressing readout locations of a desired portion of the waveform data along the time axis to thereby optionally control a tone-reproducing or tone-generating time length of the desired portion.

According to still another aspect of the present invention, there is provided a tone generating device which comprises: a waveform memory having stored therein waveform data of a plural-cycle waveform; a pitch designating section that designates a pitch of a tone to be generated; a section that generates control information varying with time; a control unit that designates, over time, discrete locations of the waveform data to be read out from the waveform memory with a time axis of the waveform data controlled, by the control unit, to be stretched or compressed in accordance with the control information; and a readout section that reads out from the waveform memory the waveform data at the locations designated by the control unit at a rate corresponding to the pitch designated by the pitch designating section.

This arrangement achieves a variety of variations of a tone waveform, by, in accordance with the time-varying control information (such as a swing waveform), performing control for stretching and compressing readout locations of the waveform data along the time axis to thereby positively impart time-varying delicate control, such as a swing, to the tone to be generated.

According to still another aspect of the present invention, there is provided a tone generating device which comprises: a waveform memory having stored therein waveform data of a plural-cycle waveform having a tonal characteristic variation imparted thereto over a predetermined period based a predetermined style of performance; a pitch designating section that designates a pitch of a tone to be generated; a section that generates control information to control a tone generating period based on the predetermined style of performance; a control unit that designates, in response to passage of time, discrete locations of the waveform data to be read out from the waveform memory with a time axis of the waveform data controlled, by the control unit, to be stretched or compressed in accordance with the control information; and a readout section that reads out from the waveform memory the waveform data at the locations designated by the control unit at a rate corresponding to the pitch designated by the pitch designating section.

When applied to the case where waveform data of a plural-cycle waveform corresponding to a predetermined performance style, such as those with transient pitch modulation like a pitch bend, those with a slur, or those with transient pitch fluctuation like a transient tone or ornament, are stored in a waveform memory so that a tone is reproduced by reading out the stored waveform data, the present invention can generate the tone based on the predetermined performance style with high quality, and also can perform control for stretching and compressing readout locations of the waveform data along the time axis independently of the control of the waveform data readout rate (pitch control of the generated tone), using less capacity of the memory capacity. Thus, the present invention can provide a time-axis control parameter as an additional tone control parameter for the optional performance style, thereby achieving suitable tone generation and tone control for the predetermined performance style with enhanced expression and controllability that have never been achieved to date. In this case, the transient tonal characteristic variation imparted to the waveform data stored in the memory may be other than the pitch variation like a bend, such as that of tone color or tone volume.

As another implementation of the above-mentioned transient waveform control, the present invention provides a tone generating device which comprises: a waveform memory having stored therein first waveform data representative of a first waveform, second waveform data representative of a second waveform, and third waveform data of a plural-cycle third waveform having a tonal characteristic variation imparted thereto to interconnect the first waveform and the second waveform; a pitch designating section that designates a pitch of a tone to be generated; a section that, when a transfer from the first waveform to the second waveform is instructed, performs control such that the first waveform and the second waveform are read out with the third waveform inserted therebetween; a section that generates control information to control a time over which the third waveform is to be used; a control unit that designates, in response to passage of time, discrete locations of at least part of the third waveform to be read out from the waveform memory with a time axis of the third waveform data controlled, by the control unit, to be stretched or compressed in accordance with the control information; and a readout section that reads out the waveform data from the waveform memory at a rate corresponding to the pitch designated by the pitch designating section, wherein the third waveform data are to be read out, the readout section reads out the third waveform data at the locations designated by the control unit at the rate corresponding to the designated pitch.

The present invention also provides a tone generating device which comprises: a waveform memory having stored therein waveform data of a plural-cycle waveform; a pitch designating section that designates a pitch of a tone to be generated; a section that generates control information in correspondence with a predetermined partial tone generating period; a control unit that designates, in response to passage of time, discrete locations of the waveform data to be read out from the waveform memory with a time axis of the waveform data controlled, by the control unit, to be stretched or compressed in accordance with the control information; and a readout section that reads out from the waveform memory the waveform data at the locations designated by the control unit at a rate corresponding to the pitch designated by the pitch designating section.

By performing the control for stretching and compressing readout locations in a desired portion (whole or part) of the waveform data along the time axis independently of the control of the waveform data readout rate (pitch control of the generated tone) to thereby optionally control a tone-reproducing or tone-generating time length of the desired portion, the present invention achieves a variety of variations of a tone waveform so as to permit tone generation and tone control with enhanced expression and controllability that have never been achieved to date. For example, by selecting a rising portion, falling portion or the like of a generated tone as the predetermined partial tone generating period, the present invention achieves a variety of variations of a tone waveform can execute tone generation and tone control with enhanced expression and controllability. Also, by using control information to variably control the entire time length of the generated tone, the present invention can freely control the tone generating time length, independently of the pitch, in conformity to a designated note length or the like.

According to still another aspect of the present invention, there is provided a tone generating device which comprises: a waveform memory having stored therein waveform data of a plural-cycle waveform; a pitch designating section that designates a pitch of a tone to be generated; a color designating section that designates a color of the tone to be generated; a section that generates control information varying in a manner corresponding to the color designated by the color designating section, in response to passage of time from a tone-generation starting point; a control unit that designates, in response to passage of time, discrete locations of the waveform data to be read out from the waveform memory with a time axis of the waveform data controlled, by the control unit, to be stretched or compressed in accordance with the control information; and a readout section that reads out from the waveform memory plural cycles of the waveform data corresponding to the designated color at a rate corresponding to the pitch designated by the pitch designating section, wherein the readout section reads out the waveform data at the locations designated by the control unit at the rate corresponding to the designated pitch. Here, the waveform data of a plural-cycle waveform stored in the waveform memory is shared for at least two different colors and the control information for the at least two different colors is arranged in different manners.

By selectively generating time-axis stretching/compressing control information of a time-varying characteristic in accordance with information designating a tone color or the like, the present invention achieves a variety of variations of a tone waveform corresponding to the designated tone color or the like and thereby create, through the time axis control, a variety of waveform variations from waveform data of just one plural-cycle waveform.

According to still another aspect of the present invention, there is provided a tone generating device which comprises: a waveform memory having stored therein waveform data of a plural-cycle waveform; a pitch designating section that designates a pitch of a tone to be generated; a section that generates control information in real time during generation of a tone; a control unit that designates, in response to passage of time, discrete locations of the waveform data to be read out from the waveform memory with a time axis of the waveform data controlled, by the control unit, to be stretched or compressed in accordance with the control information; and a readout section that reads out from the waveform memory the waveform data at the locations designated by the control unit at a rate corresponding to the pitch designated by the pitch designating section.

With this arrangement, even in the course of reproduction of a tone waveform, the present invention performs the control for stretching and compressing waveform data along the time axis in real-time response to dynamically changing control information and can thereby enhance significantly performance expression.

According to still another aspect of the present invention, there is provided a tone generating device which comprises: a waveform memory having stored therein plural different sets of waveform data of plural-cycle waveforms; a pitch designating section that designates a pitch of a tone to be generated; a waveform designating section that designates any one of the sets of waveform data, the waveform designating section sequentially switching the designated set to another one of the sets in response to passage of time; a section that generates control information; a control unit that designates, in response to passage of time, discrete locations of the set of waveform data, designated by the waveform designating section, to be read out from the waveform memory with a time axis of the set of waveform data controlled, by the control unit, to be stretched or compressed in accordance with the control information; and a readout section that reads out from the waveform memory the waveform data at the locations designated by the control unit at a rate corresponding to the pitch designated by the pitch designating section.

Thus, the present invention can perform tone control in an even further diversified manner on the basis of the time axis stretch/compression of the waveform data.

According to still another aspect of the present invention, there is provided a tone generating device which comprises: a waveform generating section that generates waveform data in two channels; a waveform designating section that designates waveform data to be generated in a first one of the two channels of the waveform generating section and waveform data to be generated in a second one of the two channels of the waveform generating section; a cross-fade synthesis section that executes cross-fade synthesis such that a transfer occurs from the waveform data generated in the first channel to the waveform data generated in the second channel; a first control section that sequentially instructs the waveform generating section to generate additional waveform data having an optional length and controls the cross-fade synthesis section to execute the cross-fade synthesis for a period corresponding to the length of the additional waveform data; and a second control section that, after completion of the cross-fade synthesis by the cross-fade synthesis section, controls designation by the waveform designating section in such a manner that the waveform data having been so far generated in the second channel are generated in the first channel and the additional waveform data are generated in the second channel.

In the case where waveform data to be cross-faded sequentially change, the present invention can fix the cross-fading (fading-in and fading-out) direction in each of the first and second channels so that a transfer always occurs from the waveform data of the first channel to the waveform data of the second channel. With this arrangement, it is possible to fix a functional waveform of cross-fading coefficient for each of the channels and thereby facilitate formation of the functional waveform.

According to still another aspect of the present invention, there is provided a tone generating device which comprises: a waveform memory having stored therein waveform data of a plural-cycle waveform; a pitch designating section that designates a pitch of a tone to be generated; a waveform designating section that designates, in response to passage of time, discrete locations of the waveform data to be read out from the waveform memory with a time axis of the waveform data controlled to be stretched or compressed, so as to identify first waveform data at currently designated locations and second waveform data at locations following the currently designated locations; a readout section that reads out, from the waveform memory, the first and second waveform data designated by the waveform designating section, to output the first and second waveform data through first and second channels, respectively; a cross-fade synthesis section that always executes cross-fade synthesis such that a transfer occurs from the first waveform data supplied through the first channel to the second waveform data supplied through the second channel; a control unit that after completion of the cross-fade synthesis by the cross-fade synthesis section, controls designation by the waveform designating section in such a manner that the waveform data having been so far generated in the second channel are generated in the first channel and waveform data at new locations controlled to be stretched or compressed relative to the locations of the second waveform data are generated in the second channel.

With this arrangement, in performing the time-axis stretch/compression control of the readout locations of the waveform data, the present invention achieves such control that provides for a smooth waveform variation based on cross-fade synthesis. Also, similarly to the above-mentioned, it is possible to fix a functional waveform of cross-fading coefficient for each of the channels and thereby facilitate formation of the functional waveform.

According to still another aspect of the present invention, there is provided a tone generating device which comprises: a waveform memory having stored therein waveform data of a plural-cycle waveform; a pitch designating section that designates a pitch of a tone to be generated; a waveform designating section that designates, in response to passage of time, discrete locations of the waveform data to be read out from the waveform memory with a time axis of the waveform data controlled to be stretched or compressed, so as to designate first waveform data at current locations and second waveform data at locations having been controlled to be stretched or compressed relative to the first waveform data; a readout section that reads out, from the waveform memory, the first and second waveform data designated by the waveform designating section, to output the first and second waveform data through first and second channels, respectively; a cross-fade synthesis section that executes cross-fade synthesis such that a transfer occurs from one of the first and second waveform data supplied through one of the first and second channels to another of the first and second waveform data; and a control unit that when, after completion of the cross-fade synthesis by the cross-fade synthesis section, the waveform designating section designates waveform data at locations having been controlled to be stretched or compressed relative to the locations of the second waveform data, controls designation by the waveform designating section in such a manner that the second waveform data continue to be outputted by the readout section through a same one of the first and second channels as having been so far used and the waveform data at the new locations are outputted by the readout section through another of the first and second channels and also changes a cross-fading direction in the cross-fade synthesis section.

With this arrangement, in performing the time-axis stretch/compression control of the readout locations of the waveform data, the present invention achieves such control that provides for a smooth waveform variation based on cross-fade synthesis.

Finally, according to still another aspect of the present invention, there is provided a tone generating device which comprised: a waveform memory having stored therein waveform data of a plural-cycle waveform; a pitch designating section that designates a pitch of a tone to be generated; a control unit that designates, in response to passage of time, discrete locations of the waveform data to be read out from the waveform memory with a time axis of the waveform data controlled, by the control unit, to be stretched or compressed; a waveform designating section that, in response to designation by the control unit, designates a first part of the waveform data at current locations and a second part of the waveform data at locations following the current locations when stretch of the waveform data is to be executed, designates the first part of the waveform data at current locations and a second part of the waveform data at locations preceding the current locations when compression of the waveform data is to be executed, and designates a same part of the waveform data at current locations as first and second part of the waveform data when neither stretch nor compression is to be executed; a readout section that reads out from the waveform memory the first and second part of the waveform data designated by the control unit at a rate corresponding to the pitch designated by the pitch designating section; and a cross-fade synthesis section that executes cross-fade synthesis such that a transfer occurs from the first part of the waveform data to the second part of the waveform data.

With this arrangement, the present invention achieves such control that provides for a smooth waveform variation based on cross-fade synthesis. In addition, even when no time-axis stretch or compression is to be carried out, the present invention is allowed to perform cross-fade synthesis between same waveform data read out through the first and second channels to thereby prevent occurrence of time-axis stretch or compression of the waveform data. In this manner, the present invention performs the cross-fade synthesis at any time only "apparently". As a result, the present invention can be constructed to unconditionally perform the cross-fade synthesis at any time and thus can eliminate the need to determine, in consideration of contents of a time-axis stretch/compression control parameter, whether or not the cross-fade synthesis should be effected. This arrangement can significantly simplify the necessary control and construction.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

[General Description of TSC Control]

As will be described in detail hereinbelow, the present invention is designed to execute time stretch and compress control (hereinafter referred to as "TSC control") for reading out waveform data from a waveform memory with the time-axis length stretched or compressed within optional limits, independently of normal pitch control of each tone to be reproduced, to thereby control characteristics of the tone freely and variously.

Figure 1:
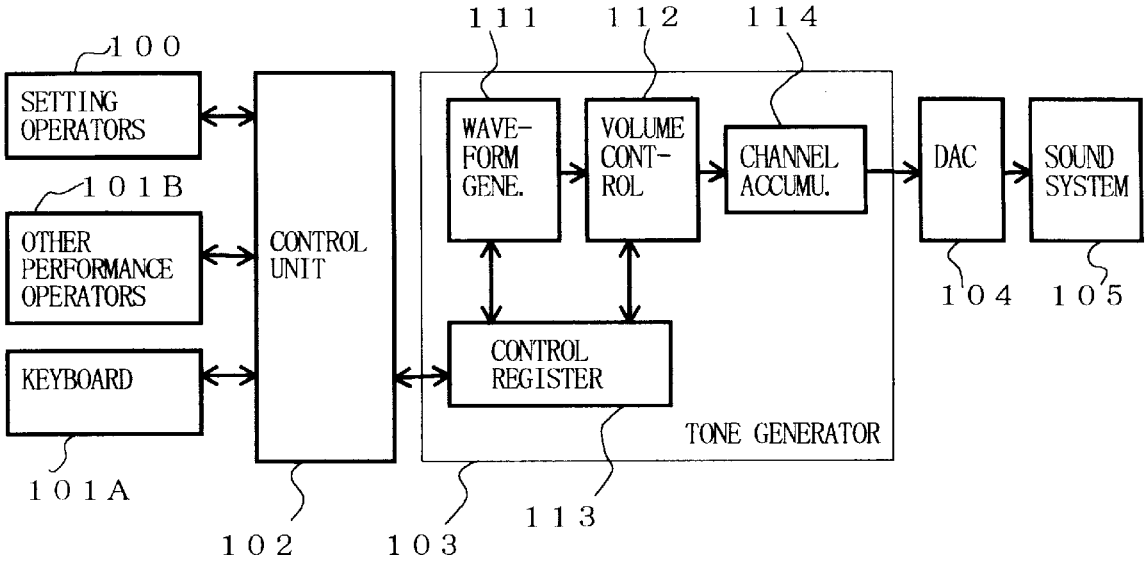
FIG. 1 is a block diagram illustrating an overall setup of an electronic musical instrument to which is applied a tone generating technique based on time stretch and compress control (TSC) control.

FIG. 1 is a block diagram illustrating an overall setup of an electronic musical instrument in accordance with an embodiment of the present invention, to which is applied a tone generating technique based on such TSC control. The electronic musical instrument comprises a keyboard 101A, a group of other performance operators 101B, a group of setting operators 100, a control unit 102, a tone generator unit 103, a digital-to-analog converter (DAC) 104, a sound system 105, etc. The tone generator unit 103 includes a waveform generating section 111, a tone volume control section 112, a control register 113 provided for each of tone generating channels and a channel accumulating section 114. Every predetermined sampling cycle, the tone generator unit 103 generates tone waveform signals for the tone generating channels on a time divisional basis and supplies tone waveform data, obtained by accumulating the thus-generated tone waveform signals, to the DAC 104.

The keyboard 101A includes a plurality of keys for designating pitches of tones to be generated and may be in the form of not only a conventionally-known typical keyboard but also another suitable device, such as a MIDI guitar device, which generates pitch designating data in accordance with the MIDI (Musical Instrument Digital Interface) technique. The other performance operators 101B include various types of performance operators such as wheel-type and pedal-type operators and joy stick. In response to player's performance operation on any of the keyboard 101A and other performance operators 101B, corresponding performance information is generated in real time and then given to the control unit 102. It may be important to note that such performance information need not necessarily be given in response to player's real-time performance operation and may of course be automatically given from an automatic performance device, such as a sequencer, in accordance with the MIDI technique. The setting operators 100 include a display and various data setting operators such as panel switches, sliders and jog dials, which are used to enter various data relating to setting and control of tonal characteristics.

The control unit 102 issues a tone generating instruction to the tone generator unit 103, in accordance with performance information given from any of the keyboard 101A and other performance operators 101B and various setting information given from the setting operators 100. For example, the control unit 102, which includes a CPU, ROM, RAM and other peripheral circuitry, carries out processing in accordance with predetermined programs to issue tone generating instructions corresponding to the above-mentioned performance information and setting information. More specifically, in accordance with the above-mentioned performance information and setting information given from the keyboard 101A and performance operator 101B, the control unit 102 assigns channels to tone generation and creates tone parameters, so as to set the created tone parameters into the control register 113 in association with the assigned channels. On the basis of the tone parameters thus set in the control register 113 in association with the assigned channels, the waveform generating section 111 in the tone generator unit 103 generates tone waveforms for the channels on the time-divisional basis, the tone volume control section 112 performs tone volume control (including tone volume envelope control) on the generated tone waveforms of the individual channels, and the channel accumulating section 114 accumulates the volume-controlled tone waveforms of the channels and passes the accumulated result to the DAC 104. The DAC 104 converts the digital tone waveforms from the channel accumulating section 114 into analog tone signals, which are audibly reproduced or sounded via the sound system 105.

Figure 2:
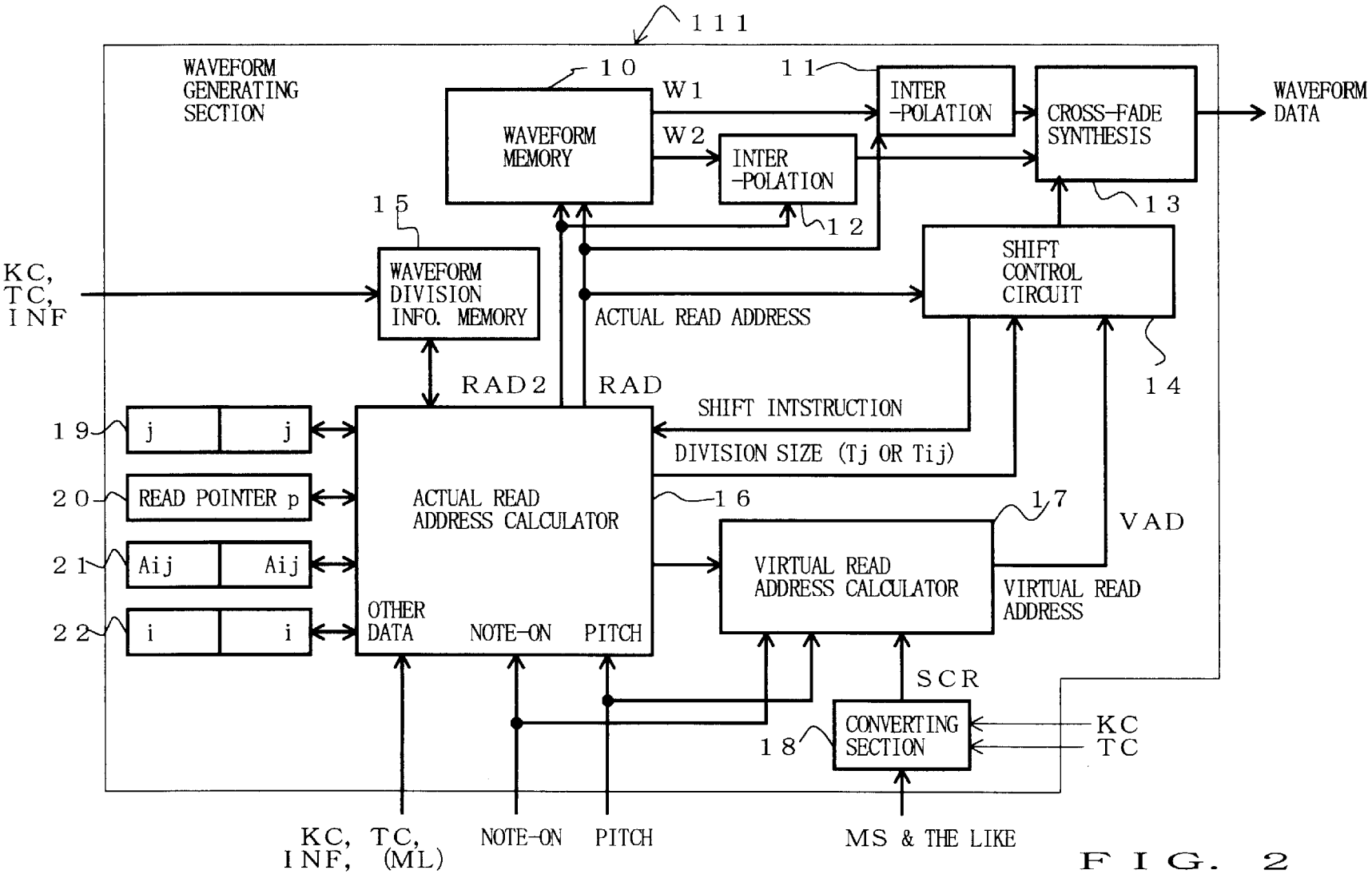
FIG. 2 is a block diagram illustrating details of a waveform generating section of FIG. 1.

FIG. 2 is a block diagram illustrating a detailed example of the waveform generating section 111 of FIG. 1. The waveform generating section 111 includes a waveform memory 10, which, for each of selected tones, has prestored therein a plurality of sets of waveform data of a plural-cycle waveform in association with a plurality of tone colors and tonal characteristics (e.g., characteristics depending on tone pitches or note ranges and modulating characteristics such as vibrato and slur). Key code KC and tone color information TC indicative of pitch or note range and color, respectively, of each tone to be generated are supplied, by way of the control register 113, to the waveform generating section 111 for subsequent delivery to various components thereof. Various information, such as the respective leading or start addresses of the individual waveform data prestored in the waveform memory 10 is stored in, for example, a waveform division information memory 15. By reading out given leading address information using such key code KC and tone color information TC as parameters, a selection is made, in the waveform memory 10, of one of the sets of the plural-cycle waveform data which has particular tonal characteristics. Namely, the leading address information read out from the waveform section information memory 15 is fed to an actual read address calculator 16 where it is set as an initial value of actual read address RAD to be generated by the calculator 16. Then, the waveform data are read out from the waveform memory 10 in accordance with actual read addresses RAD generated from the address calculator 16. Note that the above-mentioned parameters for selecting waveform data to be read out from the waveform memory 10 may be other than the key code KC and tone color information TC, such as information INF based on suitable performance information or setting information.

From the control unit 102, the actual read address calculator 16 receives, by way of the control register 113, a note-on signal instructing tone generation (namely, waveform generation), pitch information indicative of pitch information of a tone to be generated and other data. The pitch information may be a frequency number corresponding to a frequency of the tone to be generated, and well-known information or other information may be used as the frequency number. Basically, the actual read address calculator 16 generates data of the actual read address RAD that sequentially changes at a rate (pitch) corresponding to the received pitch information. Thus, by reading the samples of the waveform data from the waveform memory 10 in accordance with the actual read addresses RAD, a tone can be reproduced which has a pitch corresponding to the pitch information.

In the present embodiment, a virtual read address calculator 17 is provided for use in the above-mentioned "TSC control". The virtual read address calculator 17 generates, as virtual read address VAD, address data indicating from which address the waveform data should be read out at a current time point, in order to achieve desired time-axis stretch or compression of the waveform data. To this end, stretch/compression ratio data SCR indicating desired stretch or compression ratio and the above-mentioned pitch information are supplied to the virtual read address calculator 17, which thus outputs, as virtual read address VAD, address data sequentially changing at a variation inclination or slope calculated by modifying the advancing slope represented by the pitch information with the stretch/compression ratio data SCR. Modulating information MS based on the performance information and setting information and/or other information is supplied to a converting section 18, which, as necessary, converts the value by use of parameters, such as the key code KC and tone color information TC. The resultant output of the converting section 18 is supplied to the virtual read address calculator 17 as the stretch/compression ratio data SCR. For simplicity of description, the virtual read addresses VAD will be described hereinbelow as corresponding to absolute addresses in the waveform memory 10, although they may be relative addresses that are not directly related to the absolute addresses. Thus, necessary absolute address data (such as the above-mentioned leading or start address information) may be given from the actual read address calculator 16 to the virtual read address calculator 17, and comparisons between the actual read addresses RAD and virtual read addresses VAD may be directly made by a shift control circuit 14. Where the virtual read addresses VAD are relative addresses (with the leading address of "0", for example), the virtual read addresses VAD to be passed to the shift control circuit 14 may comprise only relative addresses (with the leading address of "0", for example).

The shift control circuit 14 compares the actual read address RAD and virtual read address VAD, so as to give the actual read address calculator 16 an instruction to shift the actual read address RAD when the difference or deviation of the actual read address RAD from the virtual read address VAD has exceeded a predetermined value. In response to the shift instruction, the actual read address calculator 16 executes control to shift the actual read address RAD by an amount corresponding to a specific number of addresses for eliminating the difference of the actual read address RAD from the virtual read address VAD. Such shift control executed by the actual read address calculator 16 will be later described in detail.

Various registers 19 to 22 shown in FIG. 2 as belonging to the actual read address calculator 16 are for storing controlling variable data "i", "j", "Aij" and read pointer p for use in the shift control.

Cross-fade synthesis section 13, provided on the output side of the waveform memory 10, synthesizes two groups or parts of waveform data in a cross-fade fashion (cross-fade synthesis) during the shift control, in order to achieve a smooth waveform transfer by minimizing adverse influences of fluctuations in the read-out waveform due to a rapid change (shift) in the actual read addresses RAD. To this end, two groups of waveform data are read out from the waveform memory 10 and supplied via respective interpolating circuits 11 and 12 to the cross-fade synthesis section 13; that is, the two groups of waveform data are read out to the cross-fade synthesis section 13 through two cross-fading channels (primary and secondary cross-fading channels). The cross-fade synthesis may be performed in a variety of ways. This embodiment is designed in such a manner that the actual read address calculator 16 generates shifted actual read addresses RAD and simultaneously generates non-shifted actual read addresses as actual read addresses RAD2 for the subsidiary cross-fading channel, so as to read out two groups of waveform data W1 and W2 from the waveform memory 10 using the addresses RAD and RAD2. The read-out waveform data W1 and W2 are passed to the cross-fade synthesis section 13 via the interpolating circuits 11 and 12. In this preferred embodiment, the waveform data W1 read out using the actual read addresses RAD are processed as first or primary cross-fading waveform region data (through the first or primary cross-fading channel) and the waveform data W2 read out using the actual read addresses RAD2 are processed as second or subsidiary cross-fading waveform region data (through the second or subsidiary cross-fading channel); more specifically, the amplitude values of the waveform data W1 are scaled by cross-fade coefficients in decimal values sequentially increasing from "0" to "1" (fade-in) and the amplitude values of the waveform data W2 are scaled by cross-fade coefficients in decimal values sequentially decreasing from "1" to "0" (fade-out), so that the thus-scaled waveform data W1 and W2 are additively synthesized. It should be obvious that the manner of effecting the cross-fade synthesis is not limited to the above-mentioned and may be modified variously; for example, the fading-in/fading-out relationship between the primary and subsidiary cross-fading waveform region data may be reversed. The two groups of waveform data W1 and W2 may be read out from the waveform memory 10 on the time-divisional basis.

Each of the interpolating circuits 11 and 12 interpolates between samples of the corresponding waveform data W1 or W2 read out from the waveform memory 10. To this end, integer parts of the actual read addresses RAD and RAD2 are supplied to the waveform memory 10, while decimal fraction parts of the addresses RAD and RAD2 are supplied to the interpolating circuits 11 and 12 as interpolation parameters. Of course, the interpolating circuits 11 and 12 are not necessarily essential and may be omitted.

Variable data i, j and Aij are stored in the registers 19, 21 and 22 in association with the primary cross-fading waveform region data and subsidiary cross-fading waveform region data. The read pointer p stored in the register 20 is shared between the primary and subsidiary cross-fading channels.

Figure 3:
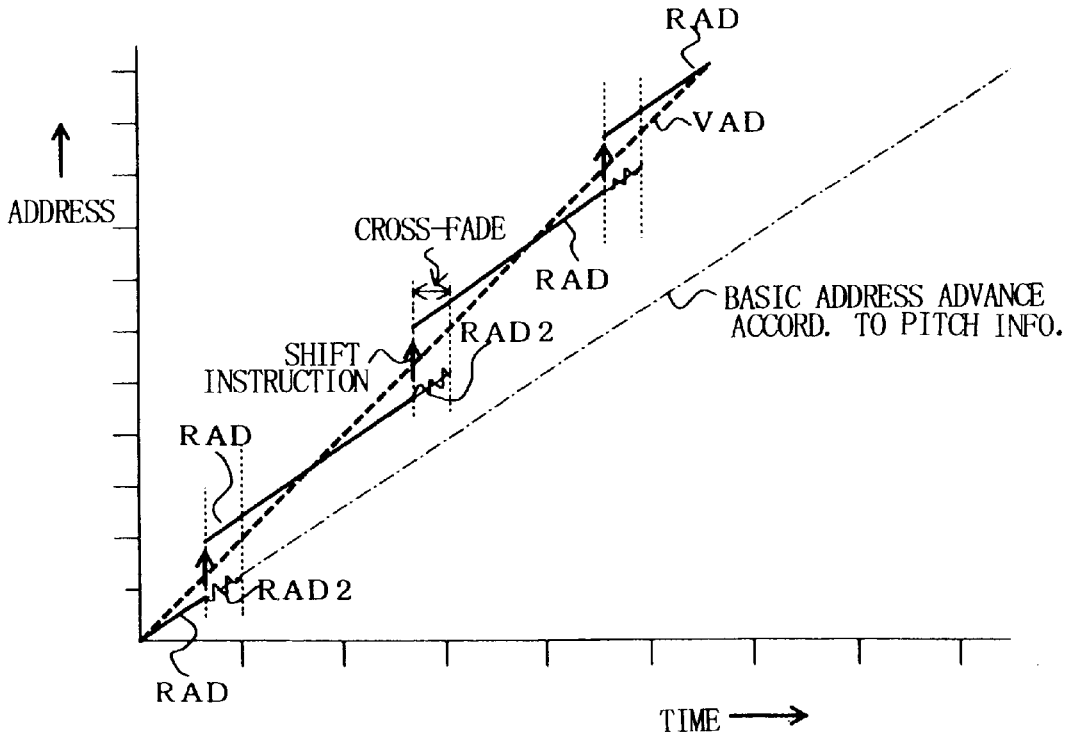
FIG. 3 is a graph illustratively showing a manner in which the address is advanced over time in a waveform memory during compression control based on the TSC control along the time axis of waveform data according to the present invention.
Figure 4:
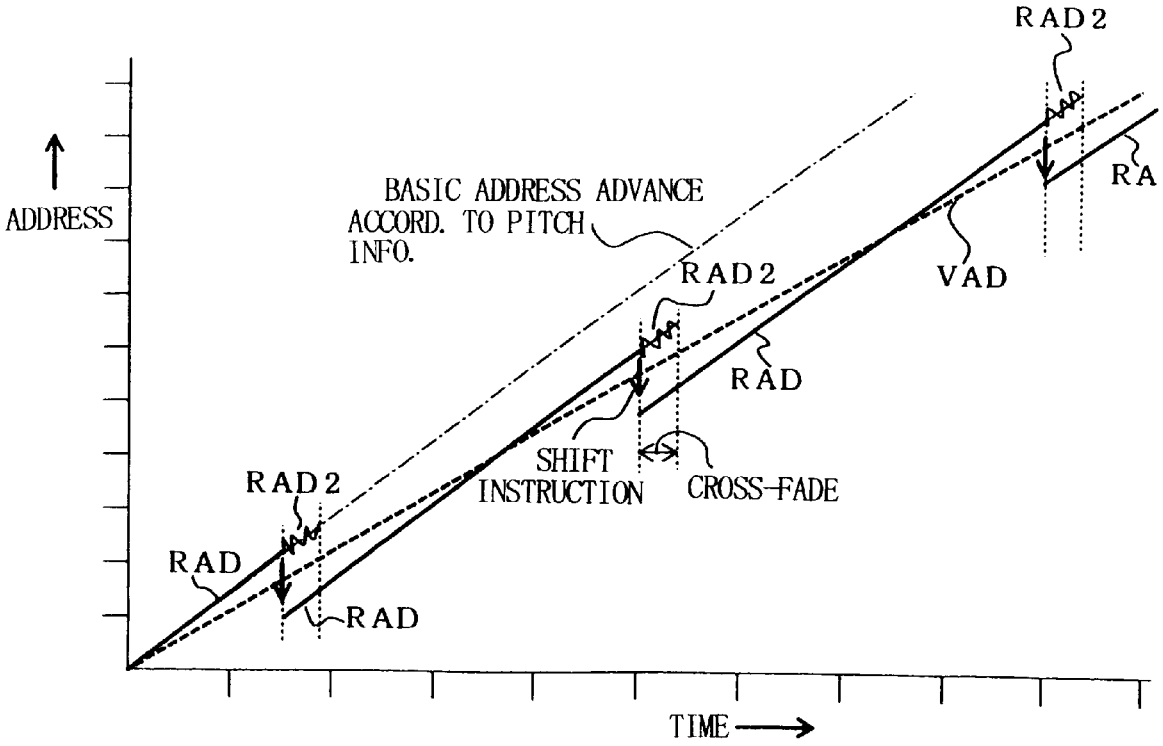
FIG. 4 is a graph illustratively showing a manner in which the address is advanced over time in the waveform memory during stretch control based on the TSC control.

Before going into further details, the basic concept of the TSC control carried out by the waveform generating section 111 of FIG. 2 is described by way of example in relation to FIGS. 3 and 4.

FIG. 3 is a graph illustratively showing a manner in which addresses are advanced over time in the waveform memory during compression control based on the TSC control scheme, where the horizontal axis represents time and the vertical axis represents the address. The starting point of the vertical axis represents the leading or start address of a selected set of waveform data. A dot-and-dash line represents an example of a basic address advance or progression based on pitch information, and a heavy broken line represents an example of an advance of virtual read address VAD. If the stretch/compression ratio data SCR is of value "1", the advance of virtual read address VAD coincides with the basic address advance represented by the dot-and-dash line and no time-axis variation occurs. If the time axis is to be compressed, the stretch/compression ratio data SCR takes an appropriate value equal to or greater than "1" so that the advancing slope of the virtual read address VAD becomes relatively great or steep as shown. Heavy solid line represents an example of an advance path of actual read addresses RAD. The advancing slope of the actual read address RAD coincides with the basic address advance represented by the dot-and-dash line. In this case, because the varying or advancing slope of the virtual read address VAD is relatively great, the advance of the actual read address RAD becomes slower and slower than that of the virtual read addresses VAD as the time passes. Once the difference or deviation of the actual read address RAD from the virtual read address VAD has exceeded a predetermined value, the shift control circuit 14 issues a shift instruction (designated by an arrow), so that the actual read address RAD is shifted by an appropriate amount in such a direction to eliminate the difference. This way, the advance of the actual read addresses RAD is varied in line with that of the virtual read addresses VAD while maintaining the varying or advancing slope as dictated by the pitch information, and presents characteristics compressed in the time-axis direction. Thus, by reading out waveform data W1 from the waveform memory 10 in accordance with such actual read addresses RAD, it is possible to obtain a waveform signal, indicative of a waveform compressed in the time-axis direction, without varying the pitch of the tone to be reproduced.

Preferably, the shift of the actual read address RAD in the direction to eliminate its difference from the virtual read address VAD is carried out in such a manner that a smooth interconnection is achieved between the waveform data having been read out immediately before the shifting and the waveform data to be read out immediately after the shift. As an example, the shift may be carried out in such a manner that the interconnection occurs at respective points where the fundamental wave components of the stored waveform data are in same phase. As another example, the actual read address RAD may be shifted over a length corresponding to an integer multiple of the number of samples contained in one cycle of the stored waveform data. As still another example, the shift may be carried out in such a manner that the interconnection occurs at respective points of substantially same amplitude value and advancing slope.

FIG. 4 is a graph illustratively showing a manner in which the address is advanced over time in the waveform memory during stretch control based on the TSC control. In this case, the varying or advancing slope of the virtual read addresses VAD represented by the heavy solid line is relatively small as shown. Thus, the advance of the actual read addresses RAD becomes faster and faster than that of the virtual read addresses VAD as the time passes. Once the difference of the actual read address RAD from the virtual read address VAD has exceeded a predetermined value, the shift control circuit 14 issues a shift instruction (designated by an arrow), so that the actual read address RAD is shifted by an appropriate amount in such a direction to eliminate the difference. This way, the advance of the actual read addresses RAD is varied in line with that of the virtual read addresses VAD while maintaining the advancing slope as dictated by the pitch information, and presents characteristics stretched in the time-axis direction. Thus, by reading out waveform data W1 from the waveform memory 10 in accordance with such actual read addresses RAD, it is possible to obtain a waveform signal, indicative of a waveform stretched in the time-axis direction, without varying the pitch of the tone to be reproduced.

In FIGS. 3 and 4, each ripple-shape line represents an advance of the actual read addresses RAD2 in the subsidiary cross-fading channel (i.e., for the subsidiary cross-fading waveform region data). As shown, in response to the shift instruction, the actual read addresses RAD2 for the subsidiary cross-fading waveform region data are generated along an extension of the advance of unshifted actual read addresses RAD at a same rate (i.e., varying or advancing slope) as the actual read addresses RAD. In a suitable cross-fade period, cross-fade synthesis is carried out in such a manner that a smooth waveform transfer is achieved from the waveform data W2, read out in accordance with the actual read addresses RAD2 for subsidiary cross-fading waveform region data, to the waveform data W1, read out in accordance with the actual read addresses RAD for primary cross-fading waveform region data. In this case, it is only necessary that the actual read addresses RAD2 for subsidiary cross-fading waveform region data be generated for a given cross-fade period.

Note that execution of such cross-fade synthesis is not necessarily essential although it is very preferable. For example, a smooth interconnection between the waveform data read out before and after the shift of the actual read address RAD may be achieved by issuing a shift instruction at a point when the waveform data read out immediately before the shift and the waveform data read out immediately after the shift agree with each other in phase. Further, because any other form of waveform processing is also possible, the present invention may employ a scheme of reading one group of the waveform data W1 using only the actual read address RAD, instead of executing the cross-fade synthesis.

In the case where the cross-fade synthesis is employed, the fading-in/fading-out relationship between the primary and subsidiary cross-fading waveform region data may be reversed from that described above in relation to FIGS. 3 and 4. Namely, in a cross-fade period, addresses being advanced along the extension of the actual read addresses RAD may be maintained directly as actual read addresses RAD and shifted actual read addresses may be used as actual read addresses RAD2 for subsidiary cross-fading waveform region data. In such a case, upon termination of the cross-fade synthesis, the actual read addresses RAD2 for subsidiary cross-fading waveform region data are changed to actual read addresses RAD so that the actual read addresses RAD are advanced along the extension. This way, the cross-fade can be considerably simplified because it is only necessary to set shifted actual read addresses as actual read addresses RAD2 for subsidiary cross-fading waveform region data while allowing the actual read addresses RAD for primary cross-fading waveform region data to be advanced as before. This approach is employed in detailed examples which will be described hereinafter.

Although, for simplicity of illustration and description, FIGS. 3 and 4 do not show a case where control is executed to repetitively read out a predetermined range of the waveform data set stored in the waveform memory 10, the TSC control scheme according to the present invention is also applicable to such a case. Namely, the TSC control scheme according to the present invention is applicable not only to the case where plural-cycle waveform data stored in the waveform memory are read out only once to reproduce a single tone but also the case where a predetermined range of the same waveform data set stored in the waveform memory is repetitively read out to reproduce a single tone. For this purpose, loop (repetition) control of the actual and virtual read addresses RAD and VAD may be carried out in both the actual read address calculator 16 and the virtual read address calculator 17 of FIG. 2, or loop (repetition) control of only the virtual read addresses VAD may be carried out only in the virtual read address calculator 17. The reason why the loop control of the virtual read addresses VAD may be carried out in only the virtual read address calculator 17 is that as long as the virtual read addresses VAD are loop-controlled, the actual read addresses RAD will be automatically loop-controlled in the track of the loop of the virtual read addresses VAD in response to occurrence of any difference or deviation from the virtual read addresses VAD.

Now, with reference to FIGS. 5 and 6, a description will be made about examples of stretch and compression, along the time axis, of a waveform which may be implemented by the TSC control scheme according to the present embodiment.

Figure 5:
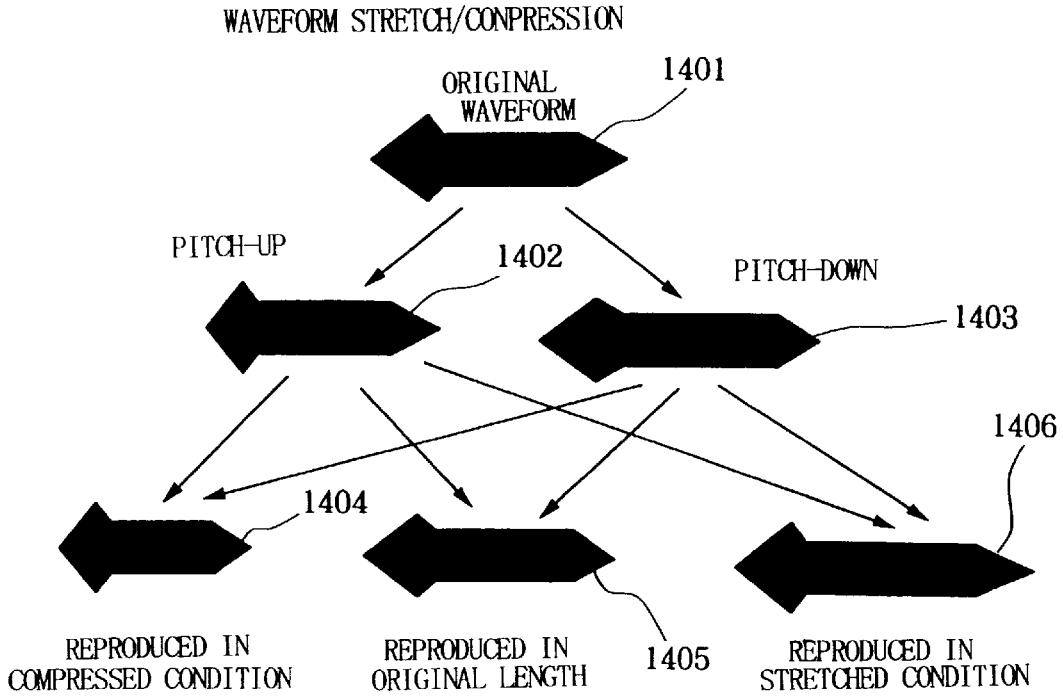
FIG. 5 shows exemplary manners in which the absolute time length of the original waveform is stretched and compressed along the time axis.
Figure 6:
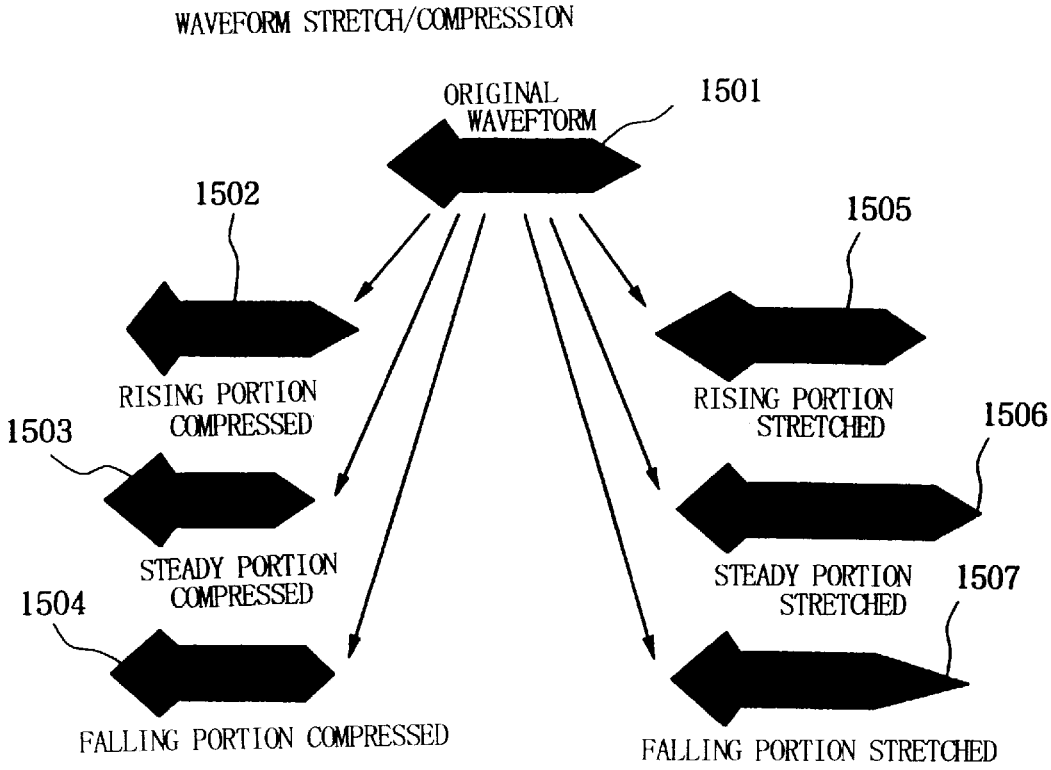
FIG. 6 is a diagram showing other exemplary manners in which various waveform control is carried out by applying the TSC control to reproduced waveforms.

In FIGS. 5 and 6, black symbols denoted by reference numerals 1401 and 1501 at the top of the figures represent original waveforms (each of which may be obtained by, for example, recording or sampling a plural-cycle waveform of a tone having a given original pitch) stored in the waveform memory 10. Note that each black symbol in FIGS. 5 and 6 represents a plural-cycle waveform and its contour generally corresponds to the envelope of the waveform, and the length (horizontal dimension) of the symbol represents a tone-generating time length while the width (vertical dimension) of the symbol represents amplitude.

FIG. 5 shows exemplary manners in which the absolute time length of the entire original waveform (stored original waveform) 1401 is stretched and compressed by interactions between the pitch control based on the pitch information and the TSC control according to the present embodiment. Black symbols 1402 and 1403 in the middle of the figure represent examples of waveforms read out only in accordance with the pitch information (i.e., waveforms read out with a stretch/compression ratio of "1"); more specifically, symbol 1402 represents an example of a read-out waveform with a pitch higher than (or raised from) that of the original waveform 1401 ("pitch-up waveform") while symbol 1403 represents an example of a read-out waveform with a pitch lower than (or lowered from) that of the original waveform 1401 ("pitch-down waveform"). Raising the pitch means reading out the original waveform 1401 faster or at a wider stride by advancing the read address at a higher rate, and by so doing, the time-axis length of the waveform is reduced. Conversely, lowering the pitch means reading out the original waveform 1401 slower or at a narrower stride by advancing the read address at a slower rate, and by so doing, the time-axis length of the waveform is increased. Therefore, in FIG. 5, the time length (tone-generating time length) of the raised-pitch waveform 1402 is smaller than that of the original waveform 1401 (reference tone-generating time length), and the time length of the lowered-pitch waveform 1403 is greater than that of the original waveform 1401.

Black symbols 1404, 1405 and 1406 at the bottom of FIG. 5 represent examples of waveforms obtained by optionally stretching and compressing the pitch-controlled waveforms 1402 and 1403 through the TSC control. More specifically, symbol 1404 represents an example of a waveform obtained by compressing the time length of the raised-pitch or lowered-pitch waveform 1402 or 1403 relative to the absolute time length of the original waveform 1401, symbol 1405 represents an example of a waveform obtained by restoring the time length of the raised-pitch or lowered-pitch waveform 1402 or 1403 back to the absolute time length of the original waveform 1401, and symbol 1406 represents an example of a waveform obtained by stretching the time length of the raised-pitch or lowered-pitch waveform 1402 or 1403 relative to the absolute time length of the original waveform 1401. Such control to stretch or compress the tone-generating time length is permitted by properly giving the stretch/compression ratio data SCR.

FIG. 6 is a diagram showing exemplary manners where various waveform control is carried out by applying the TSC control to a selected part, rather than the whole, of reproduced waveforms. Black symbol 1502 represents an example of a waveform obtained by compressing the time length of only an attack or rising portion of the original waveform 1501, black symbol 1503 represents an example of a waveform obtained by compressing the time length of only a steady or sustain portion of the original waveform 1501, and black symbol 1504 represents an example of a waveform obtained by compressing the time length of only a release or falling portion of the original waveform 1501. Further, black symbol 1505 represents an example of a waveform obtained by stretching the time length of only the attack portion of the original waveform 1501, black symbol 1506 represents an example of a waveform obtained by stretching the time length of only the sustain portion of the original waveform 1501, and black symbol 1507 represents an example of a waveform obtained by stretching the time length of only the release portion of the original waveform 1501. Through the TSC control scheme according to the present embodiment, such control to partly change the time length can be carried out independently of the pitch control. For example, the local or partial TSC control can be achieved by giving and changing, in real time during tone generation, the performance information or setting information for controlling the stretch/compression ratio data SCR.

The TSC control scheme proposed by the present invention can be utilized, in a tone generating device using a waveform memory as a tone source, as novel control parameters for enhancing time-axis or time-varying expression such as variations in style of performance or tonal effect.

Namely, the TSC control can be utilized as time-axis parameters in controlling a style of performance or tonal effect. Specific examples of such time-axis parameters include ones for:

(1) controlling a cycle of periodic modulation effect such as a vibrato or tremolo;

(2) controlling a time of a transient pitch modulation effect such as a pitch bend;

(3) controlling a rising or falling time, such as an attack or decay time of a tone;

(4) positively and freely imparting a "swing" to a tone;

(5) eliminating monotonousness of loop control (including looped read control for generating a sustain sound or loop control of a vibrato);

(6) controlling a time of control for linking sounds, such as a slur (linking time);

(7) controlling the length of an ornament (decorative sound);

(8) compensating for changes in a tone generating period when the stored original waveform is read out at different pitches;

(9) creating variations of the stored original waveform by reading out the original waveform while locally or partly controlling its time-axis; and

(10) optionally controlling a tone generating period length in reproducing a sound based on the original waveform, by variably controlling an entire tone generating period length of the original waveform (e.g., controlling the time length to coincide with a note length of a musical staff given via automatic performance information).

Thus, let's assume here that the organization of the waveform generating section 111, particularly the contents of the waveform data to be stored in the waveform memory 10, are set optionally in accordance with specific purposes or needs for which the TSC control scheme is to be utilized.

For example, the waveform memory 10 has prestored therein at least one set of waveform data of a plural-cycle tone waveform, for each tone color. In addition, in the waveform memory 10, there are prestored, for each of the tone colors, two or more sets of waveform data in corresponding relations to pitches or ranges, touch intensity (velocity) values, or styles of performance or tonal effects (such as a vibrato, tremolo, pitch bend and slur). However, it is not necessary that different sets of stored waveform data be used for each of the tone colors; instead, a same set of stored waveform data may be shared for two or more tone colors. In the case where a same set of stored waveform data is shared, the waveform can be modified as necessary in accordance with the TSC control of the present embodiment in combination with any other suitable waveform control technique. Further, the plural-cycle waveform data stored for a tone may be of either an entire waveform from a rise (start) to fall (end) of the tone or a predetermined looping range of the waveform. In the case where the predetermined looping range of the plural-cycle waveform is stored, the waveform data within the looping range are read out in a repetitive manner during the tone generating period. Further, the plural-cycle waveform to be stored may be one maintaining a tone volume envelope of the original waveform or one having a tone volume envelope normalized to predetermined level. Of course, where a tone waveform, having imparted thereto effects including a tone volume variation such as a tremolo, is to be stored as an original waveform, the waveform data are stored with the tone volume envelope maintained in the original form (or processed as necessary) instead of being normalized to predetermined level. The plural-stored waveform to be stored may be other than one sampled from an external source, such as one having undergone any necessary waveform processing like cross-fade synthesis or filtering.

To facilitate a smooth waveform interconnection at the point of the shift control in the TSC control, it is preferable to perform management of the stored waveforms in consideration of such a waveform interconnection. To this end, the waveform data to be stored in the waveform memory 10 may be managed with the data divided in advance into a plurality of data sections for management purposes, as will be described below.

Namely, the plural-cycle waveform of a tone is divided into a plurality of data divisions, each having a suitable size, for subsequent management, and a shift control point for the TSC control is set for every such data divisions. In this case, the plural-cycle waveform data of a tone stored in the waveform memory 10 are pre-analyzed, and points in the plural cycles which are in a same phase with each other (same-phase points) are determined as respective start points of the individual data divisions. In other words, such same-phase points are found in the waveform data, and the waveform data are divided at the same-phase points to define the data divisions. Waveform data over two or more cycles may be contained in a single data division. In short, boundaries between every adjacent data divisions are the same-phase points and it is sufficient that each of the data divisions be defined to be able to be smoothly connected to another data division. The same-phase points are points which are identical with each other in waveform amplitude value and in sloping direction of the waveform. The same-phase points may typically be zero phase-angle points where the waveform amplitude zero-crosses from a negative value to a positive value, but may be points of any other phase angle. Of course, the same-phase points need not necessarily correspond to a precise phase angle and may be an approximate position which could permit a relatively smooth waveform interconnection. Note that each of the data divisions does not or need not coincide with a pitch cycle corresponding to a fundamental pitch of the waveform data, and the data divisions need not be the same in size and may have different sizes as necessary. Furthermore, it is preferable that the boundary points between the adjacent data divisions be determined with resolution finer than a phase angle corresponding to one address of the waveform memory 10, because this approach could define the same-phase points with higher precision.

By managing the waveform data to be stored in the waveform memory with the waveform data divided into a plurality of data divisions in the above-mentioned manner, the actual read address calculator 16, in response to a shift instruction issued from the shift control circuit 14 (FIG. 2), can perform control such that once the actual read address RAD has been advanced to the end of one of the data divisions it belongs to, it is shifted to a start point of another data division, so as to carry out the waveform shifting by an amount corresponding to one or more of the data divisions. Because each of the data divisions is defined in such a manner to smoothly connect to another data division, such read address shifting by an amount corresponding to one or more of the data divisions, when the actual read address RAD has been shifted in accordance with the TSC control, permits an interconnection between waveforms of different data divisions at points of substantially the same phase; thus, waveforms to be interconnected in fragments (each comprising the data division) due to the stretch or compression control can be interlinked smoothly.

Note that the "read address shifting by an amount corresponding to one or more of the data divisions" does not necessarily mean that the data readout should be initiated at the beginning of a data division of a new (i.e., shifted-to) waveform only after the data readout of an old (i.e., shifted-from) waveform reaches the end of a data division in question. Namely, the "read address shifting by an amount corresponding to one or more of the data divisions" also includes a form of control for, in response to a shift instruction given during data readout of a data division of an old waveform, starting reading out a data division of a new waveform at a corresponding intermediate point thereof. In such a case as well, a good phase connection is expected because relative intermediate positions in the two data divisions correspond to each other. If the cross-fade synthesis is carried out as in the current embodiment, a sufficiently good, smooth waveform interconnection may be achieved even with the shift control carried out at such intermediate points of the data divisions. In the following specific example, such intermediate points of data divisions are designated by read pointer p, which allows for designation of corresponding relative address locations in the middle of any data divisions.

Figure 7:
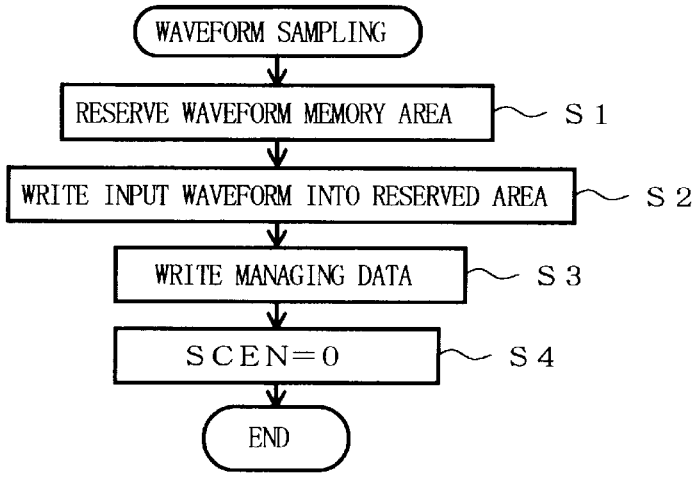
FIG. 7 is a flow chart illustrating a step sequence for creating waveform data to be stored in the waveform memory of FIG. 2.
Figure 8:
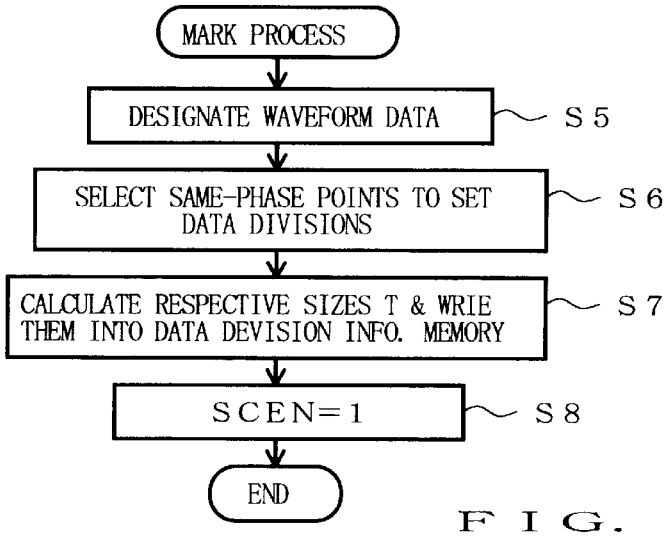
FIG. 8 is a flow chart illustrating a step sequence of a process for defining (marking) data divisions in the waveform data to be stored in the waveform memory.

FIGS. 7 and 8 are flow charts illustratively showing step sequences of creation and previous management of the waveform data to be stored.

FIG. 7 shows a step sequence of a process for sampling (recording) desired waveform data from an external source and storing the sampled waveform data into the waveform memory 10. First, at step S1, a necessary storage area is reserved in the waveform memory 10. Thereafter, at step S2, the waveform data of the input waveform (the sampled waveform itself or a waveform obtained by subjecting the sampled waveform to suitable processing) are written into the reserved storage area as one file or set of waveform data. Then, at step S3, managing data necessary for the waveform data stored in the reserved storage area (such as data indicative of a file name of the waveform data and the storage area) are written into a predetermined managing data area. Further, at step S4, "0" is written as a stretch/compression enable flag SCEN for the waveform data stored in the storage area. The stretch/compression enable flag SCEN is a flag indicating whether the TSC control according to the present embodiment may be carried out or not; the flag SCEN at a value "0" indicates that the TSC control should not be carried out while the flag SCEN at a value "1" indicates that the TSC control may be carried out. Because the current embodiment is arranged to carry out the TSC control after the above-mentioned "data division" management, the TSC control scheme can not be carried out unless the "data division" management is executed. Therefore, the TSC control scheme can not be carried out at a stage when only the waveform data have been written in the waveform memory 10, and this is the reason why the stretch/compression enable flag SCEN is set to the value "0" at step S4. The enable flag SCEN may be stored as an attachment of the managing data for each file.

Figure 9:
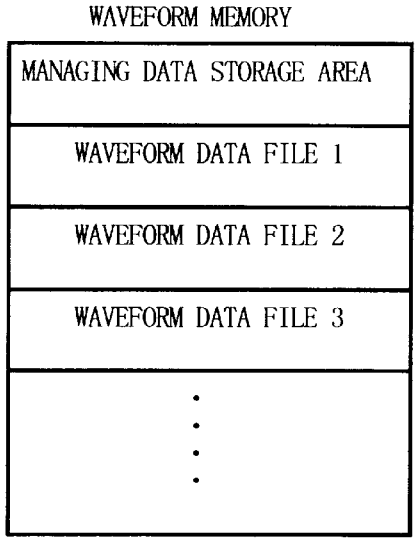
FIG. 9 is a diagram schematically showing an exemplary storage format in the waveform memory.

FIG. 9 is a diagram schematically showing an exemplary storage format in the waveform memory 10, for reference purposes. In FIG. 9, "waveform data file 1" is an area storing plural-cycle waveform data of a single tone, and "waveform data file 2" is an area storing plural-cycle waveform data of another single tone. A great number of such storage areas are reserved in the waveform memory 10, so that plural-cycle waveform data of a great number of tones are stored in the individual storage areas. Note that the waveform data to be stored as a file need not necessarily be all the waveform data of a tone input from the external source and may be a desired part thereof. Therefore, to reproduce a tone, only one of the waveform data files or sets may be used in one case, and a plurality of the waveform data files may be used in another case.

Referring back to FIG. 8, a "mark process" is for defining (marking) the above-mentioned data divisions of the waveform data. First, at step S5, a desired one of the waveform data files for which the data division definition (marking) is to be conducted is designated and read out from the waveform memory 10 for visual presentation on a paper or display. Then, at step S6, a plurality of "same-phase points" are selected from the displayed waveform data list and the waveform data are divided into a plurality of data divisions on the basis of the selected same-phase points, so that the data divisions of the waveform data are set. After that, at step S7, respective sizes T of the individual data divisions are determined and written into the waveform division information memory 15 (FIG. 2) in association with the file name of the waveform data. Then, at step S8, the stretch/compression enable flag SCEN for the waveform data file is set to the value "1" to indicate that the TSC control scheme can now be conducted. Note that the respective sizes T of the individual data divisions may be stored in the managing data storage area within the waveform memory 10; that is, the stored contents of the waveform division information memory 15 may be contained in the managing data storage area of FIG. 9. In the following description, absolute address data indicative of the respective head addresses of the individual waveform data file stored in the waveform memory 10 and data indicative of respective sizes T of the individual data divisions will be explained as being stored in the waveform division information memory 15. As noted earlier, it is preferable that the boundary points between the adjacent data divisions be defined (marked) with resolution finer than a phase angle corresponding to one address of the waveform memory 10. Therefore, the data indicative of respective sizes T of the individual data divisions each include a decimal value rather than being comprised only of an integral value corresponding to the total number of addresses in the waveform memory 10.

Now, a detailed description will be made about several exemplary applications of the TSC control scheme.

[Application to Periodic Tone Modulation Control]

First, a specific example will be described where a periodic modulation effect, such as a vibrato or tremolo, is controlled in accordance with the TSC control scheme employed in the present embodiment.

To this end, as preliminary operations, a vibrato or tremolo performance is actually executed at a predetermined reference pitch (or in correspondence with an optional pitch or note range) by use of a desired natural musical instrument such as a stringed or wind instrument, and a resultant performance tone is recorded (sampled) to store the waveform data into the waveform memory 10 in the above-described manner. At the same time, other necessary information is also stored into the waveform division information memory 15. Preferably, waveform data of the performance tone without a predetermined modulation (such as a vibrato) and waveform data of the performance tone with that predetermined modulation are stored, for a predetermined tone color (natural instrument tone color). It is also preferable to store waveform data of performance tones corresponding to several different depths of modulation; in this case, in order to guarantee common effectiveness of the TSC control parameter, it is only necessary that a performance be executed in such a manner that only the modulating depth is varied while the modulating cycle is kept as equal as possible and the tone pitch is of course kept identical for every modulating depth.

FIGS. 10A to 10D are diagrams showing exemplary manners in which the waveform data are stored in the waveform memory 10 and the waveform data are divided into data divisions. In the illustrated examples, a plural-cycle waveform of attack portion (attack-portion waveform) representing a rising portion of a tone and plural-cycle waveforms of looping portion (loop-portion waveforms) each representing a succeeding sustain portion of the tone are stored in the memory 10. In the illustrated examples, the stored loop-portion waveforms includes one without modulation (FIG. 10B), one with medium level modulation (FIG. 10C) and one with great modulation (FIG. 10D), and the only attack-portion waveform (FIG. 10A) is stored for use irrespective of presence or absence of modulation and levels of modulation. Note that these examples are merely for illustrative purposes and any suitable waveforms may be made or obtained and stored in any other suitable form. For example, a plurality of attack-portion waveforms may be prepared in corresponding relations to presence or absence of modulation and levels of modulation. In FIGS. 10A to 10D, rightward arrows represent an address incrementing direction in the waveform memory 10.

Figure 10A:
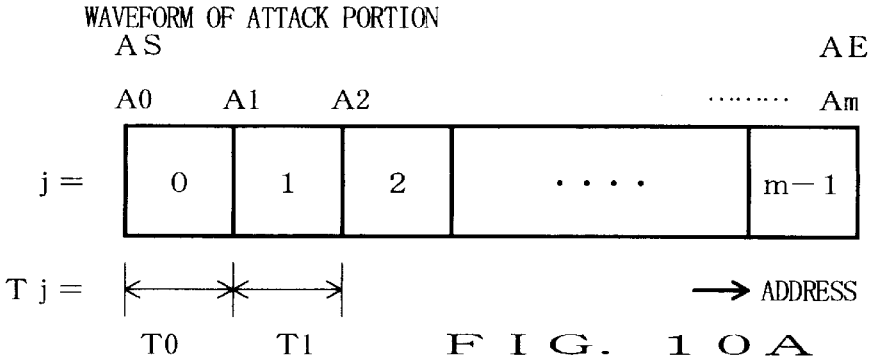
FIGS. 10A to 10D are diagrams showing exemplary manners in which the waveform data are stored in the waveform memory and the waveform data are divided into data divisions for management purposes.

FIG. 10A shows the attack-portion waveform divided into "m" (here, "m" is an arbitrary natural number) data divisions. Here, for convenience of description, the data divisions are distinguished from each other using variable j that is an ordinal number sequentially taking values "0", "1", "2", . . . , "m-1". "A0", "A1", "A2", . . . represent start addresses of the corresponding data divisions and are generically denoted as "Aj". "T0", "T1", "T2", . . . represent sizes of the corresponding data divisions and are generically denoted as "Tj", and the size Tj is, for example, data indicative of the number of addresses (the number of waveform samples) contained in the data division and including a decimal fraction part as well as an integer part as noted earlier.

Figure 10B:
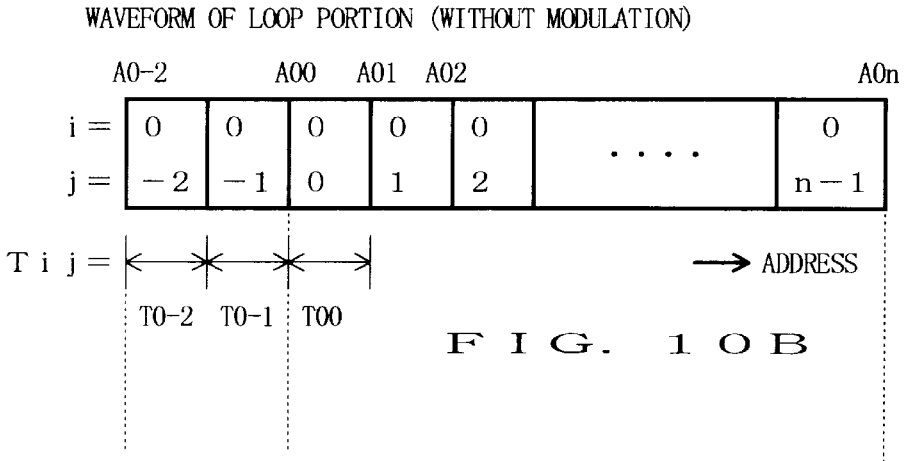
Figure 10C:
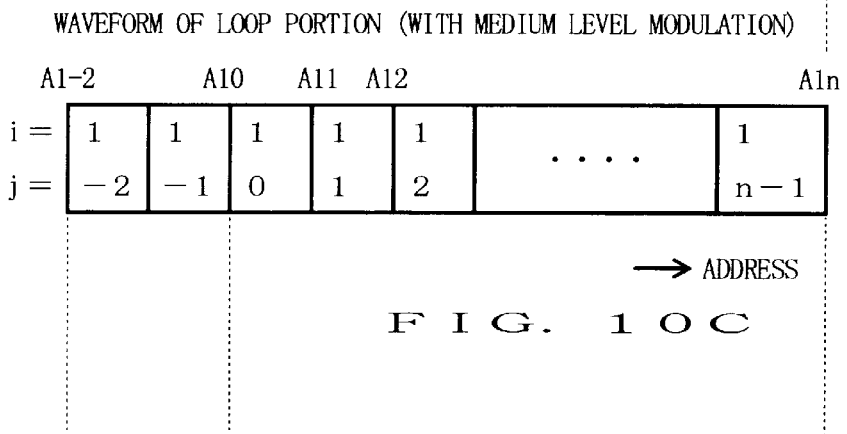
Figure 10D:
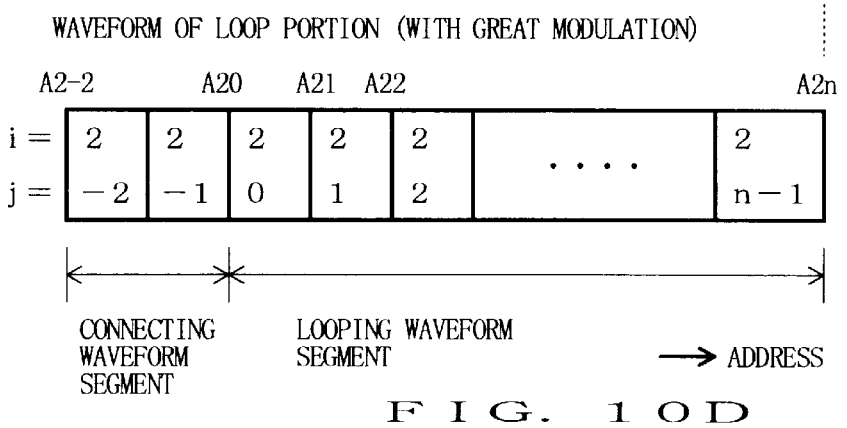

FIGS. 10B, 10C and 10D show the loop-portion waveform divided into "n+2" (here, "n" is an arbitrary natural number) data divisions. Here, depths of modulation are distinguished from each other using variable i that takes one of values "0", "1" and "2". "i=0" represents absence of modulation (FIG. 10B), "i=1" represents medium level modulation (FIG. 10C), and "i=2" represents great modulation (FIG. 1OD). "j" is an ordinal number sequentially taking values "−2", "−1", "0", "1", "2", . . . , "n-1". "A0-2", "A00", "A01", . . . "A1-2", "A10", "A11", . . . , "A2-2", "A20", "A21", . . . represent start addresses of the corresponding data divisions in the loop-portion waveforms and are generically denoted as "Aij". Sizes of the corresponding data divisions are generically denoted as "Tij", and the size Tij is data indicative of the number of addresses (waveform samples) contained in the data division as in FIG. 10A.

In each of the loop-portion waveforms, the first two data divisions (denoted by j=−2 and j=−1) constitute a "connecting waveform segment" provided to guarantee a smooth connection with the attack-portion waveform, which is not subjected to the loop control, i.e., repetitive readout; in the illustrated example of FIG. 10D, a "looping waveform segment" that is to be subjected to the loop control or repetitive readout consists of n data divisions denoted by j=0, 1, 2, . . . , n−1. The connecting waveform segment is a processed segment obtained by a cross-fade synthesis between a first predetermined waveform segment smoothly connecting with the end point of the attack-portion waveform and a second predetermined waveform segment smoothly connecting with the start point of the loop-portion waveform, and it serves to provide for a smooth connection or transfer from the end point of the attack-portion waveform to the start point of the loop-portion waveform. With such a connecting waveform segment, a smooth interconnection is achieved no matter which loop-portion waveform the attack-portion waveform may be connected to at the time of tone reproduction. Note that the looping waveform segment may be a particular range of the original waveform which noticeably presents characteristics of a modulation effect in question. In such a case, a range of the original waveform equivalent to about ½ or integer multiple of the modulating cycle may be selected, in order to prevent unnaturalness of the modulating cycle based on the loop readout.

In the examples of FIGS. 10A to 10D, the waveform readout during the reproduction may essentially be by the conventionally-known loop readout technique, except for portions pertaining to the TSC control. Namely, once an instruction to start tone generation is given, the waveform data of the attack-portion waveform (FIG. 10A) are read out once from start address AS to end address AE, and then the connecting waveform segment of any one of the loop-portion waveforms shown in FIGS. 10B to 10D is read out. Thereafter, the looping waveform segment of the loop-portion waveform is read out in a repetitive manner. As previously noted, such looped readout control may be carried out in both the actual read address calculator 16 and the virtual read address calculator 17, or only in the virtual read address calculator 17.

When the modulating depth is changed in real time in the course of tone reproduction, the loop-portion waveform to be read out is switched to another one. If, for example, the modulating depth is changed to the medium level modulation when a particular data division (e.g., j=1) in the loop-portion waveform of FIG. 10D is being read out with the great modulating depth, the data readout switches to a corresponding data division (e.g., j=1) of the loop-portion waveform of FIG. 10C. When an intermediate modulating depth between the prepared depths is desired, it may be provided by reading out two or more of the stored waveforms of different modulating depths (e.g., waveforms of FIGS. 10C and 10D) and interpolatively synthesizing the read-out waveform in accordance with the desired depth; this approach is conventionally known and therefore is not specifically shown here.

The following paragraphs describe the stored information in the waveform division information memory 15 with reference to FIGS. 10A to 10D. For example, data of the waveforms shown in FIGS. 10A to 10D are managed as waveforms for a given tone color, and the following information is stored in the waveform division information memory 15 as data division information for that tone color:

- start address (absolute address) A0 of the first data division of the attack-portion waveform;
- data (j=0, 1, 2, . . . , m−1) indicative of the respective sizes Tj of the individual data divisions of the attack-portion waveform;
- start addresses A0-2, A1-2, A2-2 (each absolute address) of the respective first data divisions of the individual loop-portion waveforms having different modulating depths; and
- data (i=0, 1, 2; j=−2, −1, 0, 1, 2, . . . , n−1) indicative of the respective sizes Tij of the individual data divisions of the loop-portion waveforms having different modulating depths.

In the waveform division information memory 15, there may be stored, in place of or in addition to the data indicative of the data division sizes T, absolute address values of the start addresses of the individual data divisions. However, because the absolute address values require more bits and hence more data storage space, the data indicative of the data division sizes T are more preferable because they require a smaller number of bits. Thus, storing the waveform division information in the waveform division information memory 15 as mentioned above is more advantageous in that it can effectively save the limited storage capacity of the memory 15.

Because the size Tj or Tij of each of the data divisions represents a difference between the start address values of adjacent data divisions, the following relationships may be obtained:

$$Tj=Aj+1-Aj$$

$$Tij=Aij+1-Aij$$

Thus, the start addresses Aj and Aij may be evaluated from $$Aj=A0+\Sigma T$$

where ΣT represents a result of cumulatively adding Tj in the range of j=0, 1, 2, . . . , j−1, and $$Aij=Ai-2+\Sigma Ti$$

where ΣTi represents a result of cumulatively adding Tij in the range of j=−2, −1, 0, 1, 2, . . . , j−1. Because each of the sizes Tj and Tij of the data divisions is of a value including a decimal fraction part as well as an integer part corresponding to an address of the waveform memory 10, each of the start addresses Aj and Aij of the data divisions calculated on the basis of the sizes is also of a value including an integer part corresponding to an address of the waveform memory 10 and a decimal fraction part.

Because, as previously mentioned, the read address is shifted by an amount corresponding to one or more of the data divisions according to the TSC control scheme, the start address Aj or Aij of the shifted-to data division may be evaluated using the above equation. The register 21 of FIG. 2 stores the thus-evaluated start address Aj or Aij of the data division being currently read out. Note that the TSC control scheme employed in the present embodiment is applicable to reproduction of the attack-portion waveform as well as reproduction of the loop-portion waveform. While only the start address Aij is shown in FIG. 2 as stored in the register, it should be obvious that the start address Aj is stored in the register 21 when the attack-portion waveform is being read out.

The register 19 of FIG. 2 stores variable j indicative of a data division being currently read out, and the register 22 stores variable i indicative of a modulating depth of a currently read-out loop-portion waveform. To perform cross-fade synthesis, the data j, Aij and i indicative of the currently read-out data division, etc. of each of the primary and subsidiary cross-fading waveform region data are stored into these registers 19, 21 and 22, respectively.

Further, the register 20 of FIG. 2 stores the read pointer p pointing to one of the actual read addresses RAD. The read pointer p is such data that, for each of the data divisions, is set to a predetermined initial value at the beginning of the data division and then sequentially increments (or decrements) periodically every predetermined sampling cycle; namely, the read pointer p is, so to speak, progressive phase (read address) data. Actual read address RAD in the form of an absolute address value is generated by adding the start address Aj or Aij of the data division to the read pointer p. As well known, if each address of the waveform memory 10 is expressed in an integral value, pitch information is represented in a value including a decimal fraction part; thus, the read pointer p is a value including a decimal fraction part. Accordingly, when the data readout is to shift from one (first) data division to another (second) data division, a value of the size Tj or Tij (including a decimal fraction part) of the first data division is subtracted from a current value of the read pointer p (also including a decimal fraction part), and the subtraction result or difference is added, as an initial value of the read pointer p of the second data division, to the start address Aj or Aij of the second data division. This is also a conventionally-known approach for accurately achieving a desired pitch frequency and hence will not be described in greater detail here. In the cross-fade synthesis, the read pointer p is shared for the primary and subsidiary cross-fading waveform region data, i.e, between the primary and subsidiary cross-fading channels.

Although not specifically shown, registers similar to the registers 19, 20, 21 and 22 are also provided in connection with the virtual read address calculator 17. Because the subsidiary cross-fading waveform region data is required in the virtual read address calculator 17, it is only necessary to store one set of variables i and j and start address Aij (or Aj) for the primary cross-fading waveform region data. Of course, the contents of the read pointers p in the actual read address calculator 16 and in the virtual read address calculator 17 differ from each other. More specifically, while the read pointer p in the actual read address calculator 16 increments at a rate or advancing slope corresponding only to the "pitch information", the read pointer p in the virtual read address calculator 17 increments at an slope corresponding to a value determined by variably controlling the pitch information with a stretch/compression ratio SCR.

Whereas variable i has been described above as corresponding to a modulating depth because the description has been given in relation to modulation, it may correspond to any other waveform modulating factor or parameter as long as it designates a variation of a waveform. For example, the present invention may be practiced using, as variable i, any desired waveform modulating factor such as a variable indicative of brightness of a tone color, performance intensity (velocity) or elapsed time from a start point of tone generation, or a mere random number.

The following paragraphs describe a detailed example of processing carried out during tone reproduction.

Figure 11:
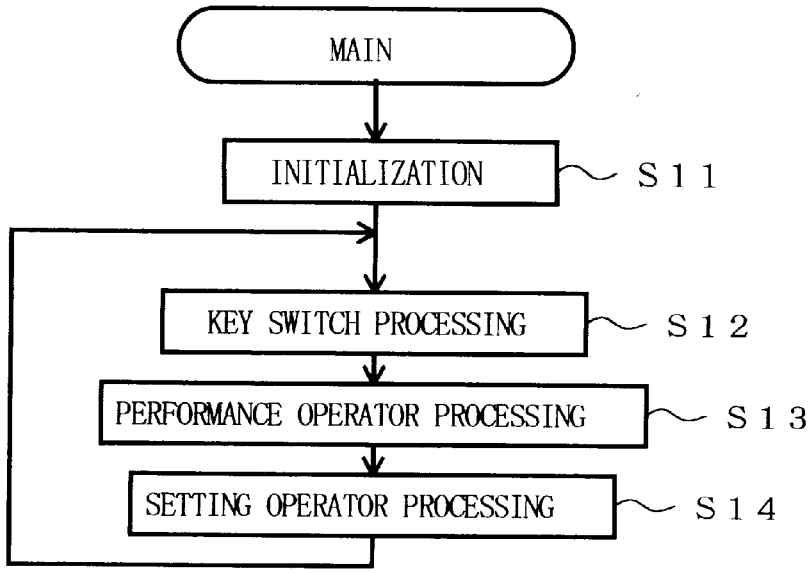
FIG. 11 is a flow chart illustrating an example of a main routine in a processing program run by a control unit of FIG. 1.
Figure 12:
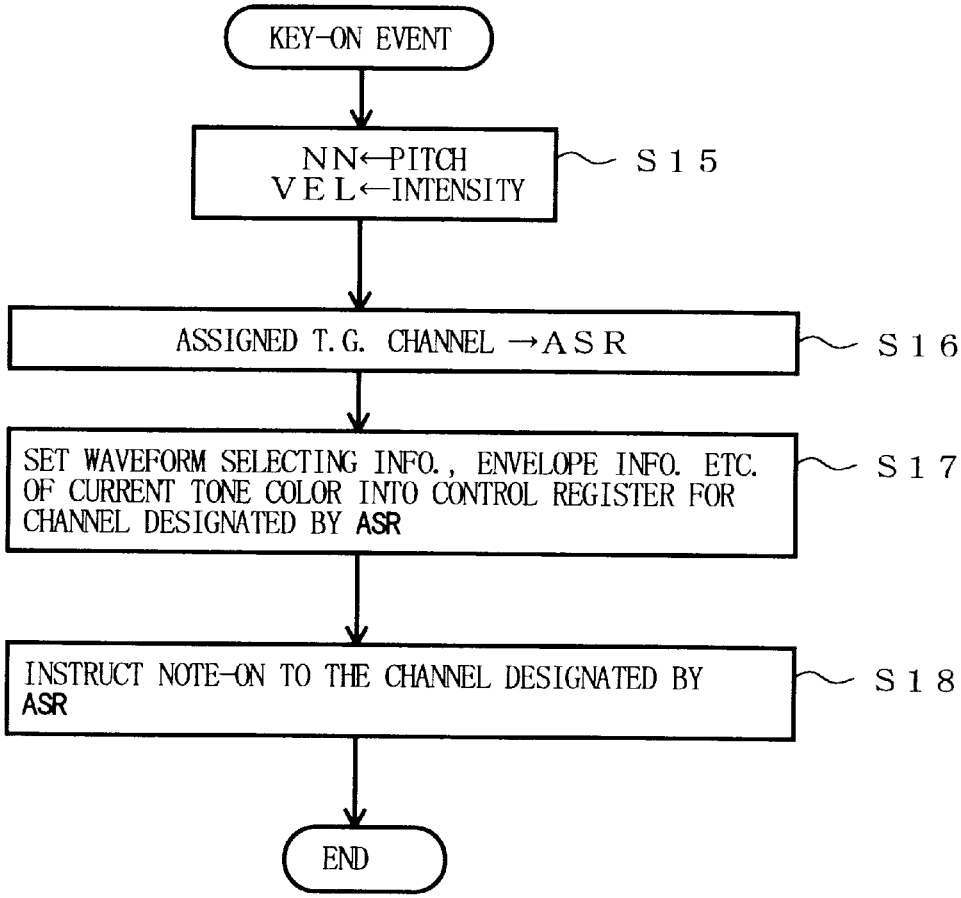
FIG. 12 is a flow chart illustrating an example of a key event process carried out in key switch processing of FIG. 11.

FIG. 11 is a flow chart illustrating a main routine of a processing program run by the control unit 102 of FIG. 1. Upon power-on of the device, the main routine is activated, where after a predetermined initialization process at step S11, regular routines including key switch processing (step S12), performance operator processing (step S13) and setting operator processing (step S14) are carried out in a repetitive manner. In the key switch processing of step S12, various operations are executed in response to a key-on or key-off event on the keyboard 101A; that is, a key-on event process of FIG. 12 is executed upon detection of a key-on event (i.e., a tone generating instruction). In the performance operator processing of step S13, various operations are executed in response to activation of any of the other performance operators 101B, as illustratively shown in FIG. 13. In the setting operator processing of step S14, various operations are executed in response to activation of any of the setting operators 100. Instead of the keyboard 101A and the other performance operators 101B being directly connected to the control unit 102, there may be provided in a MIDI interface circuit so that key-on/key-off performance information and other performance information is supplied, as MIDI information, to the control unit 102; this alternative can appropriately perform processes similar to those of FIGS. 11 to 13 by checking the contents of the supplied MIDI information.

Referring now to FIG. 12, once a key-on event has been detected, information (e.g., key code KC) indicative of a pitch of the tone related to the detected key-on event (i.e, the tone designated for sounding) is stored into a note number register NN, and information indicative of initial touch intensity (i.e., velocity data) of the tone related to the detected key-on event is stored into a velocity register VEL, at step S15. Then, at step S16, any one of a plurality of channels is selected and assigned as a tone generator channel CH for sounding or audible generation of the designated tone, and a unique channel number of the assigned channel is stored into an assigned channel register ASR. Thereafter, at step S17, various information necessary for the tone generation, such as waveform selecting information corresponding to a currently-selected tone color and envelope information, is set into one of the control registers 113 (FIG. 1) designated by the channel number stored in the assigned channel register ASR. Here, the waveform selecting information is such information specifying particular waveform data to be used for the tone generation in the channel; more specifically, this information designates four waveforms, like those shown in FIGS. 10A to 10D, from among a plurality of sets of waveform data stored in the waveform memory 10. Further, the envelope information is such information indicating target value data and variation rate data for each broken line (inclinations of the individual broken lines) for forming a "broken-line" envelope for controlling tone volume or the like.

Among various information set in the control register 113 of FIG. 1 are key code KC, tone color code TC and some of other information INF shown in FIG. 2. Further, in association with the stored content of the assigned channel register ASR, there is set, in the control register 113, "pitch information" corresponding a pitch frequency of the tone allocated to the channel on the basis of the stored content of the note number regsiter NN. Also, in association with the stored content of the assigned channel register ASR, there are set, in the control register 113, initial values of modulating depth information ML and modulating speed (or modulating) information MS. Further, in association with the stored content of the assigned channel register ASR, there are set, in the control register 113, various target level data and variation rate data to be used for envelope formation. Specific pieces of information to be used for generating tone signals on a channel-by-channel basis are conventionally known and may be of any desired design, although not described here in detail. Various data and information thus set in the control register 113 for the individual channels are fed to the waveform generating section 111 and tone volume control section 112. Finally, at step S18, a note-on signal instructing tone generation in accordance with the stored content of the assigned channel register ASR is fed to the waveform generating section 111 and tone volume control section 112 by way of the control regsiter 113. In response to the note-on signal, the waveform generating section 111 and tone volume control section 112 initiate operations to read out a waveform and to form and generate a tone volume envelope. These operations in the waveform generating section 111 and tone volume control section 112 are carried out for the individual channels on the time-divisional basis.

Figure 13:
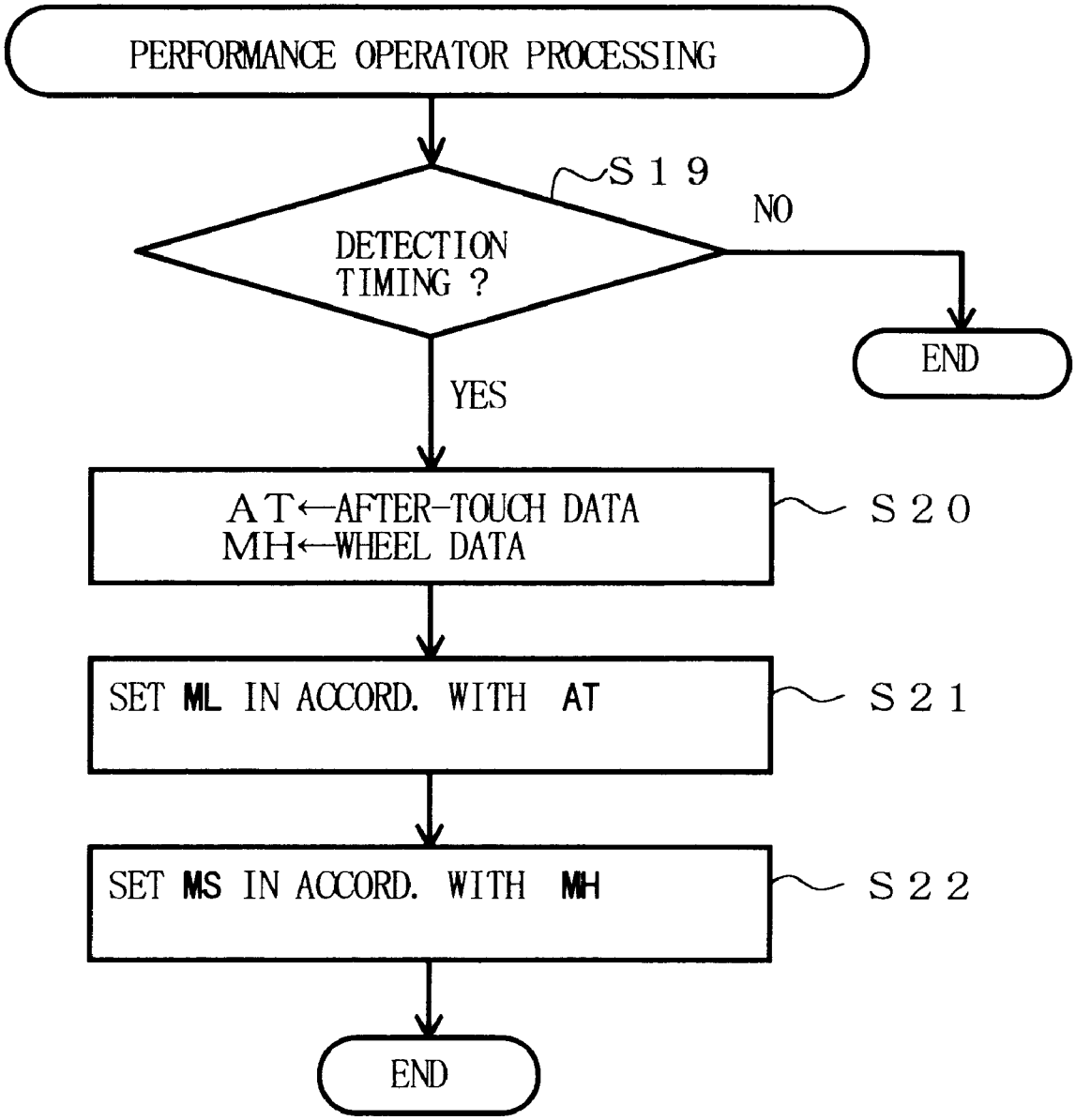
FIG. 13 is a flow chart illustrating an example of performance operator processing of FIG. 11.

In the performance operator processing of FIG. 13, a determination is first made, at step S19, as to whether predetermined detection timing has arrived, in order to detect operational states of the individual performance operators every predetermined detection timing. If the determination is in the affirmative (YES) at step S19, data indicative of the respective operational states of the individual performance operators (or performance information) are stored, at step S20, into corresponding regsiter regions in the control register 113; for example, after-touch data is stored into register region AT and operating data of the wheel operator (wheel data) is stored into register region MH. Real-time control of the tone to be generated is executed using these operating data (or performance information) as a control parameter. The following steps S21 and S22 perform operations to create a control parameter for modulation control; for example, at step S21, modulating depth information ML is set in accordance with the after-touch data stored in register region AT, and st step S22, modulating speed information MS is set in accordance with the wheel data stored in register region MH. It should be obvious that details of these information ML and MS may be set variably depending on any other factors.

The above-mentioned modulating speed information MS is processed in the converting section 18 as necessary so that it can be used as a basis for generation of data of the stretch/compression ratio SCR. For example, if the modulating speed information MS is of a predetermined natural value, the stretch/compression ratio SCR is set to "1" so that the original modulating cycle (modulating speed) is used without stretching or compressing the stored waveform data along the time axis if the modulating speed information MS is of a value greater or smaller than the predetermined neutral value, then the stretch/compression ratio SCR is set to be greater or smaller than "1" so that control for reproducing the stored waveform data stretched or compressed along the time axis through the TSC control scheme of the present embodiment to thereby increase or decrease the original modulating cycle (modulating speed) can be carried out without influencing or changing the pitch of the to-be-generated tone at all. In the case where the TSC control scheme is applied to another purpose than the modulation, it is only necessary that control data intended for that purpose be supplied to the converting section 18 in place of the modulating speed information MS. The converting section 18 of FIG. 2 is capable of variably controlling the manner of converting the modulating speed information MS and other input information into data of the stretch/compression ratio SCR; that is, the converting section can variably control the conversion function.

Next, a description will be made about behavior of the waveform generating section 111 after reception of the note-on signal, with reference to FIGS. 2 to 4 and 10.

First, the start address A0 of the first data division of a given attack-portion waveform is read out from the waveform division information memory 15, in accordance with waveform selecting information such as tone color code TC and key code KC. The read-out start address A0 is fed to the actual read address calculator 16 and virtual read address calculator 17 and is then set, as start address Aj, into the current-data-division start address registers 21 in the calculators 16 and 17 (namely, Aj←A0).

Also, a value "0" is set, as variable j indicating order of data division, into the registers 19 in the calculators 16 and 17. Also, in response to variable j=0, data indicative of the size T0 of the first data division is read out from the waveform division information memory 15 and then set into a predetermined internal register; that is, Tj←T0.

Note that because the number of data divisions m of the attack-portion waveform and the number of data divisions n of the looping waveform segment would vary depending on the waveform, let's assume here that data indicative of the numbers m and n can be read out from the waveform division information memory 15 in accordance with the waveform selecting information such as tone color code TC and key code KC and then used for control purposes.

In response to the supplied note-on signal, the actual read address calculator 16 and virtual read address calculator 17 initiate operations to arithmetically generate actual read address RAD and virtual read address VAD, respectively, using the start address A0 as an initial value. The actual read address calculator 16 and virtual read address calculator 17 arithmetically generate the read addresses in a practically same manner, and hence the following paragraphs mainly describe the address generating operations carried out in the actual read address calculator 16. The major differences between the address generating operations in the actual read address calculator 16 and in the virtual read address calculator 17 are, as previously mentioned, that only "pitch information" is used, as data determining the incremental variation width (variation rate), in the actual read address calculator 16 while a value obtained by controlling the pitch information with stretch/compression ratio SCR is used, as such determining data, in the virtual read address calculator 17, and that arithmetic operations for cross-fade synthesis are carried out only in the actual read address calculator 16.

Although it has been stated that the registers 19, 21 and 22 are provided both for the primary cross-fading waveform region data and for the subsidiary cross-fading waveform region data, the following paragraphs only refer to the registers 19, 21 and 22 for the primary cross-fading waveform region data unless specifically stated otherwise.

The read pointer p is reset to "0" in response to the note-on signal, after which the read pointer p in the actual read address calculator 16 is incremented regularly by a variation width (variation rate) corresponding to the pitch information while the read pointer p in the virtual read address calculator 17 is incremented regularly by a variation width (variation rate) corresponding to a value obtained by controlling the pitch information with the stretch/compression ratio SCR. This results in a difference in the advancing slope between the actual read address RAD and the virtual read address VAD.

The actual read address RAD is calculated by adding the read pointer p to the start address Aj of the current data division; that is, by the following equation:

$$RAD=Aj+p$$

The virtual read address VAD is calculated in a similar manner; that is, if the start address of the current data division is represented by Aj' and the read pointer is represented by p', it may be calculated by the following equation:

$$VAD=Aj'+p'$$

Because the actual read address RAD and virtual read address VAD are generated independently of each other, the start address (Aj) and the like are provided for each of the addresses RAD and VAD.

Sample data of the attack-portion waveform (waveform data W1) are sequentially read out from the waveform memory 10 in accordance with the actual read addresses RAD generated by the actual read address calculator 16. As noted earlier, the actual read address RAD includes integral and decimal fraction parts, so that the waveform data W1 are read out from the waveform memory 10 in accordance with the integer part of the actual read address RAD and an interpolation is made, by the interpolating circuit 11, between the sample data in accordance with the decimal fraction part of the actual read address RAD.

Then, once the read pointer p has become greater in value than the size Tj of the current data division, i.e., p>Tj, this means that the waveform readout of the current data division has been completed, and thus a predetermined renewal or updating operation is performed for a transfer or shift to the next data division. That is, a difference between the values p and Tj is set into the register 20 as a new read pointer value, and a value obtained by adding the size Tj of the current data division to the start address Aj of the current data division is set into the regsiter 21 as a start address Aj of the next data division as follows:

$$p \leftarrow p-Tj$$

$$Aj \leftarrow Aj+Tj$$

Then, variable j set in the register 19 is incremented by one; that is, j←J+1.

Thereafter, similar operations are repeated such that the waveform data W1 are sequentially read out from the waveform memory 10 and a shift from one data division to another sequentially occurs as the read pointer p is incremented at a rate corresponding to the pitch information.

Then, once the readout of the last data division of the attack-portion waveform has been completed, control proceeds to one of the stored loop-portion waveforms. To maintain data continuity, the read pointer p is updated similarly to the above-mentioned; that is, p←p−Tj, where Tj represents the size of the last data division of the attack-portion waveform (Tm−1).

To read out such a loop-portion waveform, a value of variable i for selecting one of the loop-portion waveforms corresponding to a desired modulating depth is determined by reference to modulating depth information ML, and the determined value is set into the register 22. In addition, as variable j indicative of a position (in the data division order order) of a particular one of the data divisions, a value "−2" representing the first data division of the loop-portion waveform is set into the register 19. Then, in accordance with the two variables i and j, the start address Ai−2 of the first data division of the loop-portion waveform is read out from the waveform division information memory 15 and set into the current-data-division start address register 21 as start address Aij; that is, Aij←Ai−2. Further, in accordance with the two variables i and j, data indicative of the size Ti−2 of the first data division is read out from the waveform division information memory 15 and then set into a predetermined internal register; that is, Tij←Ti−2.

As noted earlier in relation to the attack-portion waveform readout, the actual read address RAD is calculated by adding the read pointer p to the start address Aij of the current data division; that is, by the following equation:

$$RAD=Aij+p$$

As mentioned, the read pointer p in the actual read address calculator 16 is incremented regularly by a variation width (variation rate) corresponding to the pitch information, so that waveform data W1 of the loop-portion waveform are sequentially read out from the waveform memory 10 in accordance with the actual read addresses RAD generated by the actual read address calculator 16.

Then, once the read pointer p has become greater in value than the size Tij of the current data division, i.e., p>Tij, operations are carried out to renew the read pointer p, set a start address Aij of the next data division and renew data-division specifying variable j as follows:

$$p \leftarrow p - \mathrm{Tij}$$

$$\mathrm{Aij} \leftarrow \mathrm{Aij} + \mathrm{Tij}$$

$$j \leftarrow j+1$$

Thereafter, similar operations are repeated such that the waveform data W1 (and waveform data W2 as well) are sequentially read out from the waveform memory 10 and a sequential shift from one data division to another occurs as the read pointer p is incremented at a rate corresponding to the pitch information.

Then, once the readout of the last data division of the loop-portion waveform has been completed, control gets back to the first data division of the looping waveform segment (FIG. 10) for subsequent repetitive (looped) readout of the looping waveform segment consisting of "n" data divisions.

Completion of the readout of the last data division can be identified from establishment of the condition of p>Tij similarly to the above-mentioned, when j=n−1.

To get back to the first data division of the looping waveform segment, operations are carried out to renew the read pointer p, set a start address Ai0 of the first data division of the looping waveform segment as a start address Aij of the next data division and reset data-division specifying variable j to 0 as follows:

$$p \leftarrow p - \mathrm{Tij}$$

$$\mathrm{Aij} \leftarrow \mathrm{Ai0}$$

$$j \leftarrow 0$$

It should be obvious that for the repetitive (looped) readout, the actual read address RAD and virtual read address VAD have to advance together in a looped fashion. To this end, it may be only necessary that as the actual read address RAD is moved back to the first data division of the looping waveform segment, the virtual read address VAD be simultaneously moved back to a near-start point of the looping waveform segment while maintaining a distance or difference from the actual read address RAD. Conversely, it may be sufficient that the virtual read address VAD be moved back to the first data division of the looping waveform segment when the circuitry for generating the actual read address RAD detects completion of readout of the last data division of the looping waveform segment and the actual read address RAD be simultaneously moved back to a near-start point of the looping waveform segment while maintaining a distance from the virtual read address VAD.

On the basis of the above-mentioned operations, actual read addresses RAD and virtual read addresses VAD are generated from the actual read address calculator 16 and virtual read address calculator 17, respectively, and the waveform data are sequentially read out from the waveform memory 10 in accordance with the actual read addresses RAD. As noted above, where the stretch/compression ratio SCR is "1", the read pointers P in the actual read address calculator 16 and virtual read address calculator 17 take a same value and the actual read address RAD and virtual read address VAD coincide with each other. However, As the stretch/compression ratio SCR is changed from the value "1" to effect time-axis stretch/compression control of the waveform data, there occurs a difference in advancing slope between the actual read address RAD and the virtual read address VAD. Thus, according to the TSC control scheme employed in the present embodiment, control is performed such that the advancing inclination of the actual read address RAD generally follows that of the virtual read address VAD while the actual read address RAD is maintained at an advancing slope corresponding to a desired pitch, as previously noted. Such control will be described below in greater detail.

In FIG. 2, the shift control circuit 14 constantly monitors a deviation or difference of the actual read address RAD from the virtual read address VAD so that it issues a shift instruction to the actual read address calculator 16 once the difference has exceeded a predetermined reference value. The predetermined reference value in this embodiment is set to be some percentage (e.g., ½) of the size Tj or Tij of the current data division, although it may be set optionally. To this end, data indicative of the size Tj or Tij of the current data division is given to the shift control circuit 14. In turn, the shift control circuit 14 gives the actual read address calculator 16 a shift instruction, along with information identifying direction or polarity of the deviation or difference, i.e., whether the actual read address RAD is greater than the virtual read address VAD (as in the example of FIG. 4) or smaller than the virtual read address VAD (as in the example of FIG. 3). In response to the shift instruction, the actual read address calculator 16 operates in the following manner.

Namely, in response to the shift instruction, the actual read address calculator 16 identifies one of the data divisions to which the actual read address is to be shifted and then unique division number j of the shifted-to data division into the register 19 provided for the subsidiary cross-fading waveform region data. For convenience of description, the shifted-to data division is hereinafter represented by reference character j(new). Typically, the unique division number of the shifted-to data division is greater or smaller than that of the current data division by one (i.e, the order number of the current data division plus one or minus one). Namely, if the actual read address RAD is greater than the virtual read address VAD as in the example of FIG. 4, then j(new)=j−1. If the actual read address RAD is smaller than the virtual read address VAD as in the example of FIG. 3, then j(new)=j+1.

Thereafter, the start address Aij or Aj of the shifted to data division is read out from the waveform division information memory 15 and stored into the register 21 for the subsidiary cross-fading waveform region data. For convenience of description, the start address Aij or Aj stored into the register 21 for the subsidiary cross-fading waveform region data is represented by reference character Aij(new).

Using the same read pointer p as for the primary cross-fading waveform region data, the actual read address RAD2 for the subsidiary cross-fading waveform region data is calculated as follows:

$$\mathrm{RAD2} = \mathrm{Aij(new)} + p$$

In this way, a new actual read address is created, which is equivalent to a result of shifting the actual read address RAD for the primary cross-fading waveform region data immediately before the shift instruction by an amount corresponding to one data division. The new actual read address is output as actual read address RAD2 for the subsidiary cross-fading waveform region data. On the other hand, the actual read address RAD2 continues to vary in value in accordance with variation of the read pointer p as follows:

$$\mathrm{RAD} = \mathrm{Aij} + p$$

In the above-mentioned manner, waveform data W1 corresponding to the actual read address RAD for the primary cross-fading waveform region data and waveform data W2 corresponding to the actual read address RAD2 for the subsidiary cross-fading waveform region data are read out from the waveform memory 10 and fed via the interpolating circuits 11, 12 to the cross-fade synthesis section 13.

In response to the shift instruction from the shift control circuit 14, the cross-fade synthesis section 13 executes cross-fade synthesis between the waveform data W1 and W2 of the primary and subsidiary cross-fading waveform region data. More specifically, the shifted-to (target) waveform data W2 are scaled with a coefficient function progressively increasing from coefficient "0" to coefficient "1" (i.e., a function of coefficients having decimal fraction parts), while the waveform data W1 are scaled with a coefficient function progressively decreasing from coefficient "1" to coefficient "0" (i.e., a function of coefficients having decimal fraction parts). The thus-scaled waveform data W1 and W2 are then additively synthesized. In this example, the fading-in/fading-out relationship between the primary and subsidiary cross-fading waveform region data is opposite to that shown in FIGS. 3 and 4; however, the cross-fade synthesis produces the same result.

Upon completion of the cross-fade synthesis, the primary-subsidiary relationship between the registers 19 and 21 is reversed in order to change the shifted-to actual read address RAD2 into the actual read address RAD for the primary cross-fading waveform region data; that is, $$j \leftarrow j(\text{new})$$

$$\text{Aij} \leftarrow \text{Aij(new)}$$

Then, generation of the actual read address RAD2 for the subsidiary cross-fading waveform region data is terminated. Thus, for the cross-fade synthesis, the waveform region of the waveform data W1 can be constantly scaled with a falling characteristic while the waveform region of the waveform data W2 can be constantly scaled with a rising characteristic; further it is not necessary to switch the actual read address RAD to be fed to the control unit 14, which would thereby achieve reduced cumbersomeness and enhanced convenience. It is also possible to not reverse the primary-subsidiary relationship between the registers 19 and 21 even after the cross-fade synthesis; in this case, however, it is necessary to alternately use the rising (increasing) and falling (diminishing) scaling characteristics for the waveform regions of the waveform data W1 and W2 and also alternately feed the actual read addresses RAD and RAD2 to the shift control circuit 14.

In case there occurs a need for a shift between the data divisions before completion of the cross-fade synthesis, it is only necessary that the shift between the data divisions of the primary and subsidiary cross-fading waveform region data be controlled on the basis of operation of one of the waveform regions for which the shifted-to data division j(new) is being read. Namely, once the read pointer p has become greater in value than the size Tij(new) of the shifted-to data division, the difference between the read pointer p and the size Tij(new) is set as a new value of the pointer p; that is, $p \leftarrow p - \text{Tij(new)}$. Then, the start addresses Aij for the primary and subsidiary cross-fading waveform region data are updated by common size data Tij(new) as follows:

$$\text{Aij} \leftarrow \text{Aij} + \text{Tij(new)}$$

Also, the values j(new) and j are each incremented by one as follows:

$$j(\text{new}) \leftarrow j(\text{new}) + 1$$

$$j \leftarrow j + 1$$

Alternatively, the start timing of the cross-fade synthesis may be controlled in such a manner that a need for the shift does not arise in the course of the cross-fade synthesis.

Note that generation of the virtual read address VAD is continued during the cross-fade synthesis; however, in the course of the cross-fade synthesis, the comparison between the addresses RAD and VAD may be suspended optionally.

Here, to provide the same primary-subsidiary relationship for the cross-fade synthesis as shown in FIGS. 3 and 4, it is only necessary that in response to the shift instruction from the shift control circuit 14, data j and Aij of the primary cross-fading waveform region data (i.e., primary cross-fading channel) stored in the registers 19 and 21 be transferred to the registers for the subsidiary cross-fading waveform region data (i.e., secondary cross-fading channel) and data j(new) and Aij(new) of the shifted-to data division be set into the registers for the primary cross-fading waveform region data (i.e., primary cross-fading channel). In such a case, waveform data W1 become target values, so that for the cross-fade synthesis, the group of the waveform data W1 is constantly scaled with a rising characteristic while the group of the waveform data W2 is constantly scaled with a falling characteristic.

In the case where no cross-fade synthesis is carried out, data j and Aij of the current data division may be directly replaced with data j(new) designating a shifted-to data division and its start address Aij(new), in response to a shift instruction issued from the shift control circuit 14. Then, the actual read address RAD is shifted by an amount corresponding to one data division, as shown in FIG. 3 or 4 in heavy solid line. In this case, the shift instruction may be issued when the waveform readout of the current data division has arrived at the last address of the data division; this way, a smooth transfer or interconnection is reliably achieved between same-phase points when the last waveform segment of the current data division is to be linked to the first waveform segment of the shifted-to data division.

In the above-mentioned manner, stretch/compression ratio SCR is set in accordance with modulating speed information MS, and virtual read addresses VAD having their advancing slopes controlled in accordance with the stretch/compression ratio SCR are generated as shown in FIG. 3 or 4. On the other hand, actual read addresses RAD are generated as shown in FIG. 3 or 4 after having been intermittently stretched or compressed along the time axis to follow variations in the virtual read addresses VAD while maintaining slopes corresponding to a basic tone pitch as dictated by pitch information, in response to which waveform data are read out from the waveform memory 10 after having been controlled to be stretched or compressed along the time axis. Thus, in reading out high-quality plural-cycle waveform data, having a modulation effect imparted thereto, from the waveform memory 10, the modulating cycle (modulating speed), i.e., readout locations along the time axis can be variably controlled freely in accordance with the modulating speed information MS, and thus it is possible to provide a high-quality modulation effect of enhanced controllability.

Note than when the modulating speed information MS is changed in real time during tone generation, the stretch/compression ratio SCR would vary in accordance with the changed modulating speed information MS and hence the virtual read addresses VAD would also change in advancing slope. As a result, the stretch or compression, along the time axis, of a reproductively read-out waveform can be variably controlled over time.

The cross-fade synthesis section 13 can also be activated when the modulating depth is varied. Namely, when the modulating depth ML is changed in value and there occurs a need to change variable i in the regsiter 22, changed variable i(new) and start address of a data division corresponding thereto Ai(new)j are set into the registers 21 and 22, respectively, for the subsidiary cross-fading waveform region data (i.e., in the subsidiary cross-fading channel).

Using the same read pointer p as for the primary cross-fading waveform region data, the actual read address RAD2 for the subsidiary cross-fading waveform region data is calculated as follows:

$$RAD2=Ai(new)j+p$$

In this way, an actual read address designating a new waveform after the modulating depth change is created and output as an actual read address RAD2 for the subsidiary cross-fading waveform region data. The actual read address will vary as the read pointer p varies.

On the other hand, the actual read address designating the waveform before the modulating depth change will continue to vary with the variation of the read pointer p as follows:

$$RAD=Aij+p$$

In the above-mentioned manner, waveform data W1 corresponding to the actual read address RAD for the primary cross-fading waveform region data and waveform data W2 corresponding to the actual read address RAD2 for the primary cross-fading waveform region data are read out from the waveform memory 10 and fed via the interpolating circuits 11, 12 to the cross-fade synthesis section 13.

In response to a modulating-depth changing instruction from the actual read address calculator 16, the cross-fade synthesis section 13 executes cross-fade synthesis between the waveform data W1 and W2 read out through the primary and subsidiary cross-fading channels. More specifically, the shifted-to (target) waveform data W2 read out through the subsidiary cross-fading channel are scaled with a coefficient function progressively increasing from coefficient "0" to coefficient "1" (i.e., a function of coefficients having decimal fraction parts) for fade-in, while the waveform data W1 read out through the primary cross-fading channel are scaled with a coefficient function progressively decreasing from coefficient "1" to coefficient "0" (i.e., a function of coefficients having decimal fraction parts) for fade-out. The thus-scaled waveform data W1 and W2 are then additively synthesized.

Upon completion of the cross-fade synthesis, the primary-subsidiary relationship between the registers 21 and 22 is reversed in order to change the target actual read address RAD2 into the actual read address RAD for the primary cross-fading waveform region data, in a similar manner to the above-mentioned; that is, $$Aij \leftarrow Ai(new)j$$

$$i \leftarrow i(new)$$

In this way, a waveform shift or transfer is effected, via smooth cross-fade, from the old waveform before the modulating depth change to the new waveform after the modulating depth change.

Also in this case, if there occurs a need for a shift between the data divisions before completion of the cross-fade synthesis, it is only necessary that the shift between the data divisions in the the primary and subsidiary cross-fading channels be controlled on the basis of operation of one of the channels for which the shifted-to data division j(new) is being read. Alternatively, the start timing of the cross-fade synthesis may be controlled in such a manner that a need for a shift does not arise in the course of the cross-fade synthesis.

The above descriptions are merely for illustrative purposes, and various changes and modifications including the following are possible without departing from the basic concepts of the present invention.

As an example, waveform data, representing a tone color, as shown in FIGS. 10A–10D may be stored for each of a plurality of note ranges. In such a case, the total length of the attack-portion waveform and each of the loop-portion waveforms may be set to be different between the note ranges or be the same for all the note ranges. Further, the total length of each of the looping waveform segments may also be set to be different between the note ranges or be the same for all the note ranges.

While the present invention has been described, in relation to FIGS. 10A–10D, as storing two sets of modulation-effect-imparted waveform data corresponding to two different levels of modulating depth, one or three or more sets of such waveform data may be stored.

As previously noted, it is most preferable that the sets of stored waveform data, each having imparted thereto a modulation effect of different depths, have as similar pitch and modulating cycle as possible; however, this is not necessarily essential. Because, differences in pitch and modulating cycle can be adjusted, by appropriately controlling the pitch information and stretch/compression ratio SCR, during generation of the actual and virtual read addresses RAD and VAD, in such a manner that the pitch and modulating cycle become practically the same for all the sets of stored waveform data.

Further, the waveform data stored in the waveform memory 10 need not necessarily be one having a periodic modulation effect imparted thereto; that is, waveform data with any other type of modulation may be stored. Tonal factor to be modulated may be other than frequency or tone volume, such as tone color.

Furthermore, it is not necessarily essential to store an attack-portion waveform in the waveform memory 10, and only loop-portion waveforms may be stored. A decay-portion waveform with a rising tone characteristic may be stored in addition to the loop-portion waveforms (and attack-portion waveform) so that the generated tone is deadened by reading out the decay-portion waveform, in place of the loop-portion waveform, after detection of a key-off event. Furthermore, a plurality of, rather than just one, loop-portion waveforms may be stored, for each tone, so as to permit switching readout of the loop-portion waveforms over time; for example, one loop-portion waveform may be readout a plurality of times and then another loop-portion waveform may be readout a plurality of times. In another modification, waveform data of a full waveform from a start to end of a tone to be generated may be stored.

In another modification, some of the waveform data stored in the waveform memory 10 may be shared between different tone colors, between different note ranges of a same tone color, or between other different situations, as necessary.

Moreover, the number of frequency-corresponding cycles in each data division of waveform data stored in the waveform memory 10 may be one or more than one, and may be an integral or non-integral number. Also, start points of the individual data divisions need not necessarily be in a same phase and may be of any other interrelation as long as they serve to provide a smooth connection between two waveform regions.

Waveform data stored in the waveform memory 10 need not necessarily be managed in data divisions. Namely, the TSC control scheme of the present invention is applicable to waveform data that are not divided into data divisions for management.

Further, whereas the read pointer p and start address Aij or Aj have been described as updated for each data division read out from the waveform memory 10, the same read pointer p and start address Aij or Aj may be successively used to sequentially read out a plurality of the data divisions. In such a case, however, it is necessary to provide two read pointers p, one for each of the primary and subsidiary cross-fading waveform region data. For example, in response to a shift instruction from the shift control circuit 14, cross-fade synthesis may be carried out after initial values of start address Aij(new) or Aj(new) of a shifted-to data division and read pointer p may be set into the registers for one of the subsidiary cross-fading waveform region data which is currently not under waveform data readout.

It should be obvious that the above-mentioned modifications are applicable not only to cases where the TSC control scheme is used to read out a stored waveform having a modulation effect imparted thereto but also to cases where the TSC is used for any other purposes.

[Modification of the TSC Control Scheme]

Figure 14:
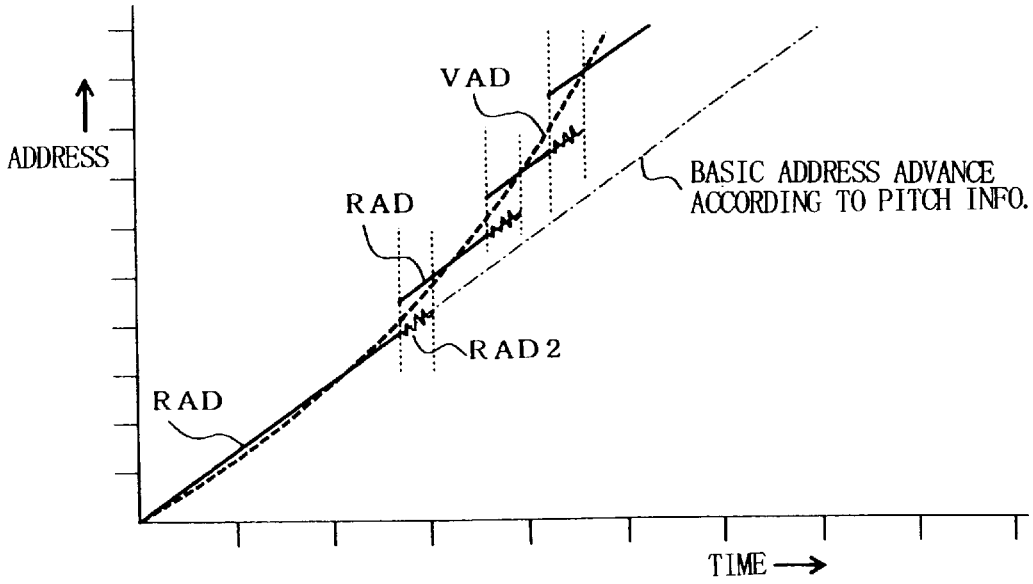
FIG. 14 is a diagram of a modification of the TSC control where virtual read addresses are generated by a virtual read address calculator of FIG. 2 with a nonlinear characteristic, showing an exemplary manner in which the read addresses advance over time in the waveform memory when compression control is to be executed.
Figure 15:
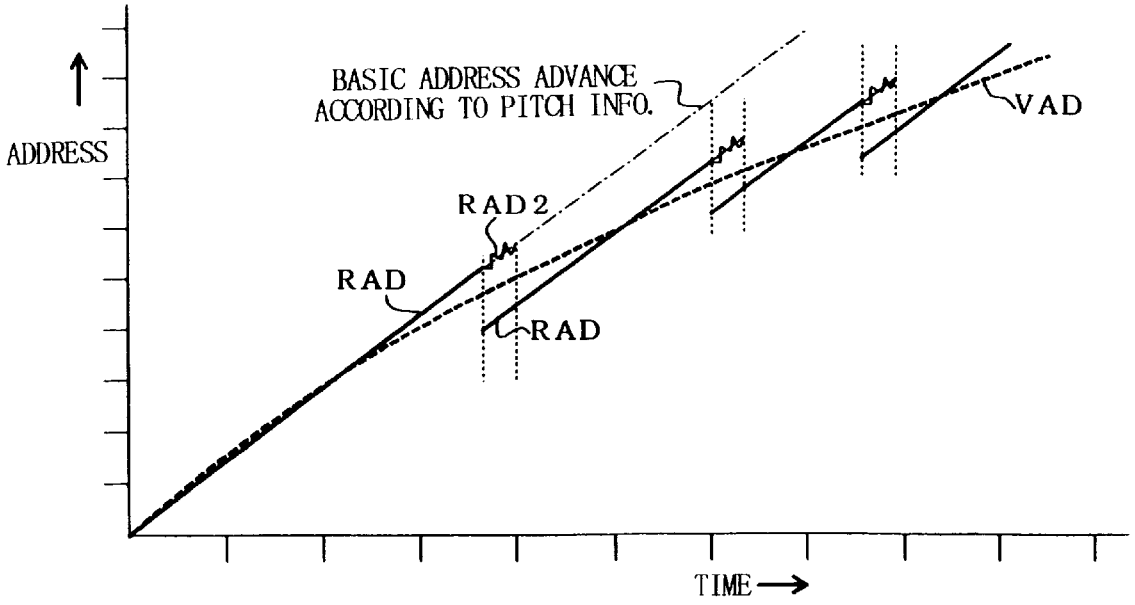
FIG. 15 is a diagram of another modification of the TSC control where the virtual read addresses are generated by the virtual read address calculator of FIG. 2 with a nonlinear characteristic, showing an exemplary manner in which the read addresses advance over time in the waveform memory when stretch control is to be executed.

FIGS. 14 and 15 are diagrams showing examples where virtual read addresses VAD are generated with a nonlinear characteristic. More specifically, FIG. 14 shows a case where virtual read addresses VAD are generated with an exponential function characteristic, while FIG. 15 shows a case where virtual read addresses VAD are generated with a logarithmic function characteristic. For these purposes, the organization of the waveform generating section 111 of FIG. 2 can be used without requiring any particular modifications. However, it is necessary to modify the organization of the converting section 18; the converting section 18 has to be provided with an exponential function generator or a logarithmic function generator so that in response to a "note-on" signal, stretch/compression ratio data SCR is generated which varies with an exponential function characteristic or a logarithmic function characteristic in accordance with passage of time from the beginning of a generated tone. Also in this case, generation of actual read addresses RAD is controlled, in accordance with the TSC control scheme of the present invention, to follow a nonlinear advance of the virtual read addresses VAD while maintaining a constant advancing slope relative to a desired pitch, as shown. Of course, actual read addresses RAD2 for the subsidiary cross-fading waveform region data may be generated as necessary for cross-fade synthesis, as in the above-described preferred embodiment. This way, waveform data stored in the waveform memory 10 can be reproductively read out in a nonlinearly stretched or compressed condition.

It should be obvious that the TSC control scheme based on such nonlinear virtual read addresses VAD are applicable not only to the above-described modulation-effect impartment control but also to any other purposes. Because the illustrated nonlinear virtual read addresses VAD follow a basic address advance path according to the pitch information for a given period elapsed from a starting point of generation of a tone (the starting point of the time axis shown in FIGS. 14 and 15 corresponds to the the tone generation starting point), no substantial stretch/compression is effected during the given period. Thus, for an attack portion, control for not effecting stretch/compression can be readily performed. Namely, in the case of modulation-effect impartment control, it is possible to prevent differences between the actual read addresses RAD and the virtual read addresses VAD from becoming excessive for an attack portion, even where modulation speed information MS indicates a relatively great value from the beginning of the attack portion. Examples using such nonlinear virtual read addresses VAD will also be described later in relation to FIGS. 41 and 42.

Figure 16:
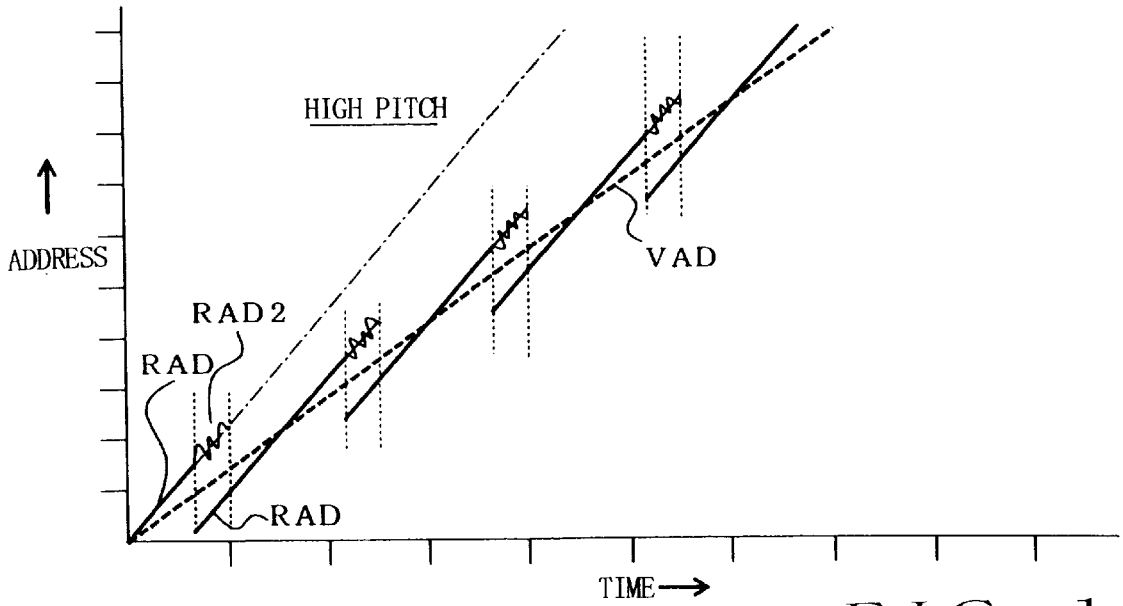
FIG. 16 is a diagram of another modification of the TSC control which, when a pitch of a tone to be generated is relatively high, performs control to stretch stored waveform data along the time length so as to keep a total tone-reproducing or tone-generating time length substantially constant, showing an exemplary manner in which the read addresses advance over time in the waveform memory during the stretch control.
Figure 17:
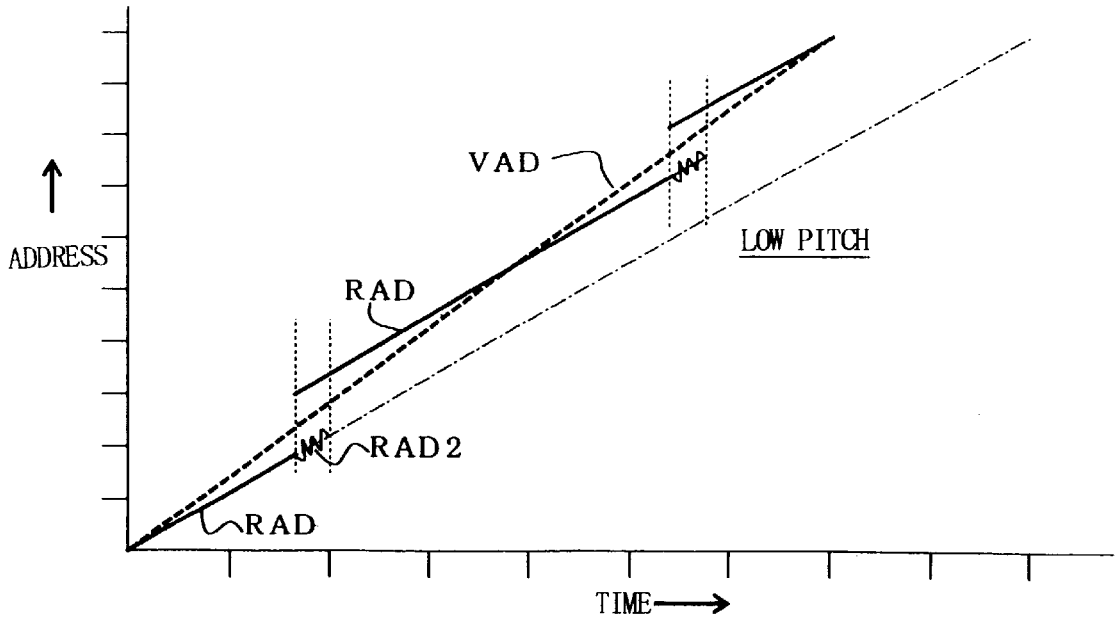
FIG. 17 is a diagram of still another modification of the TSC control which, when a pitch of a tone to be generated is relatively low, performs control to compress stored waveform data along the time length so as to keep a total tone-generating time length substantially constant, showing an exemplary manner in which the read addresses advance over time in the waveform memory during the compression control.

FIGS. 16 and 17 are diagrams showing examples where the TSC control scheme functions to keep a total tone-generating time substantially constant irrespective of a pitch variation of tone to be generated, as contrasted with the foregoing examples.

In these figures, dot-dash lines each denotes a basic address advance based on the pitch information, and the example of FIG. 16 presents a greater address advancing slope and hence higher tone pitch than in the example of FIG. 17. Slope of virtual read addresses VAD denoted in heavy broken line is the same in both the examples of FIGS. 16 and 17. Further, as in the example of FIG. 3 etc. each solid line represents an advance of actual read addresses RAD and each ripple-shape line represents an advance of actual read addresses RAD2 for the subsidiary cross-fading waveform region data to be used for cross-fade synthesis. For these purposes, the organization of the waveform generating section 111 of FIG. 2 can be used without requiring any particular modifications. It is only necessary to modify the read pointer p for use in the virtual read address calculator 17 in such a manner that it varies at a rate based on predetermined pitch rate data irrespective of a pitch as dictated by the pitch information of a tone to be generated; namely, predetermined pitch information, other than the "pitch information of a tone to be generated", is input to the virtual read address calculator 17. However, assume here that the read pointer p for use in the actual read address calculator 16 is caused to vary in accordance with the "pitch information of a tone to be generated". Also in these cases, the advancing slope of virtual read addresses VAD can be variably controlled in accordance with a value of stretch/compression ratio data SCR and stored waveform data can be controlled to be stretched or compressed along the time axis.

The TSC control scheme based on such virtual read addresses VAD varying irrespective of a tone pitch is of course applicable to the above-described modulation-effect impartment control but also to any other purposes. In the case where a same stored waveform is read out at different tone pitches, this TSC control scheme can always provide for a same tone-generating time length, by "apparently" stretching waveform's time locations for a relatively high pitch and "apparently" compressing waveform's time locations for a relatively low pitch. If applied to the modulation-effect impartment control, for instance, the TSC control scheme allows the cycle of the modulation effect to not vary even when there occurs a tone pitch variation.

Several examples of control based on the TSC control scheme have been described so far in relation to FIGS. 3, 4 and 14–17, and it should be obvious to those skilled in the art that waveforms as shown in FIGS. 5 and 6 can be controlled to be stretched/compressed along the time axis by a combination of some or all of these examples.

[Positive Modulation Control Based on the TSC Control Scheme]

Using the TSC control scheme of the present invention, periodic or non-periodic modulation control can be positively performed on a tone waveform to be reproduced. Such control can be applied to looped or repetitive readout of a stored waveform, in order to effectively minimize or eliminate monotonousness resulting from the repetition of a same looping waveform segment.

Figure 18:
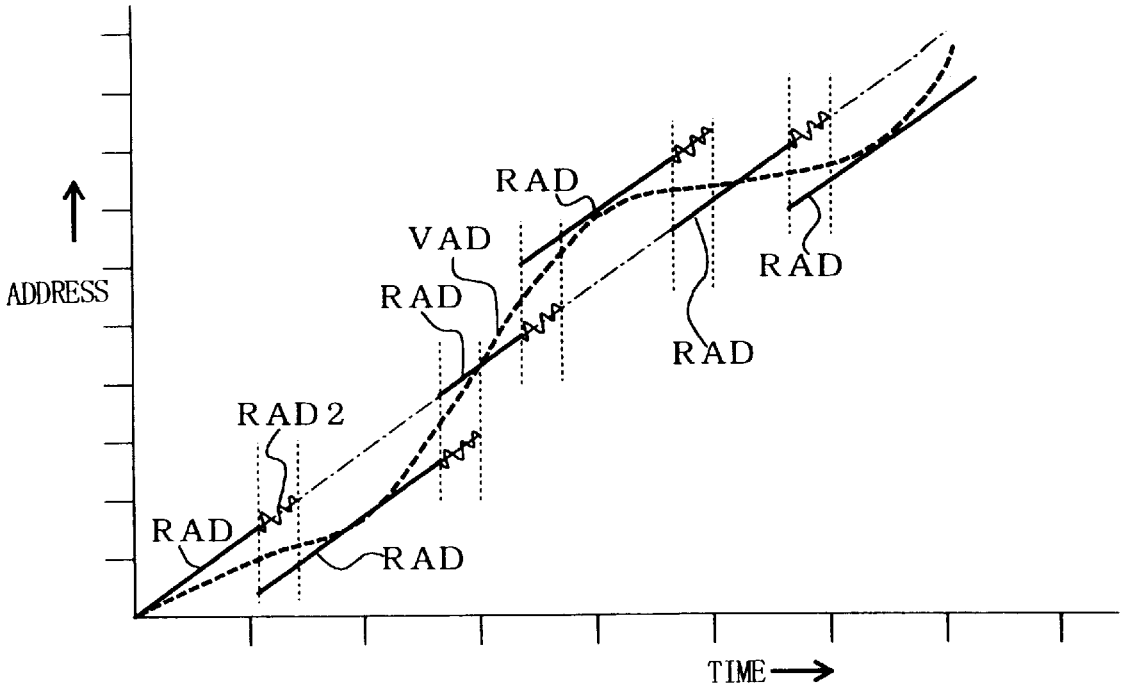
FIG. 18 is a diagram of still another modification of the TSC control which varies over time, illustratively showing advances or variations of virtual read addresses and actual read addresses when periodic or non-periodic modulation control is to be carried out by the TSC control.

FIG. 18 is a diagram, similar to those of FIG. 3 etc., illustratively showing advances or variations of virtual read addresses VAD and actual read addresses RAD when periodic or non-periodic modulation control is to be carried out by the TSC control.

In this case, the virtual read address VAD is caused to periodically vary (or non-periodically swing) as shown, in response to which the actual read address RAD repeats a data shift or jump to follow the swing of the virtual read address VAD while maintaining a basic advancing slope based on pitch information of a tone to be generated. For this purpose, the organization of the waveform generating section 111 of FIG. 2 can be used without requiring any particular modifications; however, it is necessary to allow stretch/compression ratio data SCR, generated from the converting section 18, to periodically or non-periodically fluctuate about a predetermined reference value "1". To achieve this, a suitable modulated waveform signal may be used as "other information" that is to be fed from the control register 113 (FIG. 1) to the converting section 18. In response to this modulated waveform signal, the converting section 18 generates data of stretch/compression ratio data SCR whose value periodically or non-periodically fluctuates about the predetermined reference value "1", in accordance with which the virtual read address calculator 17 can generate virtual read addresses VAD that vary in the manner as shown in FIG. 18. Note that where the present control is applied in an attempt to eliminate monotonousness resulting from the looped readout, the address starting point may be used as a starting point of the looped readout so that an attack portion of the tone is not subjected to the control of FIG. 18.

Figure 19:
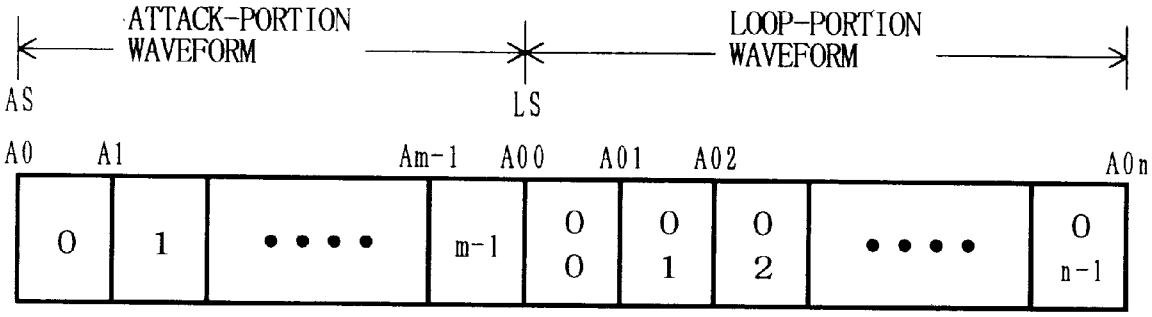
FIG. 19 is a diagram showing an exemplary storage format of waveform data for a tone in the waveform memory.

In the example of FIG. 18, the waveform stored in the waveform memory 10 need not necessarily be one with previously-imparted modulation. FIG. 19 is a diagram, similar to that of FIG. 10, showing an example of plural-cycle waveform data for a tone that are to be stored in the waveform memory 10. Specifically, for the single tone, an attack-portion waveform and a loop-portion waveform are stored and managed in data divisions in the aforesaid manner. In this case, it is not necessarily essential to provide a "connecting waveform segment" prior to the loop-portion waveform as shown in FIGS. 10A–10D, because the attack-portion waveform and loop-portion waveform correspond to each other in a one-to-one relation. Namely, it is only necessary that the attack-portion waveform and loop-portion waveform be originally made so as to continuously connect with each other. The loop-portion waveform of FIG. 19 consists of "n" data divisions and all these data divisions are read out in a looped or repetitive manner; that is, start address A00 of the first data division in the loop-portion waveform corresponds to a looping start address LS. In the event that if the attack-portion waveform and loop-portion waveform are originally made so as to not continuously connect with each other, then a "connecting waveform segment", similar to that of FIGS. 10A–10D, may of course be provided prior to the loop-portion waveform.

Note that the waveform of FIG. 19 may be made by sampling a tone sounded through a normal style of performance on a natural musical instrument or the like and need not be one with previously-imparted modulation as in the above-described preferred embodiment.

Figure 20:
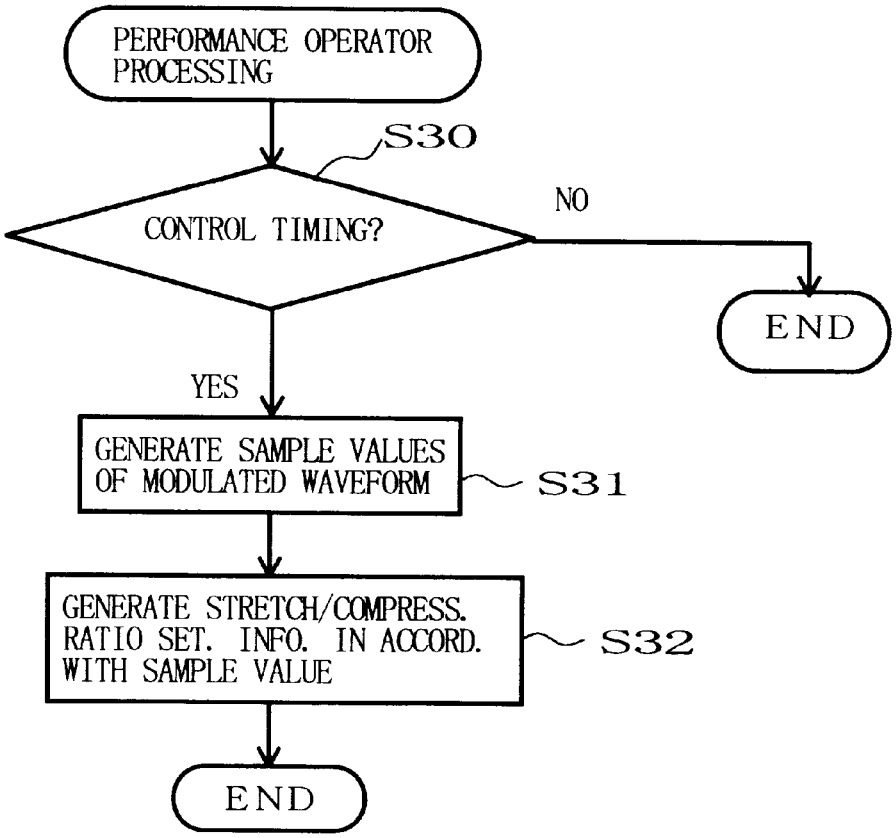
FIG. 20 is a flow chart illustrating another example of the performance operator processing.

Further, it is preferable that the loop-portion waveform to be stored in the waveform memory 10 be previously processed in such a manner that its last and first waveform segments can smoothly connect with each other during the looped readout. For example, cross-fade synthesis may be performed between last and first waveform segments of a waveform, extracted from an original waveform as a loop-portion waveform, to thereby create a connecting waveform segment, and the thus-created connecting waveform segment may be stored as a last segment of the loop-portion waveform. Further, the attack-portion waveform to be stored in the waveform memory 10 does not necessarily have to be a whole of an originally made attack-portion waveform and may be one obtained by cutting off an intermediate part of the original and performing cross-fade synthesis between the remaining end parts of the original. Of course, a plurality of waveforms each having attack-portion and loop-portion waveforms as shown in FIG. 19 may be prepared and stored for a plurality of note ranges, one for each note range, as previously stated. In such a case, the respective storage spaces, in the waveform memory 10, for the respective note ranges, may be set to be the same or different as necessary; if, for example, the respective storage spaces are the same, the number of cycles in stored waveform data are smaller for lower note ranges than for higher note ranges because the number of samples per cycle is greater for the lower note ranges.

Where the control is performed according to the example of FIG. 19, the same main routine and key-on event process as shown in FIGS. 11 and 12 may be executed by the control unit 102 (FIG. 1). The modulated waveform signal may be generated via performance operator processing in the main routine, and the performance operator processing may be carried out in a manner as shown in FIG. 20. In the performance operator processing of FIG. 20, a determination is first made, at step S30, as to whether predetermined control timing has arrived or not, in order to generate a sample value of a modulated waveform signal every predetermined control timing. If the determination is in the affirmative, control goes to step S31 in order to generate current sample value data of the modulated waveform signal. The current sample value data may be generated by incrementing by one the read address of a memory storing a desired modulated waveform and reading out one same value data in accordance with the incremented read address. In this case, the modulated waveform stored in the memory may be of any optional shape, such as a non-periodic swinging waveform as well as periodic sine waveform. Alternatively, a low-frequency oscillator (LFO) may be employed for generation of the modulated waveform, or a random number generator may be used and a random number generated thereby may be used as current sample value data of the modulated waveform signal directly or after being processed as necessary. In the latter case, random modulation control is carried out by the TSC control scheme. At next step S32, stretch/compression ratio setting information is generated in accordance with the generated sample values of the modulated waveform signal. This stretch/compression ratio setting information is fed by way of the control regsiter 113 (FIG. 1) to the waveform generating section 111, from which it is transferred as data of stretch/compression ratio SCR to the virtual read address calculator 17 directly or by way of the converting section 18 (FIG. 2). Step S32 may be omitted, and the sample value data of the modulated waveform signal may be fed to the converting section 18 so that the converting section 18 generated data of stretch/compression ratio SCR corresponding to the modulated waveform signal.

The virtual read address calculator 17 modulates the "pitch information" with the stretch/compression ratio data SCR that varies in accordance with the modulated waveform signal as mentioned above, and then generates virtual read addresses VAD varying at a rate corresponding to the "pitch information". The thus-generated virtual read addresses VAD have been swing-modulated periodically or non-periodically as shown, for example, in FIG. 18. Then, as illustratively shown in FIG. 18, the actual read address calculator 16 generates actual read addresses RAD that are intermittently shifted by the TSC control, in response to the swing of the virtual read addresses VAD while maintaining an advancing slope corresponding to the pitch information. Thus, by reading out the stored waveform data from the waveform memory 10 at a constant rate corresponding to the tone pitch while jumping back and forth along the time axis of the waveform data, a waveform can be generated which has undergone special modulation control to cause repetition of time-axis stretch and compression of the stored waveform. Thus, by applying such special modulation control to, for example, repetitive readout of a loop-portion waveform, the actually read-out waveform can be significantly varied by the TSC control even when the same loop-portion waveform is repetitively read out, thus effectively eliminating monotonousness due to the repetitive readout.

It should be obvious that the above-described modulation control is useful not only for eliminating monotonousness due to the repetitive readout but also for any other purposes. For example, the modulation control can be advantageously applied to a situation where it is desired to positively or freely impart "swing" to a to-be-generated tone so as to achieve a special tonal effect.

[Application of TSC Control to Various Special Performance Styles]

Figure 21:
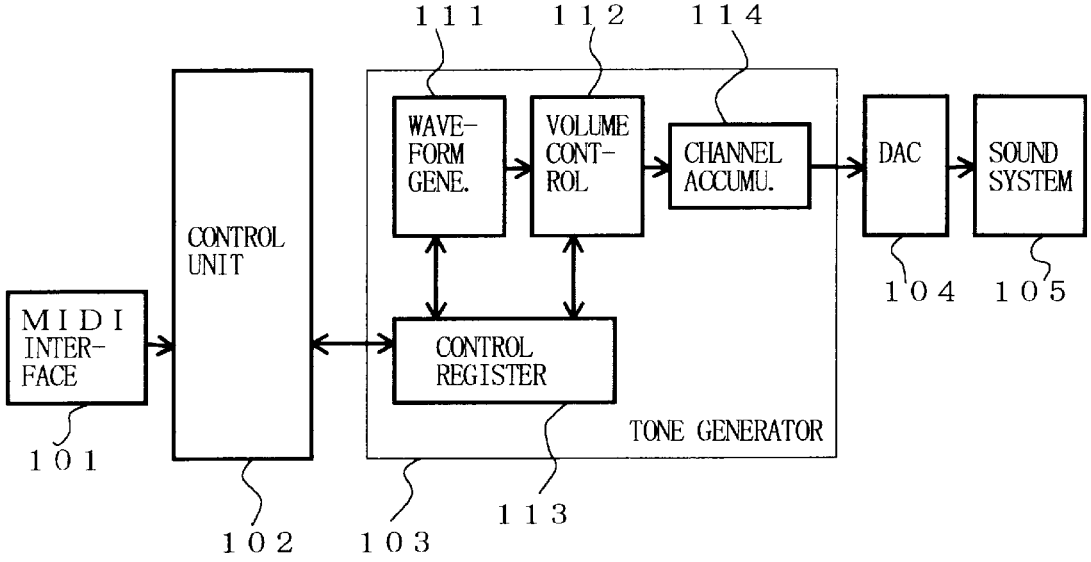
FIG. 21 is a block diagram illustrating a modified overall setup of the electronic musical instrument of FIG. 1.

Electronic musical instrument implementing the TSC control may include, in place of the keyboard 101A and performance operators 101B, a MIDI interface device for receiving, from an external source, necessary performance information in MIDI format and generating a tone waveform on the basis of the MIDI performance information. In such a case, the organization of the electronic musical instrument may be modified in a manner as shown in FIG. 21. In FIG. 21, the electronic musical instrument includes, in place of the keyboard 101A and performance operators 101B, a MIDI interface device 101 and performs tone reproducing operations based on the TSC control by means of the control unit 102, tone generator unit 103, etc. Here, information designating any of performance styles, such as vibrato, tremolo, slur and pitch bend, is also supplied to the instrument in MIDI format. In the waveform memory 10 (FIG. 2), plural-cycle waveform data corresponding to these performance styles are prestored in such a condition where they are managed in data divisions to be suited for the TSC control, as previously noted. Of course, the electronic musical instrument may include the MIDI interface device 101 in addition to, rather than in place of, the keyboard 101A and performance operators 101B.

Note that the current MIDI standard is not designed to include the "information designating any one of performance styles" in MIDI information, and thus the information may be supplied as a MIDI exclusive message. The exclusive message is data that is defined, according to the MIDI standard, for transfer of information having a function unique to a maker in question (i.e., maker-specific function).

Figure 22:
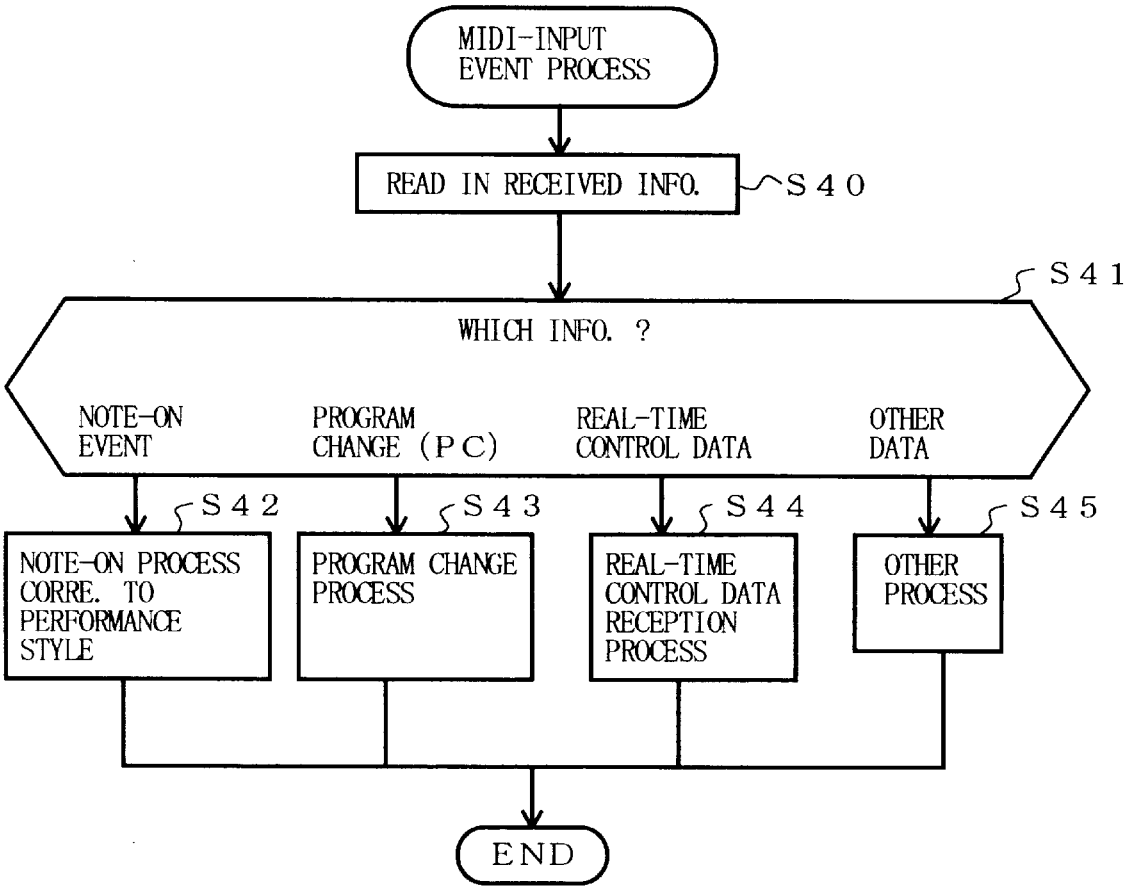
FIG. 22 is a flow chart showing an example of a MIDI input event process that is carried out by a control unit shown in FIG. 21.

In FIG. 21, the main routine of the processing program run by the control unit 102 includes an operation for ascertaining whether MIDI information has been received via the MIDI interface device 101, so that MIDI-input event processing is carried out, as shown in FIG. 22, when MIDI information has been received.

Figure 23:
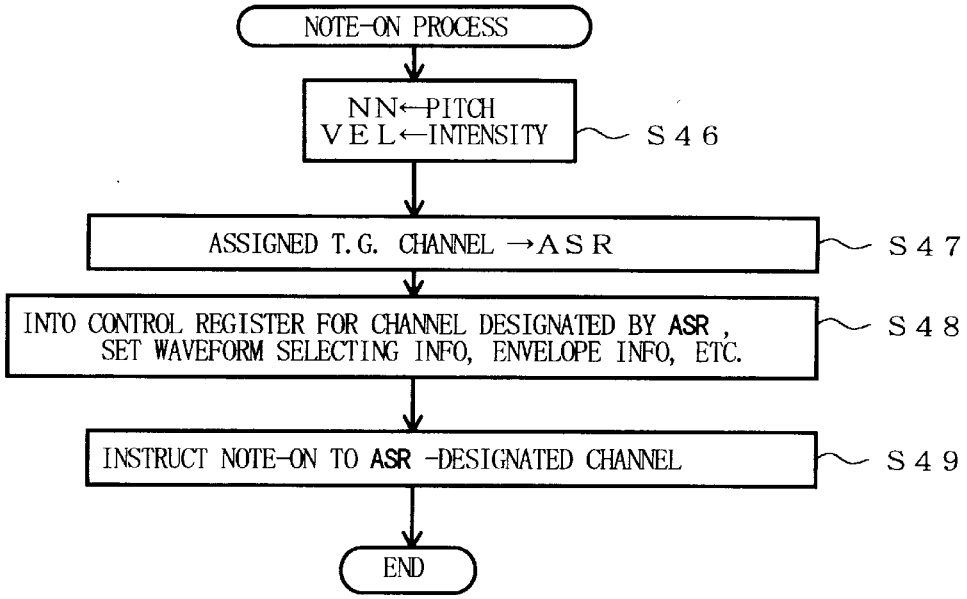
FIG. 23 is a flow chart showing an example of a note-on process that is carried out by the control unit of FIG. 21.

In the MIDI-input event processing of FIG. 22, the received MIDI information is read in at step S40, and the content of the received MIDI information is determined at step S41. If the received MIDI information represents a note-on event, control proceeds to step S42 in order to perform a note-on process corresponding to a designated performance style. Specifically, the note-on process is carried out using a waveform suited to a performance style determined by an interrupt process of FIG. 25 as will be later described. An example of the note-on process is shown in FIG. 23.

If the received MIDI information represents a program change (PC), then control proceeds to step S43 in order to perform a program change process corresponding to the content of the program change information.

Figure 24:
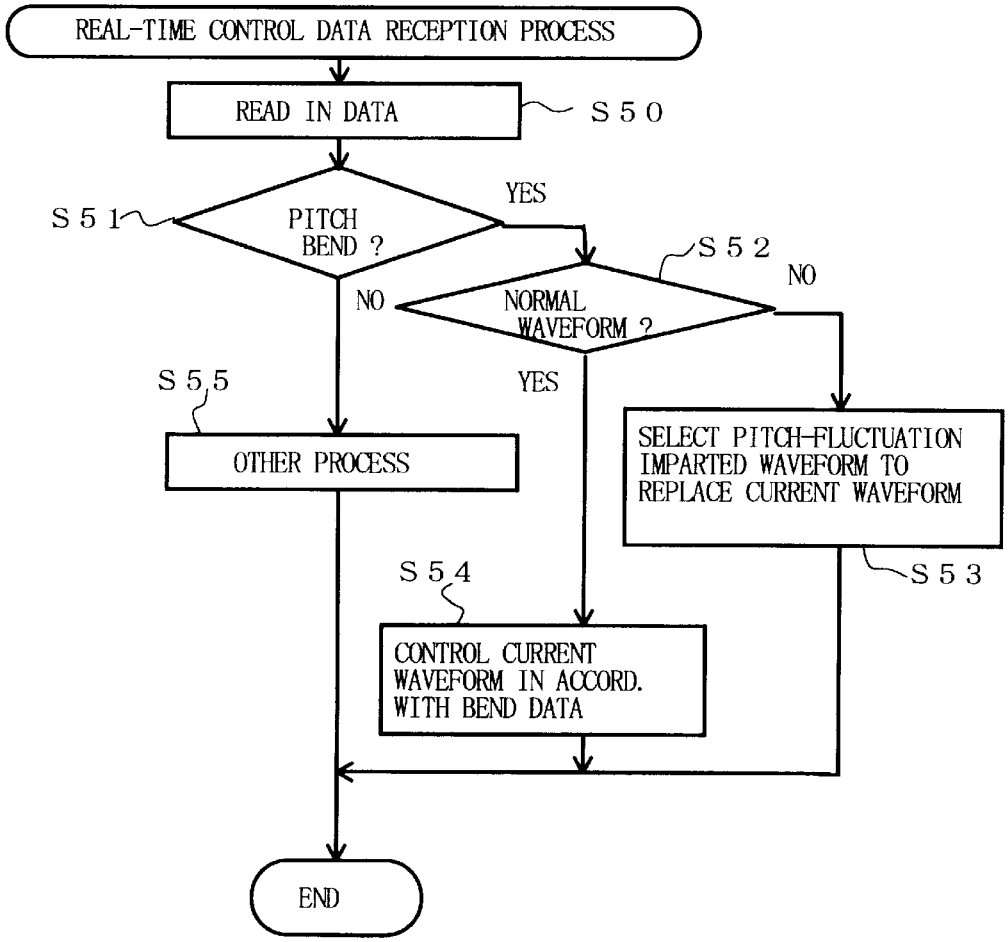
FIG. 24 is a flow chart showing an example of a real-time control data reception process that is carried out by the control unit of FIG. 21.

Further, if the received MIDI information represents data for controlling in real time a currently generated tone, then control proceeds to step S44 in order to perform a real-time control data reception process corresponding to the content of the real-time control data. If the received MIDI information is control change information, then the real-time control data reception process corresponding to the content of the control change information is carried out at step S44 in a manner corresponding to the performance style; that is, at this step S44, the real-time control data reception process is carried out using the waveform suited to a performance style determined by the interrupt process of FIG. 25. In the event the received MIDI information is another message than the control change information, the process of step S44 is executed as a process that should be carried out when control data is received for controlling in real time a currently generated tone. For example, even when the MIDI message is a "voice message", the process of step S44 is carried out if the voice message includes control data for controlling in real time a tone like "pitch bend", because "pitch bend" is normally included in a voice message according to the MIDI standard. As an example, the real-time control data reception process may use a processing routine as shown in FIG. 24.

If the received MIDI information is other than the above-mentioned, control proceeds to step S45 in order to carry out operations corresponding to the content of the other information.

The note-on process shown in FIG. 23 comprises a step sequence similar to that of the key-on event process shown in FIG. 12. Namely, information (e.g., key code KC) indicative of a pitch of the tone related to the detected note-on event (i.e, the tone designated for sounding) is stored into the note number register NN, and information indicative of initial touch intensity (i.e., velocity data) of the tone related to the detected note-on event is stored into the velocity register VEL, at step S46. Then, at step S47, any one of the plurality of channels is selected and assigned as a tone generator channel CH for sounding or generation of the designated tone, and a unique channel number of the assigned channel is stored into the assigned channel register ASR.

Thereafter, at step S48, various information necessary for the tone generation, such as waveform selecting information corresponding to a currently-selected tone color, performance style, etc. and envelope information, is set into the control register 113 (FIG. 21) designated by the channel number stored in the assigned channel register ASR.

As previously stated, the waveform selecting information is such information specifying particular waveform data to be used for the tone generation in the channel; more specifically, this information designates some of a plurality sets of waveform data stored in the waveform memory 10. Further, as previously stated, the envelope information is such information indicating target value data and variation rates (slopes of broken lines) for forming a broken-line envelope for controlling tone volume or the like. Among various information set in the control register 113 are key code KC, tone color code TC and some of other information INF shown in FIG. 2. Further, in association with the stored content of the assigned channel register ASR, there is set, in the control register 113, "pitch information" corresponding a pitch frequency of the tone allocated to the channel on the basis of the stored content of the note number regsiter NN. Also, in association with the stored content of the assigned channel register ASR, there are set, in the control register 113, various target level data and variation rate data to be used for envelope formation. Specific pieces of information to be used for generating tone signals on a channel-by-channel basis are conventionally known and may be of any desired specification, although not described here in detail. Various data and information thus set in the control register 113 for the individual channels are fed to the waveform generating section 111 and tone volume control section 112.

Figure 25:
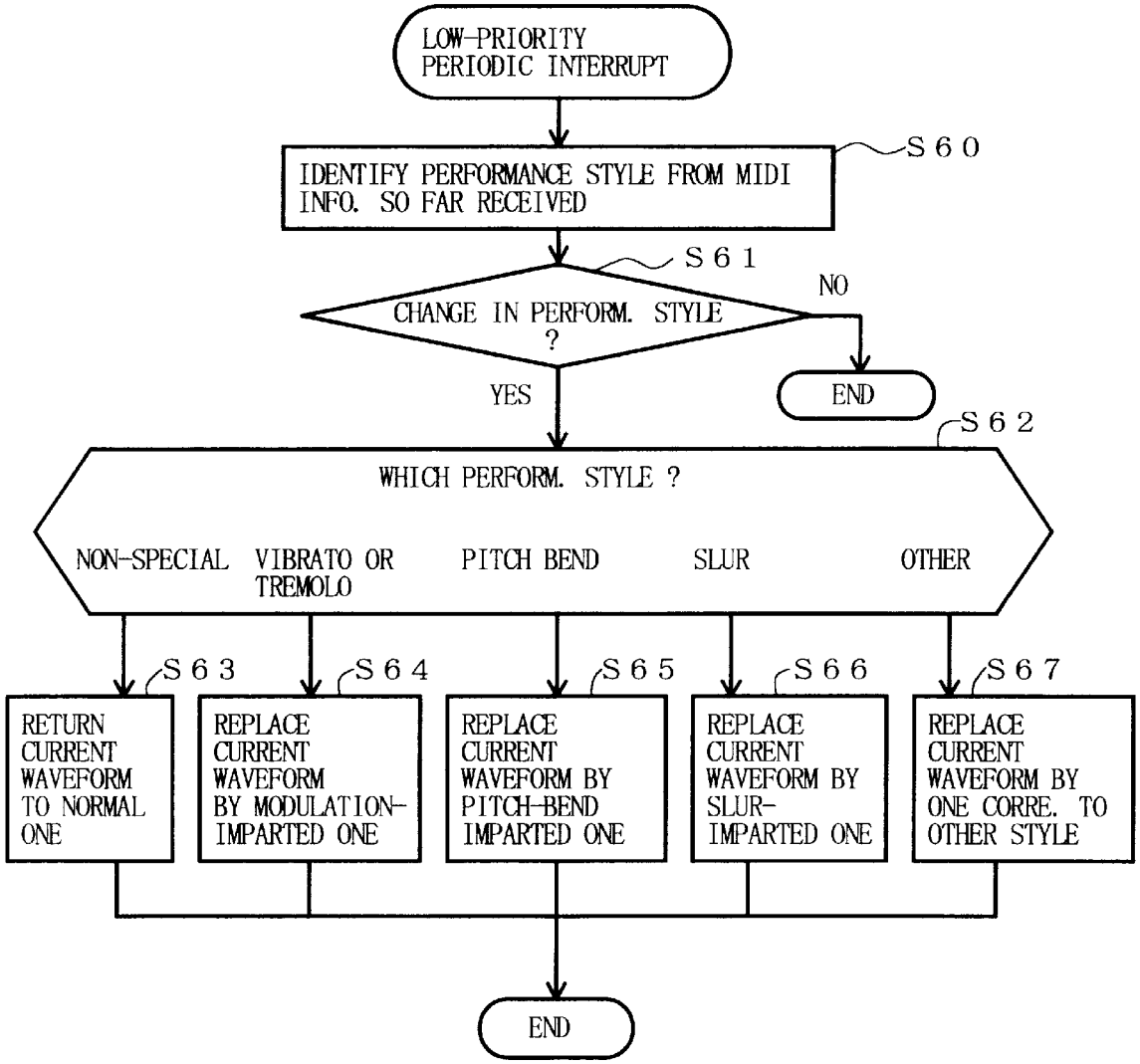
FIG. 25 is a flow chart showing an example of an interrupt process, relating to identification of a performance style, that is carried out by the control unit of FIG. 21.

At step S48, operations are carried out on the basis of a performance style determined by the interrupt process of FIG. 25. More specifically, the waveform selecting information is generated for selecting a dedicated waveform corresponding to the determined performance style and set into the control register 11 for the corresponding channel. If the determined performance style is not a special one, step S48 sets such waveform selecting information for selecting a normal waveform that does not corresponds to a special performance style. If the determined performance style is vibrato, tremolo or the like, step 48 sets such waveform selecting information for selecting a waveform that has a predetermined modulation effect (vibrato, tremolo or the like) imparted thereto. If the determined performance style is a pitch bend, then step 48 sets such waveform selecting information for selecting a waveform that has a predetermined pitch bend effect imparted thereto. If the determined performance style is a slur, then step 48 sets such waveform selecting information for selecting a waveform that has a predetermined slur effect imparted thereto. Further, if the determined performance style is other than the abovementioned, then step 48 sets such waveform selecting information for selecting a predetermined waveform that corresponds to the other performance style.

Finally, at step S49, a note-on signal instructing tone generation in accordance with the stored content of the assigned channel register ASR is fed to the waveform generating section 111 and tone volume control section 112 by way of the control regsiter 113. In response to the note-on signal, the waveform generating section 111 and tone volume control section 112 initiate operations to read out the waveform and to form and generate a tone volume envelope. These operations in the waveform generating section 111 and tone volume control section 112 are carried out for the individual channels on the time-divisional basis.

FIG. 24 is a flow chart showing an example of the real-time control data reception process at step S44 of FIG. 22, which is activated in response to reception of data for controlling a currently generated or sounding tone in real time.

In the real-time control data reception process of FIG. 24, the received control data is read in at step S50, and a determination is made at next step S51 as to whether the received control data is "pitch bend" data that designates a pitch deviation amount from the designated tone pitch stored in the note number register NN. If the determination is YES at step S51, control goes to step S52, where it is checked whether or not pitch fluctuation control based on the pitch bend data should be carried out using the normal waveform (with no pitch fluctuation control previously imparted thereto). If a dedicated waveform having pitch fluctuation control previously imparted thereto (such as the vibrato-imparted waveform, slur-imparted waveform or vibrato-imparted waveform) is to be used, then a negative determination results at step S52, so that control goes to step S53. At step S53, waveform selecting information for selecting the pitch-fluctuation-imparted waveform dedicated to the current determined performance style (such as vibrato, slur or pitch bend) is set into the control register 113, and then the waveform of the currently generated tone is replaced by an optional waveform segment of the pitch-fluctuation-imparted waveform corresponding to the pitch bend data. Namely, because pitch fluctuations have been imparted to stored waveform data of such a pitch-fluctuation-imparted waveform along its time axis, it is possible to read out waveform data having imparted thereto a pitch fluctuation corresponding to the pitch deviation amount, i.e., selectively read out a waveform segment having a pitch corresponding to the pitch deviation amount, by designating particular locations (virtual read addresses) in the stored waveform data of the pitch-fluctuation-imparted waveform in accordance with the pitch deviation amount designated by the current pitch bend data.

If, on the other hand, the normal waveform is to be used rather than the pitch-fluctuation-imparted waveforms, then an affirmative determination results at step S52, so that control goes to step S54. At step S54, the pitch information of the currently generated tone is modulated in accordance with the pitch deviation amount designated by the current pitch bend data to thereby pitch-modulate read addresses, so that the waveform data controlled to provide a pitch fluctuation are read out.

If the received control data is not pitch bend data as determined at step S51, control proceeds to step S55 in order to other operations for controlling the currently generated tone in real time. For example, if the received control data is data for tremolo, operations generally similar to those of the above-mentioned steps S52 to S54 are carried out for tremolo. Namely, the dedicated tremolo-imparted waveform corresponding to the tremolo control data is selected, and the waveform of the currently generated tone is replaced by a waveform segment of the waveform data stored at locations corresponding to a tremolo control amount designated by the control data. Among the other control data used in the process are "after-touch" included in a MIDI voice message and "modulation depth", "breath data" and "expression" included in a "control change" message. Note that in the real-time control data reception operations based on the other control data, the waveform replacement may or may not be conducted depending on the nature of the control data.

As noted above, the interrupt process shown in FIG. 25 is arranged to determine a performance style so as to select a predetermined one of the waveforms that is suited to the determined performance style. Note that this interrupt process may be executed with a lower priority over other processes.

First, at step S60, a determination is made, on the basis of MIDI information having been supplied so far, as to which performance style should be used for reproductive performance. Then, at next step S61, it is determined whether or not the determined performance differs from a currently-employed performance style. If there has been no change in the performance style as determined at step S61, the interrupt process is terminated. If, however, there has been a change in the performance style, then control proceeds to step S62 in order to further determine what the new performance style is, and a waveform selecting process is performed in a manner corresponding to the new performance style at any one of steps S63 to S67.

More specifically, at step S60, timewise interrelation between the MIDI information so far received may be analyzed. With such analysis, it is possible to know, clearly or to some degree, which performance style is being used or should be used. The "MIDI information so far received" is pieces of MIDI information received within a predetermined period or a predetermined number of pieces of MIDI information. Alternatively, the received MIDI information may be delayed by a predetermined time so that the tone is controlled by the delayed MIDI information; thus, it is possible to determine the performance style from pieces of MIDI information received within a predetermined period in the past and future or a predetermined number of pieces of MIDI information received in the past and future.

If the new performance style has been found to be a non-special performance style at step S62, control goes to step S63, where waveform selecting information for selecting a predetermined normal waveform (that does not correspond to a special performance style) is set into the control regsiter 113 (FIG. 21) so as to return the currently generated tone to the normal waveform. If the new performance style has been found to be "vibrato" or "tremolo" at step S62, then control goes to step S64, where waveform selecting information for selecting a waveform having a predetermined modulation effect imparted thereto is set into the control regsiter 113 so as to set the waveform of the currently generated tone to the modulation-effect imparted waveform. If the new performance style has been found to be "pitch bend" at step S62, then control goes to step S65, where waveform selecting information for selecting a waveform having a predetermined pitch-bend-effect imparted thereto is set into the control regsiter 113 so as to set the waveform of the currently generated tone to the pitch-bend-imparted waveform. If the new performance style has been found to be "slur" at step S62, then control goes to step S66, where waveform selecting information for selecting a waveform having a predetermined slur effect imparted thereto is set into the control regsiter 113 so as to set the waveform of the currently generated tone to the slur-imparted waveform. Further, if the new performance style has been found to be other than the above-mentioned at step S62, then control goes to step S67, where waveform selecting information for selecting a predetermined waveform having an other-performance-style effect imparted thereto is set into the control regsiter 113 so as to set the waveform of the currently generated tone to the other-performance-style-effect-imparted waveform. Note that the operations of the individual steps of FIG. 25 are carried out on the channel-by-channel basis.

In the case where there has been a change in the performance style as determined at step S61, the new performance style is continued until step S61 next detects a change in the performance style. In tone generation based on note-on event data received during continuation of a particular performance style, waveform data corresponding to the particular performance style is designated as waveform data to be used for generating a tone. Once a performance style change is detected after start of the tone generation, the waveform data for the tone being generated is changed to that corresponding to the new performance style, through the operations of steps S62 to S67. Even when the waveform data for the tone being generated is to be changed like this, there may be applied cross-fade synthesis that is performed by means of the cross-fade synthesis section on the basis of readout of the waveform data for two, primary and subsidiary, cross-fading waveform region data. In this case, the waveform data before and after the change can be smoothly interconnected by the cross-fade synthesis section initiating cross-fade synthesis such that the readout of the waveform data corresponding to the new performance style is started for one of the cross-fading waveform region while the readout of the waveform data having been used so far is continued for the other cross-fading waveform region.

Next, a description will be made about exemplary manners in which waveform data corresponding to several performance styles are stored and subsequently read out for reproduction.

Figure 26:
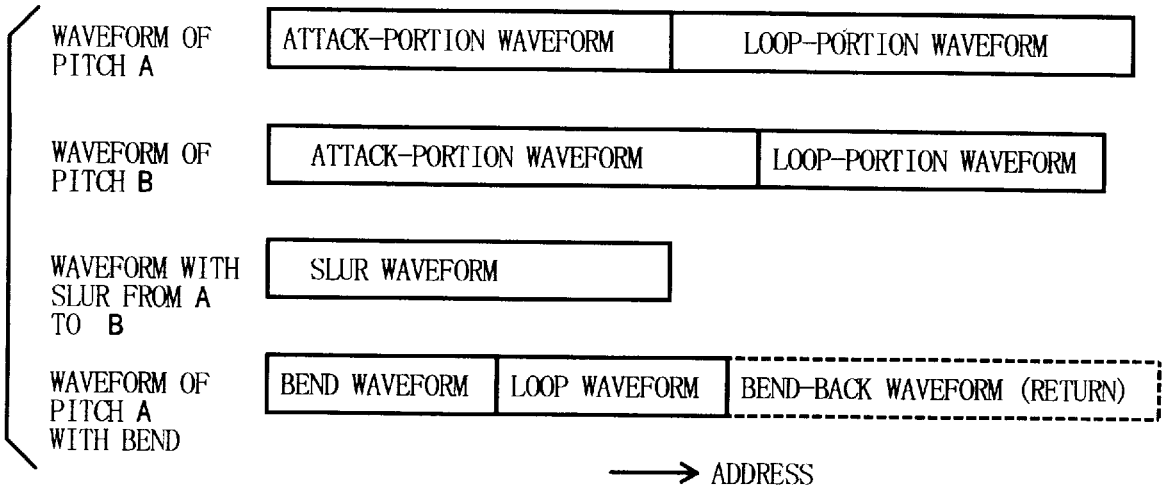
FIG. 26 is a diagram showing examples of waveform data stored in corresponding relations to performance styles.

FIG. 26 shows, at (a), an exemplary storage format of waveform data corresponding to pitch A and also shows, at (b), an exemplary storage format of waveform data corresponding to pitch B. Each of the waveform data includes an attack-portion waveform and a loop-portion waveform similarly to the example of FIG. 19. Further, at (c) of FIG. 26 is shown an exemplary storage format of a waveform corresponding to a slur from pitch A to pitch B, i.e., a slur-imparted waveform of a transient region to effect a slur from pitch A to pitch B. Also, at (d) of FIG. 26 is shown an exemplary storage format of a waveform, corresponding to pitch A, for a pitch bend, which includes a bend waveform corresponding to a pitch-bend portion and a looping waveform corresponding to a portion maintaining the bent pitch. The waveform at (d) of FIG. 26 may further include a bend-back waveform (represented in broken-line block) to be used for resuming the original pitch. Where no bend-back waveform is stored, bend control may be performed to resume the original pitch by repetitively reading out the looping waveform.

Figure 27:
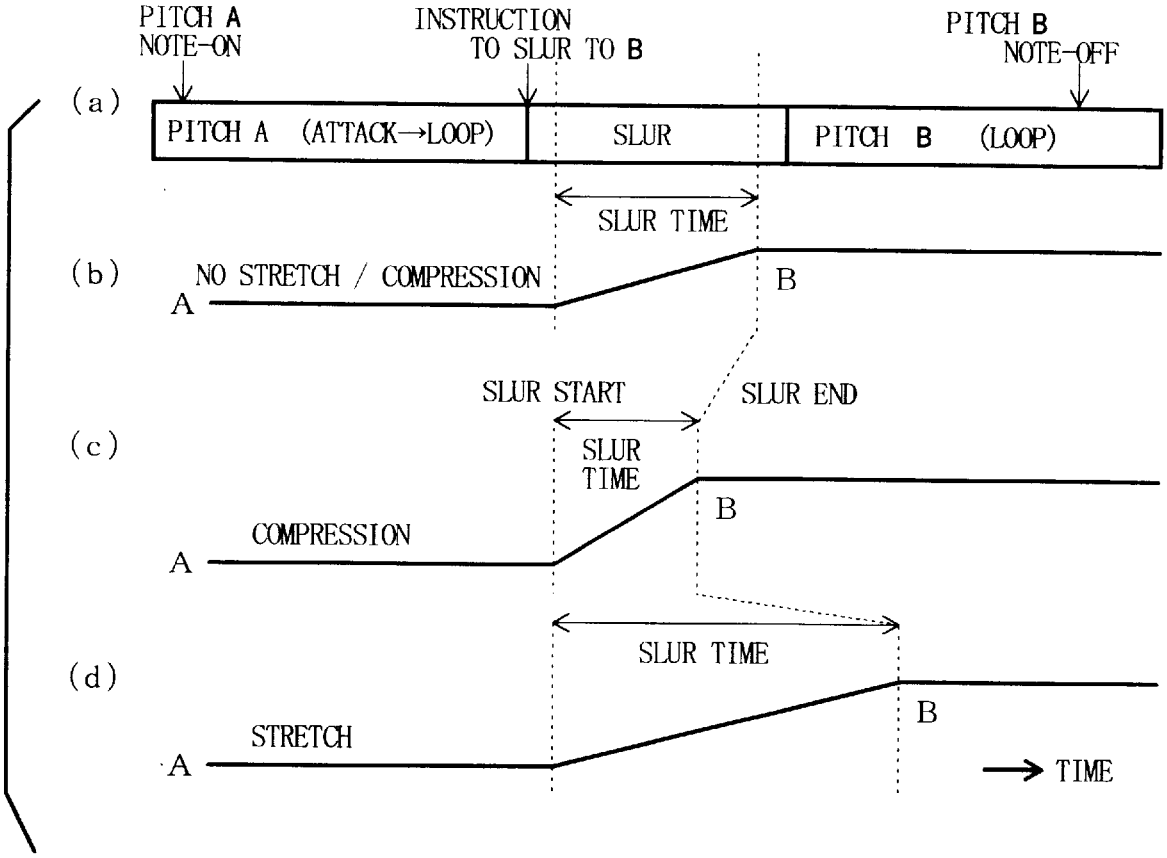
FIG. 27 is a diagram showing exemplary manners in which a waveform is read out when a slur performance is to be effected.

FIG. 27 shows examples in which the waveform is read out when a slur performance is to be effected. At (a) of FIG. 27 is shown an example where the attack-portion waveform of the waveform data corresponding to pitch A is first read out from the waveform memory 10 and then the loop-portion waveform is repetitively read out and where a change to pitch B through a slur performance is instructed during the loop-portion waveform readout. In response to the slur instruction, the waveform readout operation shifts to a predetermined slur waveform (shown at (c) of FIG. 26) to thereby read out the slur waveform from the waveform memory 10, and then, upon completion of readout of the slur waveform, the waveform readout operation shifts to the waveform data corresponding to pitch B thereby read out the waveform from the waveform memory 10. At (b) of FIG. 27 is shown another example where no time-axis stretch/compression based on the TSC control is carried out during readout of the slur waveform. At (c) of FIG. 27 is shown still another example where time-axis compression based on the TSC control is carried out during readout of the slur waveform, while at (d) of FIG. 27 is shown still another example where time-axis stretch based on the TSC control is carried out during readout of the slur waveform. By employing the TSC control, only the time length of the slur performance can be variably controlled without changing a pitch variation width (from pitch A to pitch B) within the slurring period.

Figure 28:
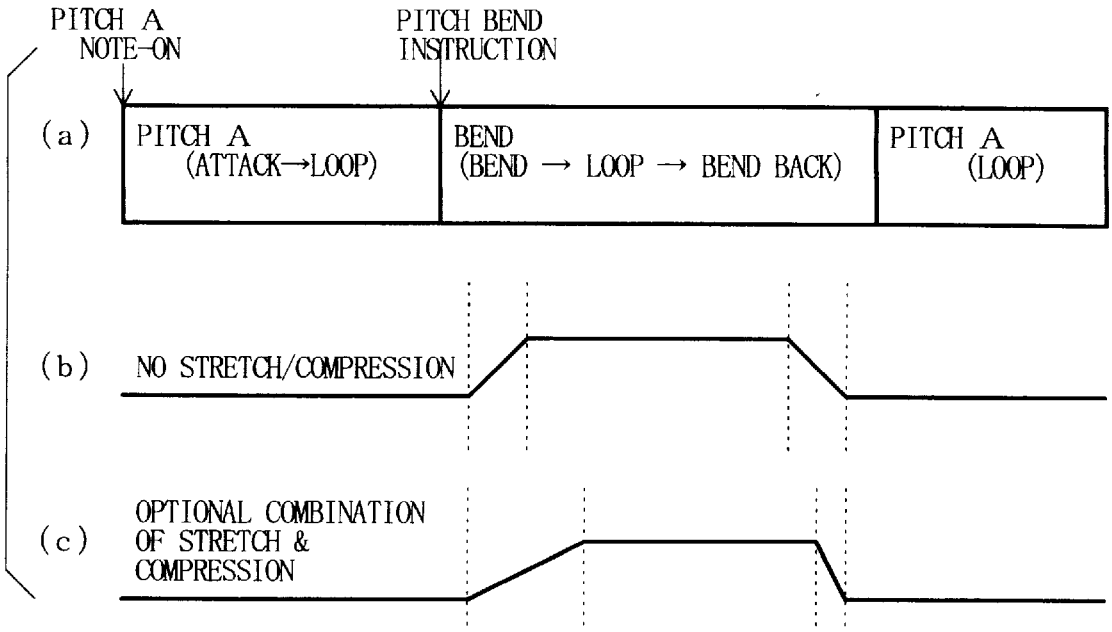
FIG. 28 is a diagram showing exemplary manners in which a waveform is read out when a pitch bend performance is to be effected.

FIG. 28 shows examples in which the waveform is read out when a pitch bend performance is to be effected. At (a) of FIG. 28 is shown an example where the attack-portion waveform of the waveform data corresponding to pitch A is first read out from the waveform memory 10 and then the loop-portion waveform is repetitively read out and where a pitch bend is instructed during the loop-portion waveform readout. In response to the pitch bend instruction, the waveform readout operation shifts to a predetermined bend waveform (shown at (d) of FIG. 26) to thereby read out the bend waveform from the waveform memory 10, and then, upon completion of readout of the bend waveform, the waveform readout operation shifts to the bend-back waveform data. Upon completion of readout of the bend-back waveform, readout of the loop-portion waveform corresponding to original pitch A is resumed. At (b) of FIG. 28 is shown another example where no time-axis stretch/compression based on the TSC control is carried out during readout of the individual pitch-bend-related waveforms. At (c) of FIG. 28 is shown still another example where time-axis stretch/compression based on the TSC control is carried out during readout of the individual pitch-bend-related waveforms. By employing the TSC control, only the time length of the pitch bend performance can be variably controlled without changing a pitch variation width (i.e., a variation up to a predetermined deviation amount from pitch A) within the pitch bend period.

[Modification of TSC Control Using Virtual Read Address]

The organization shown in FIG. 2 may be modified in such a manner that the virtual read address calculator 17 outputs data indicative of a data division j' which a current virtual read address VAD belongs to rather than the virtual read address VAD itself and that the shift control circuit 14 makes a comparison between data divisions j and j' associated with current actual and virtual read addresses RAD and VAD rather than between the actual and virtual read addresses RAD and VAD and then generates a shift instruction on the basis of the comparison result. Namely, the comparison made by the shift control circuit 14 is between the data divisions, rather than between the addresses.

In this modification, the shift instruction is issued when a difference or deviation between the actual read-out data division j and the virtual read-out data division j' has exceeded a predetermined value corresponding to the total length of one or more data divisions. For example, the shift instruction is issued when the difference or deviation between the actual read-out data division j and the virtual read-out data division j' has exceeded a value corresponding to the total length of one data division. Where the virtual read address VAD is greater in variation slope than the actual read address RAD as shown in FIG. 3, the shift instruction is issued to the actual read address calculator 16 once a condition of $j' \geqq j+1$ has been satisfied, in response to which the address calculator 16 shifts the data division j to the next one using the virtual read-out data division j' (i.e., $j \leftarrow j'+1$) rather than just incrementing the value j by one (i.e., $j \leftarrow j+1$); thus, the actual read address calculator 16 controls the actual read-out data division j to shift (jump) forward. Similarly, where the virtual read address VAD is smaller in variation slope than the actual read address RAD as shown in FIG. 4, the shift instruction is issued to the actual read address calculator 16 once a condition of $j' \leqq j-1$ has been satisfied, in response to which the address calculator 16 shifts the data division j to the next one using the virtual read-out data division j' (i.e., $j \leftarrow j'-1$) rather than just decrementing the value j by one (i.e., $j \leftarrow j-1$); thus, the actual read address calculator 16 controls the actual read-out data division j to shift (jump) backward. However, such controlled may be carried out in any other suitable manners than the above-mentioned.

[Other Embodiment of the TSC Control]

The TSC control according to the present invention may be carried out by using an optional combination of all or some of several cross-fade methods in accordance with a "stretch/compression ratio relative to a standard reproducing time length" as will be later described, rather than by using the virtual read address as noted above.

Figure 29:
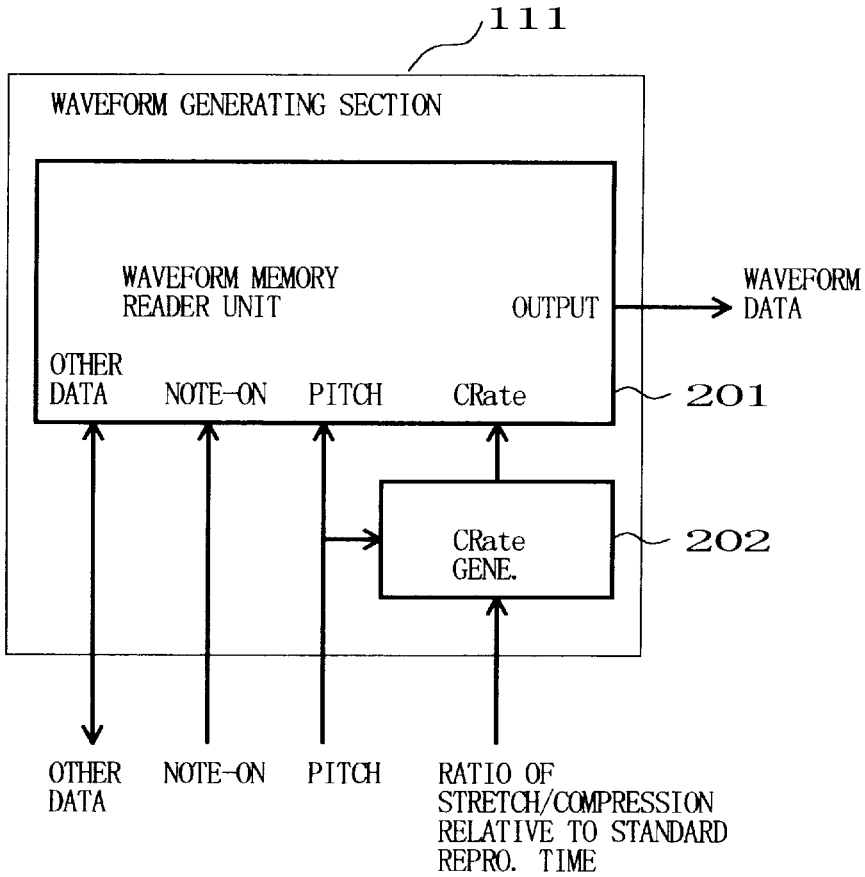
FIG. 29 is a block diagram schematically showing an exemplary arrangement of the waveform generating section of FIG. 1 or 21 in a case where an optional combination of all or some of several cross-fade methods is employed in accordance with a "ratio of stretch/compression relative to a standard reproducing time length" as another embodiment of the TSC control.

The following embodiment may employ any one of the two exemplary hardware setups of the electronic musical instrument shown in FIGS. 1 and 21, but the organization of the waveform generating section 111 has to be modified in a manner as schematically shown in FIG. 29.

In FIG. 29, the waveform generating section 111 includes a waveform memory reader unit 201 having a time-axis stretching/compressing function, and a "CRate" generator 202. The waveform generating section 111 receives, by way of the control regsiter 113 (FIG. 1 or 21), a waveform generating instruction in the form of a note-on signal and pitch information indicative of a pitch of a tone to be generated, as well as tone color information such as key code KC, tone color code TC and some of other information INF as shown in FIG. 2.

The waveform generating section 111 also receives a parameter indicative of the "ratio of stretch/compression relative to a standard reproducing time length". Because the waveform memory reader unit 201 actually performs the time-axis stretching/compressing function on the basis of a time-axis stretch/compression ratio CRate based on a tone generating time length that is required when the waveform data are read out at a rate corresponding to a designated pitch (the tone generating time length varies depending on a desired pitch, as represented by the waveforms 1402 and 1403 of FIG. 5), the "CRate" generator 202 is provided here to convert the parameter. Specifically, the "CRate" generator 202 receives the pitch information and the "ratio of stretch/compression relative to a standard reproducing or tone generating time length" and calculates a time-axis stretch/compression ratio CRate based on the tone generating time length varying depending on the desired pitch. The thus-calculated time-axis stretch/compression ratio CRate is fed to the waveform memory reader unit 201.

Figure 30:
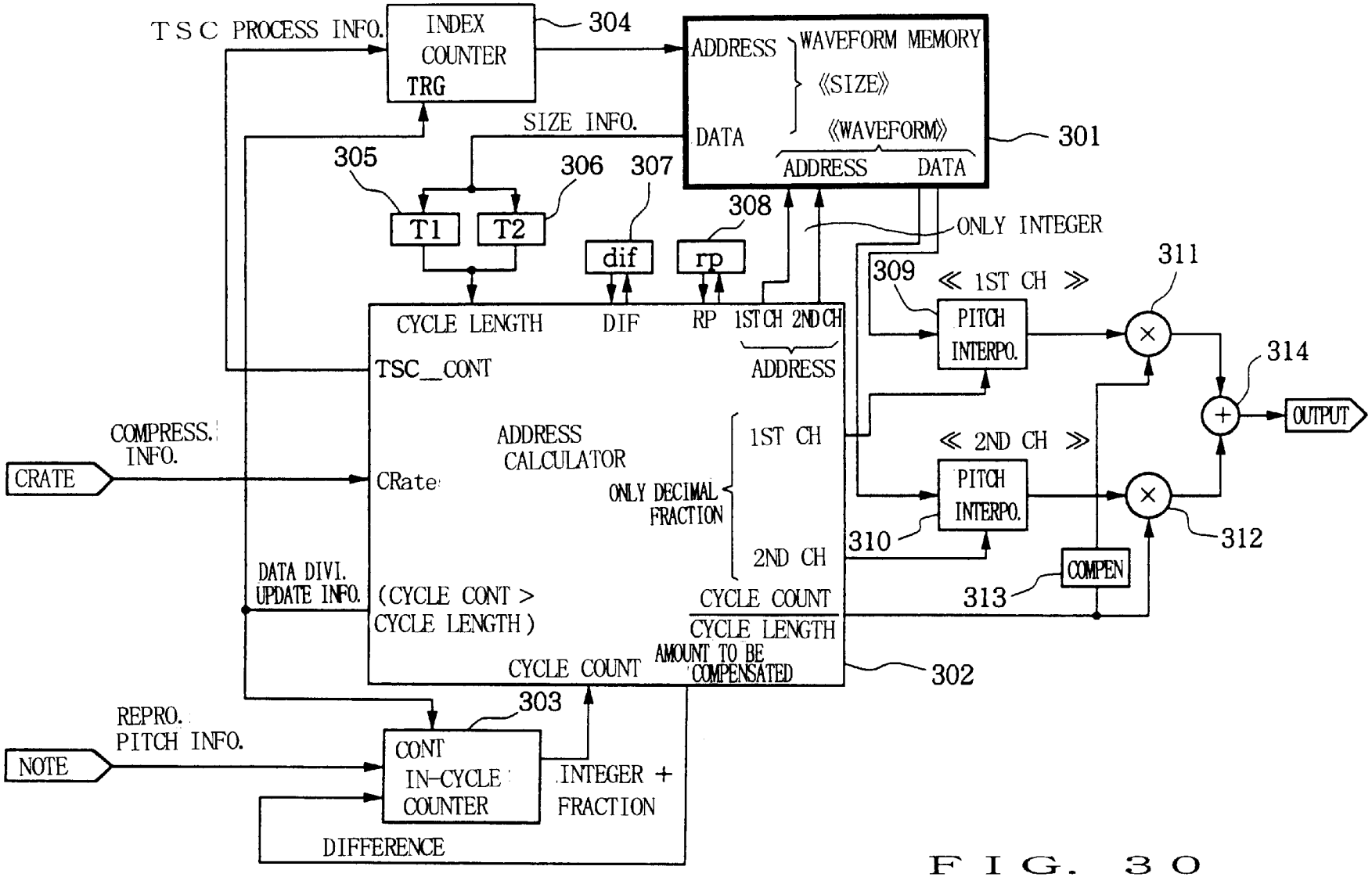
FIG. 30 is a block diagram showing a detailed example of a waveform memory reader unit shown in FIG. 29.

FIG. 30 is a block diagram showing details of the waveform memory reader unit 201 of FIG. 29. Before going into the details, let us explain the basic concept of the time-axis stretching/compressing function, i.e, TSC control, employed in the present embodiment.

First, the time-axis stretch/compression ratio CRate is a parameter introduced in the embodiment to implement the time-axis stretching/compressing function. In more specific terms, the time-axis stretch/compression ratio CRate indicates that a reproducing time length of an output waveform is set to be 1/CRate of a reproducing time length of an original (pitch-controlled) waveform. Of course, the time-axis stretch/compression ratio CRate is not always a fixed value and can be varied in real time even during readout of the waveform (i.e., at an intermediate point between the start and end of the generated tone); thus, the ratio CRate has the above-mentioned significance when considered locally. With CRate=1.0, the output waveform will be maintained at its original time length; with CRate>1.0, the output waveform will be compressed; and with CRate<1.0, the output waveform will be stretched.

The following paragraph describes the waveform data stored in a waveform memory 301 (FIG. 30) within the waveform memory reader unit 201. The waveform memory 301, like the above-mentioned waveform memory 10 of FIG. 2, stores a plurality of sets of plural-cycle waveform data in corresponding relations to various tonal characteristics, and each set of the stored waveform data is previously divided into a plurality of data divisions for management purposes. Similarly to the above-mentioned, the plural-cycle waveform data stored in the waveform memory 301 are pre-analyzed, and points in the plural cycles which are in a same phase with each other (same-phase points) are determined as respective start points of the individual data divisions. In other words, such same-phase points are found in the waveform data, and the waveform data are divided at the same-point points to define the individual data divisions. Waveform data over two or more cycles may be contained in a single data division. In short, boundaries between every adjacent data divisions are the same-phase points and it is sufficient that each of the data divisions be defined to be able to be smoothly connected to another data division. The same-phase points are such points which are identical with each other in waveform amplitude value and in sloping direction of the waveform. Note that the data divisions do not or need not necessarily coincide with the cycles corresponding to a fundamental pitch of the waveform data.

More detailed description is given below. Let's assume here that each of the same-phase points has an address Ai that consists of an integer part and a decimal fraction part. "i" represents a unique data division number, and hence "Ai" represents a start point address of "i"th data division. Index count IC, which will be later described, represents a current counted value of the data division number i. Because the respective start points of the individual data divisions are in the same phase, a smooth waveform interconnection may be achieved even when one data division is first read out up to the last point and then another data division starting at another point is read out. To interconnect two data divisions, the present embodiment is arranged to further perform cross-fade synthesis in addition to the interconnection between the same-phase points, and hence achieves an even smoother waveform interconnection.

In the waveform memory, there are also stored size data Ti (Ai+1−Ai) of the individual data divisions. The size Ti is calculated by subtracting the start point of "i"th data division from the start point of "i+1"th data division. By thus storing the sizes of the individual data divisions, the storage capacity can be effectively saved as in the case where all the addresses Ai are stored. Each of the data division sizes represented by the value Ti is of course expressed in the number of samples (which includes integer and decimal fraction parts).

The start point address Ai of each of the data divisions may be evaluated as follows:

$$Ai=A0+\Sigma T$$

where A0 represents the start address of the waveform data (i.e., the start point address of 0th data division) and ΣT represents an accumulated value of the sizes Ti for j=0, 1, 2, . . . , i−1.

The basic principle of the time-axis stretch/compression control, i.e., TSC control, in the present invention will be explained briefly below. In the present embodiment, the time-axis stretch/compression uses a "reproduction period" as its processing time unit. The "reproduction period" corresponds to a time period necessary for reproduction of one data division and represents a unit time length, of the waveform data stretch/compression in the waveform memory, which is not expressed in the number of samples. According to the basics of the time-axis stretch/compression control, a difference between each ideal readout point designated by a value of the time-axis stretch/compression ratio CRate and a corresponding actual readout point is calculated so that predetermined operations are carried out every reproduction period in accordance with the calculated difference to allow the actual readout point to successively follow the ideal readout point. In short, the predetermined operations determine which one of "stretch process" for stretching the reproducing time length, "normal process" for maintaining the reproducing time length and "compression process" for compressing the reproducing time length should be carried out, and execute the thus-identified process every reproduction period as will be later described in detail. Because invalidating the TSC control with respect the waveform data of non-periodic waveform segments may improve efficiency, it is preferred to allow the TSC control enable/disable condition to be controlled selectively.

Figure 31:
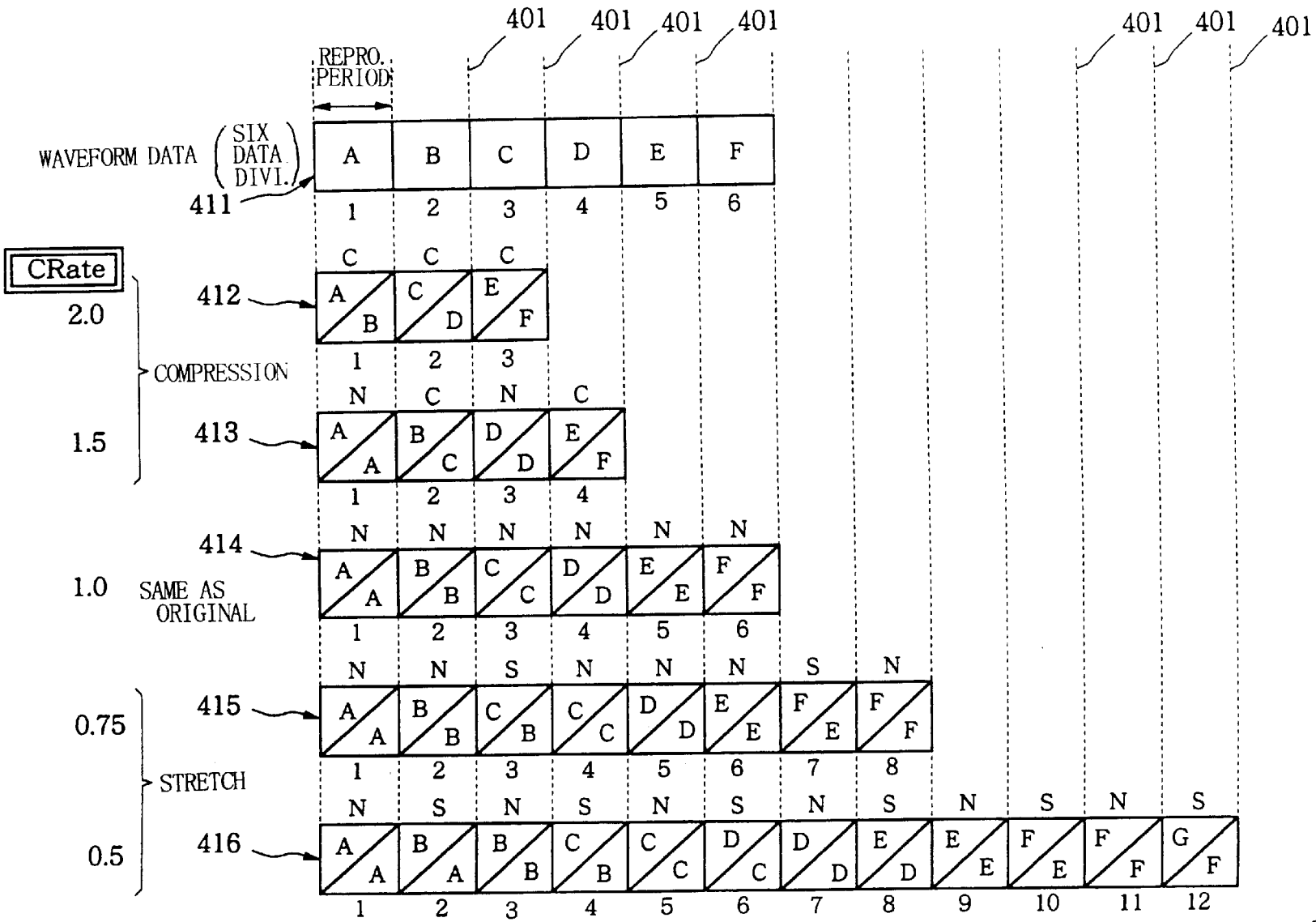
FIG. 31 is a diagram explanatory of a basic concept of the TSC control in the detailed example of FIG. 30.

FIG. 31 is a diagram explanatory of the basic concept of the TSC control in the present embodiment. In FIG. 31, reference numeral 411 represents an example of waveform data stored in the waveform memory, and blocks 412 to 416 represent exemplary manners in which the waveform data are read out from the waveform memory. The waveform data 411 consists of six data divisions as denoted at A to F. Vertical dotted lines 401 represent boundaries between reproduction periods when the waveform data are reproduced at a predetermined pitch. Thus, the horizontal axis represents elapsed time in the stretch/compression process rather than the sample length, but the elapsed time represented here is not absolute time. Numbers added below the data divisions A to F of the waveform data 411 indicate a predetermined order in which the data divisions are to be reproduced. Whereas the vertical dotted lines 401 representing boundaries between reproduction periods are drawn at equal intervals in the example of FIG. 31, the time lengths of the individual reproduction periods may differ depending on the sizes of the data divisions. Similarly, the reproduction periods shown in relation to blocks 412 to 416 may differ from each other in the horizontal and vertical directions.

Each of near-square small blocks, in the rectangular blocks 412 to 416, represents a unit of data that is processed within one reproduction period in the stretch/compression process, and any one of the stretch, normal and compression processes (shown in the figure as "S", "N" and "C", respectively) is carried out in each of such blocks or reproduction periods. Rectangular blocks 412 to 416 represent examples where the waveform data 411 of the six data divisions are controlled to be stretched or compressed in accordance with the time-axis stretch/compression ratio CRate. In each of the reproduction periods of FIG. 31, a predetermined one of the data divisions (six data divisions in the illustrated example) in the waveform data 411 is read out for each of two cross-fading waveform region data. The data divisions to be read out in the two cross-fading channels may or may not be the same. This way, irrespective of which of the stretch, normal and compression processes is carried out in the reproduction periods, the present embodiment always generates an output waveform based on the cross-fade synthesis between the two cross-fading waveform region data (hereinafter "first and second cross-fading waveform region data"). In FIG. 31, each of the near-square small blocks, representing the reproduction periods, in rectangular blocks 412 to 416 is divided by a diagonal line into two triangular segments where reference characters A–F representing two selected data divisions are written, which means that the cross-fade synthesis between the first and second cross-fading waveform region data is executed using these two data divisions. More specifically, in the illustrated examples, the data division specified in the upper triangular segment (above the diagonal line) is the first cross-fading waveform region data to be faded out, while the data division specified in the lower triangular segment (below the diagonal line) is the second cross-fading waveform region data to be faded out. Further, reference characters "S", "N" and "C", added above the individual near-square small blocks representing the reproduction periods, indicate that the stretch, normal and compression processes are executed in the corresponding reproduction periods. The cross-fade synthesis fading out the first cross-fading waveform region data and fading in the second cross-fading waveform region data is terminated in the middle of each reproduction period.

Block 412 shows the example where the waveform data are processed with the time-axis stretch/compression ratio CRate of 2.0 (CRate=2.0). As shown, in the first reproduction period, the compression (C) process is executed where data division A is read out as the first cross-fading waveform region data and data division B is read out as the second cross-fading waveform region data, so that these read-out cross-fading waveform region data represented by the data divisions A and B are subjected to cross-fade synthesis to provide an output waveform. In the second reproduction period, the compression (C) process is executed where data division C is read out as the first cross-fading waveform region data and data division D is read out as the second cross-fading waveform region data, so that these read-out cross-fading waveform region data represented by the data divisions C and D are subjected to cross-fade synthesis to provide an output waveform. Further, in the third reproduction period, the compression (C) process is executed where data division E is read out as the first cross-fading waveform region data and data division F is read out as the second cross-fading waveform region data, so that these read-out cross-fading waveform region data represented by the data divisions E and F are subjected to cross-fade synthesis to provide an output waveform. Here, the time length of each of the reproduction periods to execute the cross-fade synthesis is set to coincide with the time over which the data division as the second (i.e., faded-in) cross-fading waveform region data is read out. Therefore, in this readout example 412, the time lengths over which data divisions B, D and F are read out as the second (i.e., faded-in) cross-fading waveform region data at a desired pitch become the lengths of the corresponding reproduction periods. Thus, if the individual data divisions are set to have a same length, then a total reproducing time of the resultant output waveform 412 when read out at a desired pitch can be just about 1/CRate (i.e., about ½) of a total reproducing time that would be required when the original stored waveform 411 is read out at the same pitch without being subjected to time-axis stretch/compression control; that is, the total reproducing time of the output waveform 412 can be reduced by a factor of 2.

Note that the readout example 412 and following readout examples 413 to 416 are arranged in such a manner that the data division following the one read out and faded in as the second cross-fading waveform region data in one reproduction period is read out and faded out as the first cross-fading waveform region data in the next reproduction period. For example, data division B is read out and faded in as the second cross-fading waveform region data in the first reproduction period of the readout example 412, and then the following data division C is read out and faded out as the first cross-fading waveform region data in the second reproduction period. With this arrangement, a smooth waveform interconnection is achieved from data division B to data division C.

Block 413 shows the example where the waveform data are processed with the time-axis stretch/compression ratio CRate of 1.5 (CRate=1.5). As shown, in the first reproduction period, the normal (N) process is executed where data division A is read out as the first and second second cross-fading waveform region data and these read-out cross-fading waveform region data are subjected to cross-fade synthesis to provide an output waveform. In the second reproduction period, the compression (C) process is executed where data division B is read out as the first cross-fading waveform region data and data division C is read out as the second cross-fading waveform region data, so that these read-out cross-fading waveform region data represented by the data divisions B and C are subjected to cross-fade synthesis to provide an output waveform. Further, the normal (N) process is executed in the third reproduction period using data division D, followed by the compression (C) process in the fourth reproduction period using data divisions E and F. This way, a total reproducing time of the resultant output waveform 413 when read out at a desired pitch can be just about 1/CRate (i.e., about 1/1.5 or ⅔) of a total reproducing time that would be required when the original stored waveform 411 is read out at the same pitch without being subjected to time-axis stretch/compression control; that is, the total reproducing time of the output waveform 413 can be reduced by a factor of 1.5.

Block 414 shows the example where the waveform data are processed with the time-axis stretch/compression ratio CRate of 1.0 (CRate=1). As shown, in the first to six reproduction periods, the normal (N) process is executed using data divisions A, B, C, D, E and F, respectively. In this way, a total reproducing time of the resultant output waveform 414 when read out at a desired pitch can be just 1/CRate (1/1) of, i.e., the same as, a total reproducing time required when the original stored waveform 411 is read out at the same pitch without being subjected to time-axis stretch/compression control. The process result obtained with the time-axis stretch/compression ratio CRate of 1 in the above-mentioned manner may be generally the same as in the case where no particular stretch/compression is conducted. By thus conducting the cross-fade synthesis using the same data division as the first and second cross-fading waveform region data even when the time-axis stretch/compression ratio CRate, the system can be arranged to always execute the cross-fade synthesis. Such an arrangement eliminates the need to determine for each of the reproduction periods.

Block 415 shows the example where the waveform data are processed with the time-axis stretch/compression ratio CRate of 0.75. As shown, in the first, second, fourth, fifth, sixth and eighth reproduction periods, the normal (N) process is executed using data divisions A, B, C, D, E and F, respectively. In the third reproduction period, the stretch (S) process is executed where data division C is read out as the first cross-fading waveform region data and data division B is read out as the second cross-fading waveform region data, so that these read-out cross-fading waveform region data represented by data divisions C and B are subjected to cross-fade synthesis to provide an output waveform. In the seventh reproduction period, the stretch (S) process is executed where data division F is read out as the first cross-fading waveform region data an data division E is read out as the second cross-fading waveform region data, so that these read-out cross-fading waveform region data represented by the data divisions F and E are subjected to cross-fade synthesis to provide an output waveform. In this way, a total reproducing time of the resultant output waveform 415 when read out at a desired pitch can be just about 1/CRate (i.e., about 1/0.75) of a total reproducing time that would be required when the original stored waveform 411 is read out at the same pitch without being subjected to time-axis stretch/compression control; that is, the total reproducing time of the output waveform 415 can be increased by a factor of 1.333.

Block 416 shows the example where the waveform data are processed with the time-axis stretch/compression ratio CRate of 0.5. As shown, in the first, third, fifth, seventh, ninth and eleventh reproduction periods, the normal (N) process is executed using data divisions A, B, C, D, E and F, respectively. In the second, fourth, sixth, eighth, tenth and twelfth reproduction periods, the stretch (S) process is executed using combinations of data divisions B and A, data divisions C and B, data divisions D and C, data divisions E and D, data divisions F and E, and data divisions G and F, respectively. In this way, a total reproducing time of the resultant output waveform 416 when read out at a desired pitch can be just about 1/CRate (i.e., about 1/0.5) of a total reproducing time that would be required when the original stored waveform 411 is read out at the same pitch without being subjected to time-axis stretch/compression control; that is, the total reproducing time of the output waveform 416 can be increased by a factor of 2.

Figure 32:
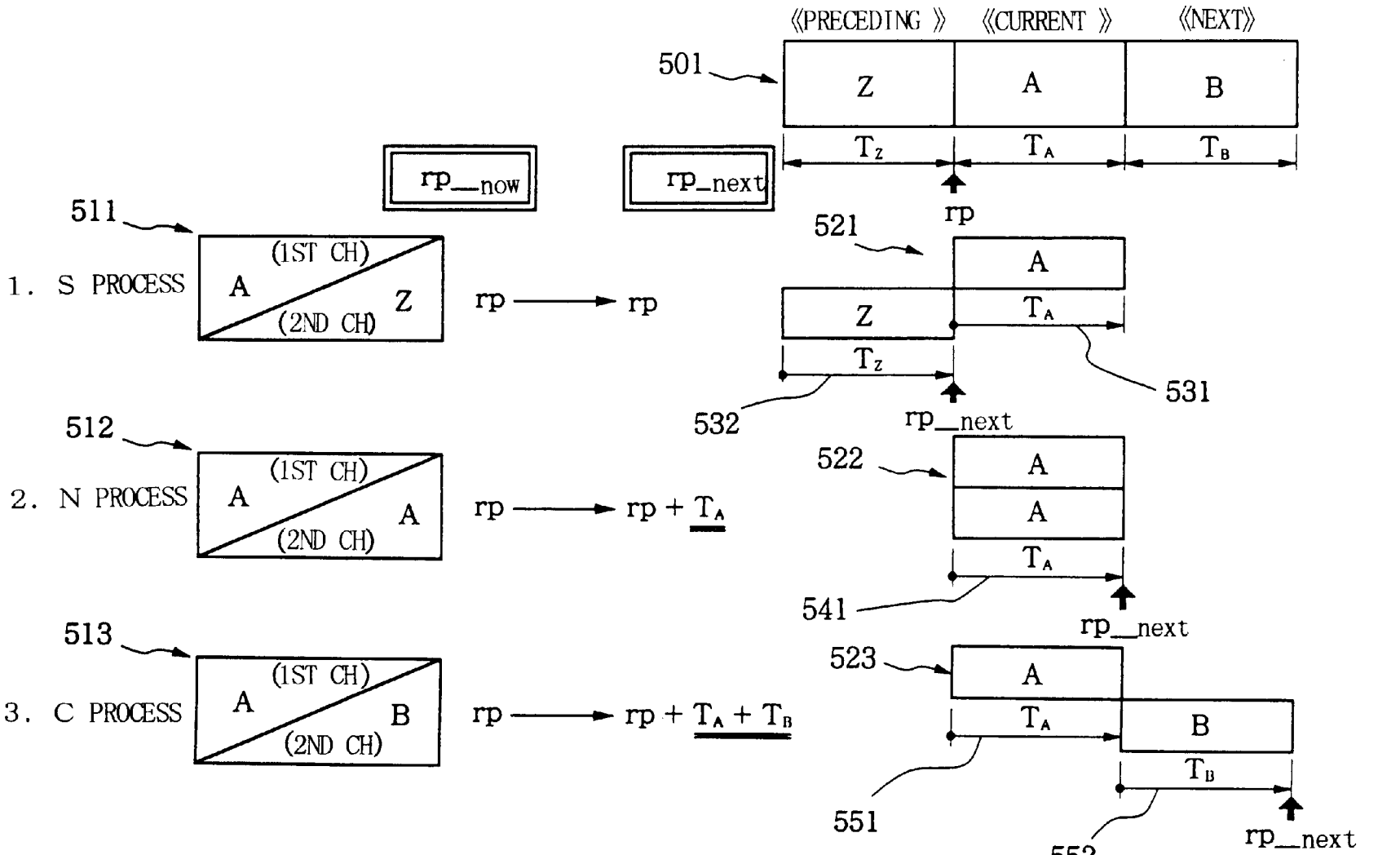
FIG. 32 is a diagram showing a manner in which cross-fade synthesis is carried out between waveform data regions read out in first and second cross-fading channels according to the TSC control of FIG. 30.

FIG. 32 is a diagram showing details of the process performed in each of the reproduction periods, where reference numeral 501 represents a succession of three data divisions Z, A an B stored in the waveform memory 301 and $T_Z$, $T_A$ and $T_B$ represent respective sizes of the three data divisions Z, A an B. Let's assume here that data division A is read out as the first cross-fading waveform region data. In this case, the data division to be read out as the second cross-fading waveform region data differs depending on which of the stretch (S), normal (N) and compression (C) processes is to be performed.

Reference numeral 511 shows an example where the stretch (S) process is carried out in a single reproduction period. As shown in the example 511, if data division A is read out as the first cross-fading waveform region data in this process, data division Z preceding data division A is read out as the second cross-fading waveform region data. Namely, as shown in block 521, data division A is read out as the first cross-fading waveform region data as indicated at 531 and data division Z is read out as the second cross-fading waveform region data as indicated at 532, so that the two waveform regions represented by data divisions A and Z are subjected to cross-fade synthesis. Reference numeral 512 shows another example where the normal (N) process is carried out in a single reproduction period without changing the reproducing time length. As shown in the example 512, if data division A is read out as the first cross-fading waveform region data in this process, same data division A is read out as the second cross-fading waveform region data. Namely, as shown in block 522, data division A is read out as the first and second cross-fading waveform region data as denoted at 541, so that the two waveform regions represented by same data division A are subjected to cross-fade synthesis. Reference numeral 513 shows another example where the compression (C) process is carried out in a single reproduction period. As shown in the example 513, if data division A is read out as the first cross-fading waveform region data in this process, data division B following data division A is read out as the second cross-fading waveform region data. Namely, as shown in block 523, data division A is read out as the first cross-fading waveform region data as indicated at 551 and data division B is read out as the second cross-fading waveform region data as indicated at 552, so that the two waveform regions represented by data divisions A and B are subjected to cross-fade synthesis.

For the above-mentioned two cross-fading waveform region data, the waveform data readout is executed using addresses calculated by sequentially accumulating, on the basis of a predetermined sampling frequency, the pitch information (F number) designated by a parameter. Thus, the pitch of the resultant output waveform can exactly agree with the designated pitch. On the other hand, the reproducing time length can be stretched or compressed as illustratively shown in the examples 412 to 416 of FIG. 31, by selectively carrying out any one of the stretch, normal and compression processes every reproduction period, as outlined earlier in relation to FIGS. 29 and 31.

Figure 34:
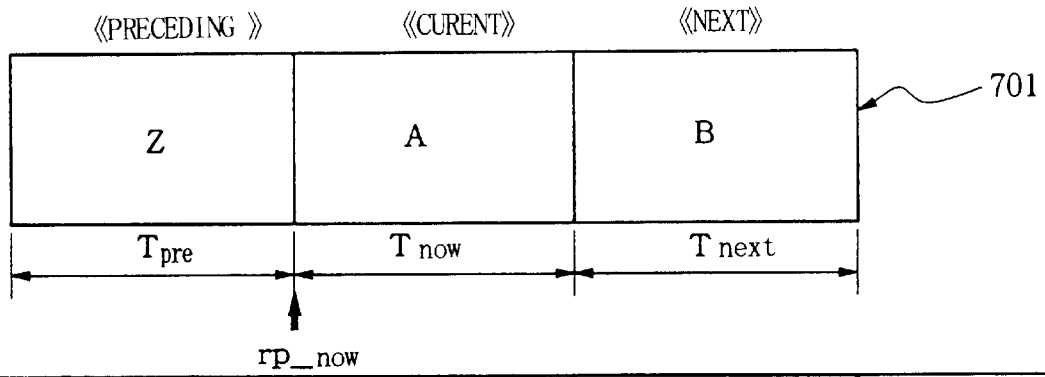
FIG. 34 is a diagram showing a sum-up of respective contents of stretch (S), normal (N) and compression (C) processes carried out by an address calculator of FIG. 30.

In FIG. 32, reference character rp represents a read pointer that points to a start address of data division to be read out as the first cross-fading waveform region data, as will be detailed in relation to FIG. 34. Reference character $rp_{now}$ represents a current value of the read pointer rp in the current reproduction period, and reference character $rp_{next}$ represents a value of the read pointer rp in the next reproduction period. Here, upon reaching the end point in each of the reproduction periods, the address for second cross-fading waveform region data becomes the start address of a particular data division that is to be read out as the first cross-fading waveform region data in the next reproduction period. This is to permit a shift from the current data division to the next data division in a predetermined order at the boundary between adjacent reproduction periods. As typically seen from reference to the boundaries between the reproduction periods in the examples 412 to 416, a shift from the current data division to the next data division, like A→B, B→C, . . . , at each boundary between the reproduction periods. As shown in FIG. 32, a value of the read pointer RP in the next reproduction period can be identified from that in the current reproduction period. Namely, in the case of the stretch (S) process, a current value of the read pointer rp becomes a value of the read pointer $rp_{ner}$; in the case of the normal (N) process, a sum of a current value of the read pointer rp and size $T_A$ (i.e., $rp+T_A$) becomes a value of the read pointer $rp_{next}$; or in the case of the compression (C) process, a sum of a current value of the read pointer rp and size $T_A$ and sizes $T_A$ and $T_B$ (i.e., $rp+T_A+T_B$) becomes a value of the read pointer $rp_{next}$.

Figure 33:
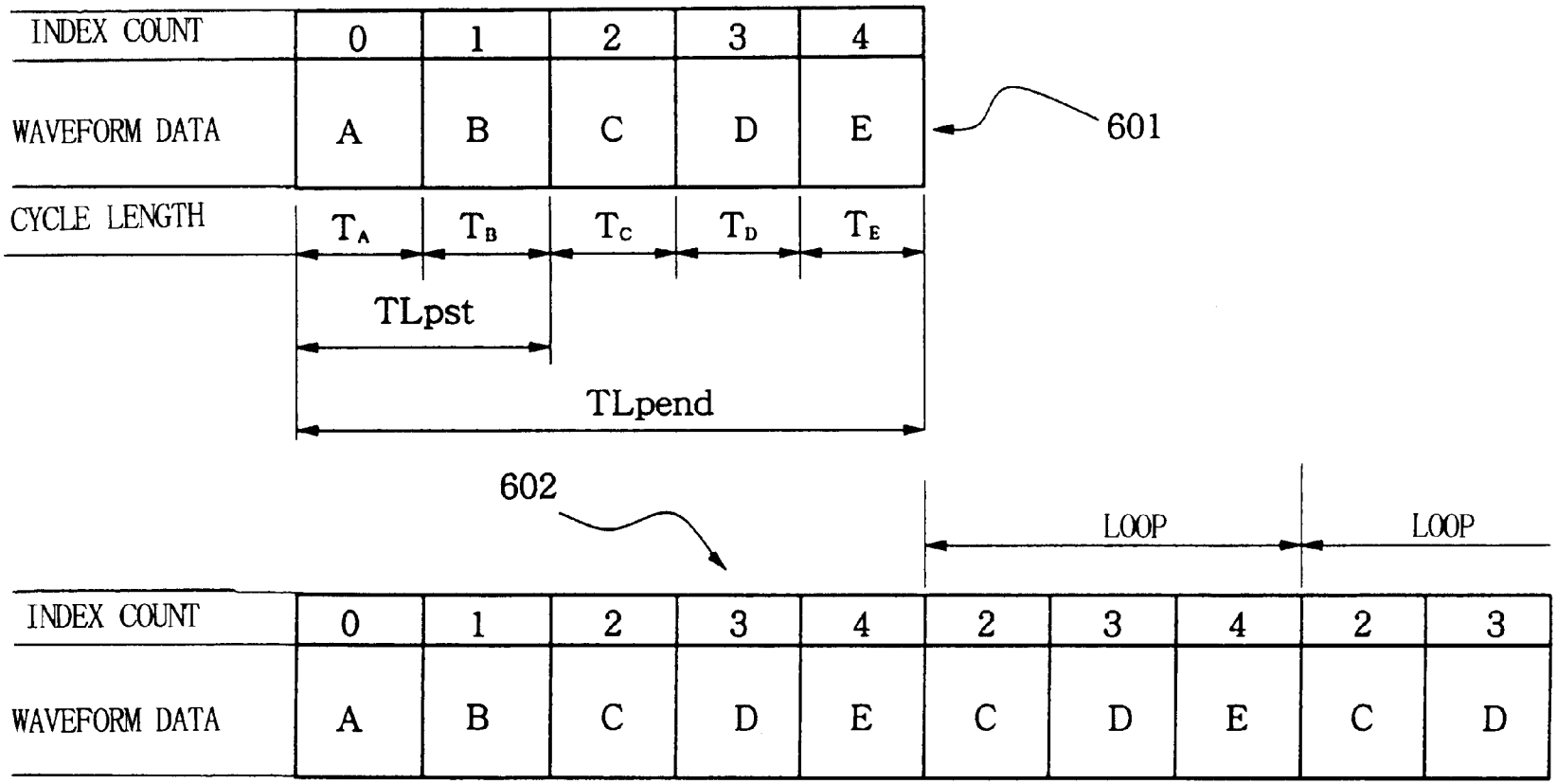
FIG. 33 is a diagram showing exemplary manners in which waveform data including attack and loop portions are stored and read out according to the TSC control of FIG. 30.

FIG. 33 is a diagram showing examples of waveform data including attack and loop portions. The waveform data 601 consist of five data divisions A to E. Index Count represents positions (order) of the individual data divisions in the waveform memory, and Cycle Length represents respective sizes $T_A$ to $T_E$ of the individual data divisions. Let's assume that the boundary between the attack and loop portions coincides with a boundary between the data divisions. In the waveform data 601, a portion occurring from the waveform start point to point TLpst, i.e., data divisions A and B, represents the attack portion, and point TLpst corresponds to a start point of the loop portion. The loop portion occurs up to point TLpend and consists of data divisions C, D and E.

The waveform data including such attack and loop portions are treated as being arranged in a same manner as waveform data 602; that is, the overall data are first read out up to the end point of the loop portion and then the loop portion is read out from the start to end thereof in a repeated manner.

Because the basic processing-time unit of the process is a reproduction period, it is necessary to positionally limit or properly set the locations of the start and end points of the loop portion. Namely, the respective locations of the start and end points of the loop portion must be set such that an interpolated sample value of the loop end point (last address of data division E) coincides with that of the loop start point (first address of data division C).

Now, with reference to FIG. 30, a detailed description will be made below about the construction and operation of the waveform memory reader unit 201.

In FIG. 30, the waveform memory reader unit 201 comprises the waveform memory 301, address calculator 302, in-cycle counter 303, index counter 304, data division size registers 305 and 306, accumulated difference register 307, readout ("rp") register 308, pitch interpolating sections 309 and 310, multipliers 311 and 312, compensating section 313 and adder 314. The respective detailed constructions of the above-mentioned components are as follows.

As noted earlier, the waveform memory 301 has prestored therein a plurality of sets of plural-cycle waveform data, in corresponding relations to a plurality of tones, with each of the waveform data sets divided into a plurality of data divisions for management purposes. In the waveform memory 301, there are also prestored respective sizes T of the individual data divisions for each of the waveform data sets. The waveform data in a selected one of the sets are read out in two independent data groups (i.e., as the first and second cross-fading waveform region data) in accordance with addresses generated from the address calculator 302. The data division size information T (consisting of integer and decimal fraction parts) is read out using, as an address, index count IC from the index counter 304.

The index count IC held by the index counter 304 is an ordinal number indicative of a unique division number of the data division being currently read out as the first cross-fading waveform region data; that is, the index count IC indicates which of the data divisions is being currently read out as the first cross-fading waveform region data. Using this index count IC as the read address (relative address), the size information T of the data division currently read out as the first cross-fading waveform region data is read out, and the read-out size information T is stored into "T1" register 305. The "T1" register 305 is provided for storing the size information T of each data division read out as the first cross-fading waveform region data. Simultaneously, the size information T of the data division being currently read out as the second cross-fading waveform region data in the second cross-fading channel is stored into "T2" register 306. On the basis of the index count IC indicating the division number of the data division being read out as the first cross-fading waveform region data and determination of which of the stretch (S), normal (N) and compression (C) processes is being currently carried out, it may be known that the size information to be stored in the "T2" register 306 is that of the one preceding the current data division as the first cross-fading waveform region data, or the current data division as the first cross-fading waveform region data, or the one following the current data division as the first cross-fading waveform region data. The reason why the index count IC is used as a relative address is to deal with the case where a plurality of sets of the plural-cycle waveform data are stored. Namely, if such relative addresses are used, by changing the base address, it is possible to select one of a plurality of data division size data corresponding to particular waveform data to be read out and identify the size data on the basis of the index count IC.

The address calculator 302 initializes the value of the index counter 304 to "0" when generation of a waveform is to be initiated. Then, upon termination of each of the reproduction periods, the address calculator 302 outputs a trigger signal (data-division updating information), in response to which the value of the index counter 304 is incremented. More specifically, if the stretch (S) process was executed in the just-terminated reproduction period, then the same data division as having been read out in the just-terminated reproduction period as the first cross-fading waveform region data is to be read out as the first cross-fading waveform region data in the next reproduction period, and thus the value of the index counter 304 remains unchanged. If the normal (N) process was executed in the just-terminated reproduction period, then the data division following the data division read out in the just-terminated reproduction period as the first cross-fading waveform region data is to be read out as the first cross-fading waveform region data in the next reproduction period, and thus the value of the index counter 304 is incremented by one. Further, if the compression (C) process was executed in the just-terminated reproduction period, then the second data division forward from the data division read out in the just-terminated reproduction period in the first cross-fading channel is to be read out in the first cross-fading channel in the next reproduction period, and thus the value of the index counter 304 is incremented by two.

As briefly described earlier in relation to FIG. 32, the readout ("rp") register 308 holds the start address rp of the data division being read out as the first cross-fading waveform region data (namely, in the first cross-fading channel).

The in-cycle counter 303 accumulates reproduction pitch information Δph (F number) every sampling cycle of the waveform data generated by the waveform generating section 111. The in-cycle counter 303 generates phase data CC(i.e., cycle counts each including integer and decimal fraction parts) for reading out individual waveform sample values of the data division designated by the readout register 308. Each cycle count CC generated by the in-cycle counter 303 is fed to the address calculator 302, which uses the start address rp and cycle count CC to calculates read addresses for first and second cross-fading waveform data regions and feeds the calculated read addresses to the waveform memory 301; more specifically, (rp+CC) becomes the read address for first cross-fading waveform data region and (rp+CC+OFST) becomes the read address for second cross-fading waveform data region. Here, if the stretch (S) process is executed in the current reproduction period, it means that the data division that precedes the data division being currently read out in the first cross-fading channel is to be read out in the second cross-fading channel, and thus "OFST"=−"size of the data division preceding the data division currently read out in the first cross-fading channel" (this value is now set in the "T2" register 306). If the normal (N) process is executed in the current reproduction period, it means that the same data division as being currently read out as the first cross-fading waveform data region is to be also read out in the second cross-fading channel, and thus "OFST"=0. Further, if the compression (C) process is executed in the current reproduction period, it means that the data division that follows the data division being currently read out in the first cross-fading channel is to be read out in the second cross-fading channel, and thus "OFST"="size of the data division being currently read out in the first cross-fading channel" (this value is now set in the "T1" register 305).

The address calculator 302 constantly compares cycle count CC and cycle length CL for a condition of CC>CL.

Here, the cycle length CL is: the size of the data division that precedes the data division being currently read out in the first cross-fading channel if the stretch (S) process is executed in the current reproduction period; the size of the data division being currently read out in the first cross-fading channel if the normal (N) process is executed in the current reproduction period; or the size of the data division that follows the data division being currently read out in the first cross-fading channel if the compression (C) process is executed in the current reproduction period. In other words, the cycle length CL represents the size of the data division being currently read out in the second cross-fading channel, and the end of the current reproduction period can be identified on the basis of the data division size represented by the cycle length CL; that is, the point when the cycle count CC has exceeded the cycle length CL represents the end of the current reproduction period. Upon termination of the current reproduction period, the address calculator 302 outputs a trigger signal (data-division updating information), in response to which the value of the index counter 304 is incremented, as noted earlier. Namely, once the accumulated value of the cycle count CC has exceeded the size T of the data division being read out in the second cross-fading channel, it is restored to an initial value (CC−T), and simultaneously the address calculator 302 generates the trigger signal.

For each of the read address in the first cross-fading channel (rp+CC) and read address in the second cross-fading channel (rp+CC+OFST), interpolation between samples has to be effected, on the basis of the decimal fraction part of the read address, in order to achieve a precise tone pitch with operation asynchronous with the pitch (namely, with a fixed sampling frequency). To this end, the waveform memory reader unit of FIG. 30 includes pitch an interpolator 309, 310, similar to the interpolating circuits 11 and 12 of FIG. 2, for each of the cross-fading channels, so that linear interpolation is carried out in the first and second cross-fading channels in accordance with different integer parts, independently of each other.

The multipliers 311 and 312, compensating section 313 and adder 314 together constitute cross-fade synthesis circuitry. In each of the reproduction periods, this cross-fade synthesis circuitry carries out a cross-fade transfer from waveform data read out in the first cross-fading channel (i.e., a first cross-fading waveform data region) to waveform data read out in the second cross-fading channel (i.e., a second cross-fading waveform data region), irrespective of which of the stretch, normal and compression processes is carried out in the reproduction period. The address calculator 302 generates a weighting coefficient (cycle count CC÷cycle length CL) for the second cross-fading channel, and the compensating section 313 generates a complement of the weighting coefficient (i.e., 1−CC÷CL). The cross-fade synthesis is carried out within a period determined by the size T2 of the data division read out in the second cross-fading channel.

The difference ("dif") register 307 is provided for storing an accumulated difference between ideal location (virtual read address) and actual location (actual read address). Here, the ideal location corresponds to a read pointer value when stretch/compression of the reproducing time is assumed to have been executed in accordance with time-axis stretch/compression ratio information CRate. The total increment of the ideal location or virtual read address in a given reproduction period when that period has been terminated is equivalent to a value obtained by multiplying the size T2 of the data division read out in the second cross-fading channel by the time-axis stretch/compression ratio information CRate (i.e., T2×CRate). On the other hand, the total increment of the actual read address (i.e., the total increment of the "rp" register) in a given reproduction period when that period has been terminated is: "0" if the stretch (S) process was executed in the reproduction period; "T1" if the normal (N) process was executed in the reproduction period; or "T1+T2" if the compression (C) process was executed in the reproduction period. This total increment of the actual read address is equivalent to a difference between the read address in the second cross-fading channel and the value of the read pointer rp at the end point of the reproduction period, because the read address in the second cross-fading channel becomes a value of the read pointer rp of the next reproduction period. If the difference between the total increment of the ideal location or virtual read address and the total increment of the actual read address in the reproduction period is represented by Δdif, the difference Δdif is calculated by the address calculator 302 in a manner differing, as follows, depending on which of the stretch (S), normal (N) and compression (C) processes is the just-completed process:

if the just-completed process is the stretch (S) process, Δdif=(T2×CRate);

if the just-completed process is the normal (N) process, Δdif=(T2×CRate)−T1; or if the just-completed process is the compression (C) process, Δdif=(T2×CRate)−(T1+T2).

The address calculator 302 adds the thus-calculated difference Δdif to a current accumulated difference (dif) to thereby determine an accumulated difference (dif) at the end point of the just-terminated reproduction period (i.e., at the start point of the next reproduction period).

Further, on the basis of the determined accumulated difference (dif) at the end point of the reproduction period, the address calculator 302 determines which of the stretch (S), normal (N) and compression (C) processes is to be carried out. More specifically, this determination is made on the basis of the following conditions (1) and (2). For this determination based on the accumulated difference (dif), the size of the data division to be read out in the first cross-fading channel in the next reproduction period is read into the "T1" register in advance, and the "T2" register maintains its value stored in the just-terminated reproduction period.

Condition (1): if dif≧0 (where "dif" is a positive value), compare "T1" (size of the data division to be read out in the first-fading channel in the next reproduction period) and "dif", and then (1-1) if |dif|/T1≧0.5 (i.e., if the accumulated difference dif is greater than one half of the data division size T1), the address calculator 302 determines that the compression (C) process is to be carried out, or (1-2) if not (i.e., if the accumulated difference dif is not greater than one half of the data division size T1), the address calculator 302 determines that the normal (N) process is to be carried out.

Condition (2): if dif<0 (where "dif" is a negative value), compare "T2" (size of the data division having been read out in the second-fading channel in the just-terminated reproduction period) and "dif", and then (2-1) if |dif|/T2≧0.5 (i.e., if the accumulated difference dif is greater than one half of the data division size T2), the address calculator 302 determines that the stretch (S) process is to be carried out, or (2-2) if not (i.e., if the accumulated difference dif is not greater than one half of the data division size T2), the address calculator 302 determines that the normal (N) process is to be carried out.

Condition (1) above is for executing the compression process when a deviation amount of the actual read location behind the ideal read location for a desired reproducing time is greater than one half of the data division size T1. Condition (2) above is for executing the stretch process when a deviation amount of the actual read location ahead of the ideal read location for a desired reproducing time is greater than one half of the data division size T2.

FIG. 34 shows in table 702 a sum-up of the respective contents of the above-mentioned stretch (S), normal (N) and compression (C) processes carried out by the address calculator 302, with block 701 showing a succession of data divisions Z, A and B stored in the waveform memory. Here, let's assume that data division A is being currently read out in the first cross-fading channel (namely, as the first cross-fading waveform data region) and respective sizes of data divisions Z, A and B are $T_{pre}$, $T_{now}$ and $T_{next}$. In this case, a data division to be read out in the second cross-fading channel (namely, as the second cross-fading waveform data region) is: data division Z if the stretch (S) process is being executed in the current reproduction period; data division A if the normal (N) process is being executed in the current reproduction period; or data division B if the compression (C) process is being executed in the current reproduction period. Reference character "$rp_{_now}$" represents a value of the "rp" register in the current reproduction period Cycle length CL applied in the current reproduction period is shown in column "APPLIED CYCLE LENGTH", and OFST applied to the second cross-fading channel in the current reproduction is shown in column "OFST OF 2ND CHANNEL". One of the data divisions having a start address (rp) is read out in the first cross-fading channel, and another one of the data divisions having a start address (rp+OFST) is read out in the second cross-fading channel. Column "UPDATE OF rp" shows that upon completion of the process in the current reproduction period, the value of "rp" is updated a read address to proceed with readout of the data division in the second cross-fading channel and then to the start address of the data division to be read out in the first cross-fading channel in the next reproduction period. Column "UPDATE OF dif" shows a value of the accumulated difference dif when the process in the current reproduction period has been completed. This "dif" value is used by the address calculator 302 in determining which of the stretch (S), normal (N) and compression (C) processes is to be carried out in the next reproduction period. Further, column "UPDATE OF INDEX COUNTER" shows that the index counter is updated to the unique number of the data division, following the one to be read out in the second cross-fading channel, which is to be read out in the first cross-fading data division in the next reproduction period. The applied cycle length CL is set to the value of the size information T2 of the data division being read out in the second cross-fading channel, and cross-fade synthesis is carried out in the reproduction period over a period represented by the cycle length CL.

Figure 35:
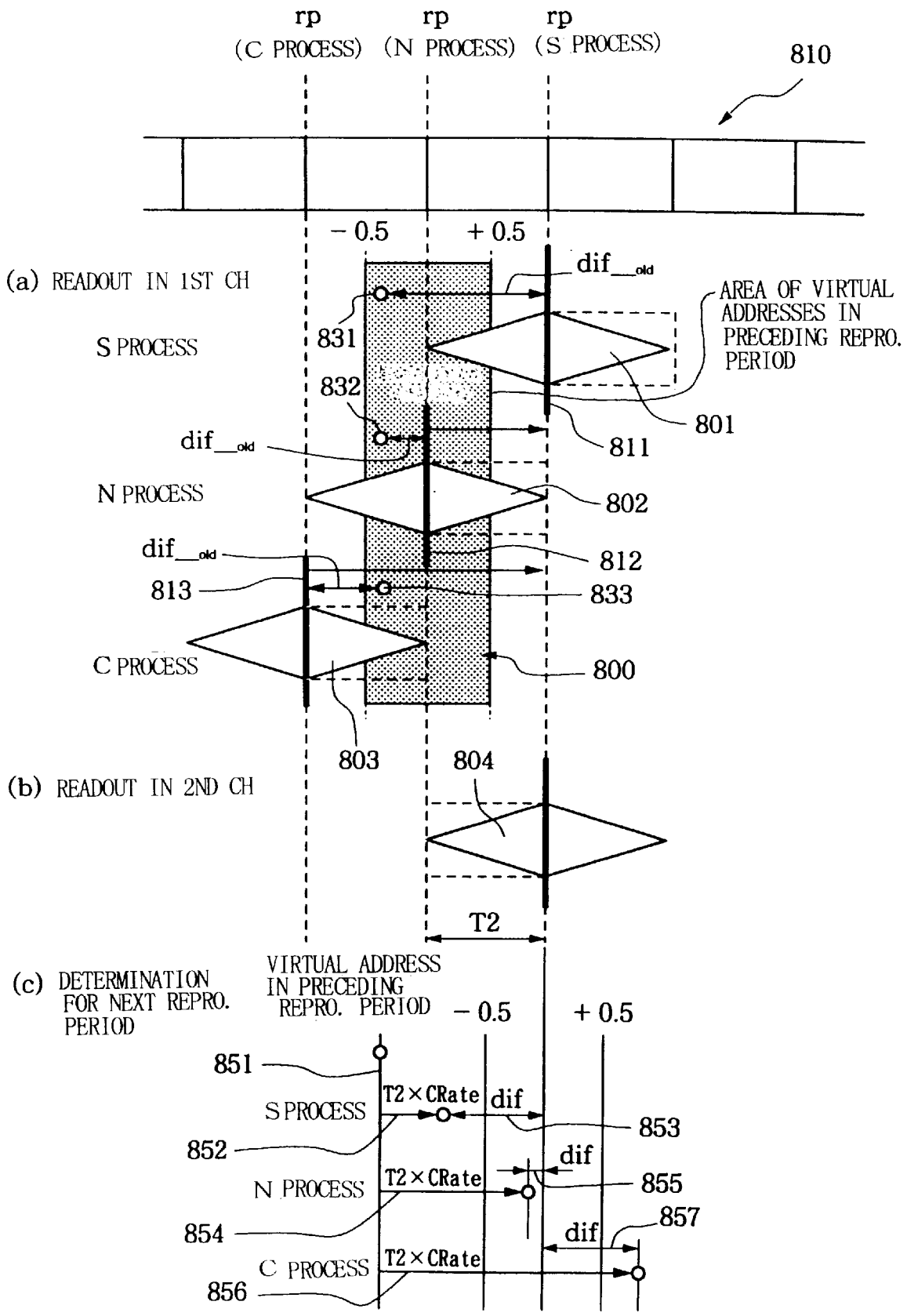
FIG. 35 is a diagram explanatory of a manner in which the address calculator determines which of the stretch (S), normal (N) and compression (C) processes is to be carried out.

FIG. 35 is a diagram explanatory of a manner in which the address calculator 302 determines which of the stretch (S), normal (N) and compression (C) processes is to be carried out. A succession of rectangular blocks at 801 represents a succession of data divisions, with the horizontal axis in FIG. 35 representing read address rather than time. In section (a) of FIG. 35 is shown an example of waveform data readout in the first cross-fading channel, and in section (b) is shown an example of waveform data readout in the second cross-fading channel.

In subsection "stretch (S) process", reference numeral 831 represents a last location pointed to by the ideal pointer (virtual read address) and 811 represents a location pointed to by the actual pointer ("rp" register). In this case, because the accumulated difference dif is $dif_{_old}$ as denoted at 821, the above-mentioned condition (2-1) is satisfied, so that the address calculator 302 determines that the stretch (S) process is to be carried out. In this stretch (S) process, waveform data are read out in the first cross-fading channel in a manner as shown by a triangle 801 representing a fading-out waveform ((a) of FIG. 35), while waveform data are read out in the second cross-fading channel in a manner as shown by an oppositely-oriented triangle 804 representing a fading-in waveform ((b) of FIG. 35).

In subsection "normal (N) process", reference numeral 832 represents a last location pointed to by the ideal pointer and 812 represents a location pointed to by the actual pointer. In this case, because the accumulated difference dif is $dif_{_old}$ as denoted at 822, the above-mentioned condition (2-2) is satisfied, so that the address calculator 302 determines that the normal (N) process is to be carried out. In this normal (N) process, waveform data are read out in the first cross-fading channel in a manner as shown by a triangle 802 representing a fading-out waveform ((a) of FIG. 35), while waveform data are read out in the second cross-fading channel in a manner as shown by an oppositely-oriented triangle 804 representing a fading-in waveform ((b) of FIG. 35. 35).

In subsection "compression (C) process", reference numeral 833 represents a last value of the ideal pointer and 813 represents a location pointed to by the actual pointer. In this case, because the accumulated difference dif is $dif_{_old}$ as denoted at 823, the above-mentioned condition (1-1) is satisfied, so that the address calculator 302 determines that the compression (C) process is to be carried out. In this compression (C) process, waveform data are read out in the first cross-fading channel in a manner as shown by a triangle 803 representing a fading-out waveform ((a) of FIG. 35), while waveform data are read out in the second cross-fading channel in a manner as shown by an oppositely-oriented triangle 804 representing a fading-in waveform ((b) of FIG. 35).

Further, in section (c) of FIG. 35, there are shown other examples of determination for waveform readout in the next reproduction period. If the virtual read address has advanced from a location pointed to by the ideal pointer 851 in the last or preceding reproduction period by an amount denoted by 852, then the accumulated difference dif becomes as denoted at 823, the above-mentioned condition (2-1) is satisfied, so that the address calculator 302 determines that the stretch (S) process is to be carried out. If the virtual read address has advanced from the ideal pointer location 851 in the preceding reproduction period by an amount denoted by 854, then the accumulated difference dif becomes as denoted at 855, the above-mentioned condition (2-2) is satisfied, so that the address calculator 302 determines that the normal (N) process is to be carried out. Further, if the virtual read address has advanced from the ideal pointer location 851 in the preceding reproduction period by an amount denoted by 856, then the accumulated difference dif becomes as denoted at 857, the above-mentioned condition (1-1) is satisfied, so that the address calculator 302 determines that the compression (C) process is to be carried out.

Figure 36:
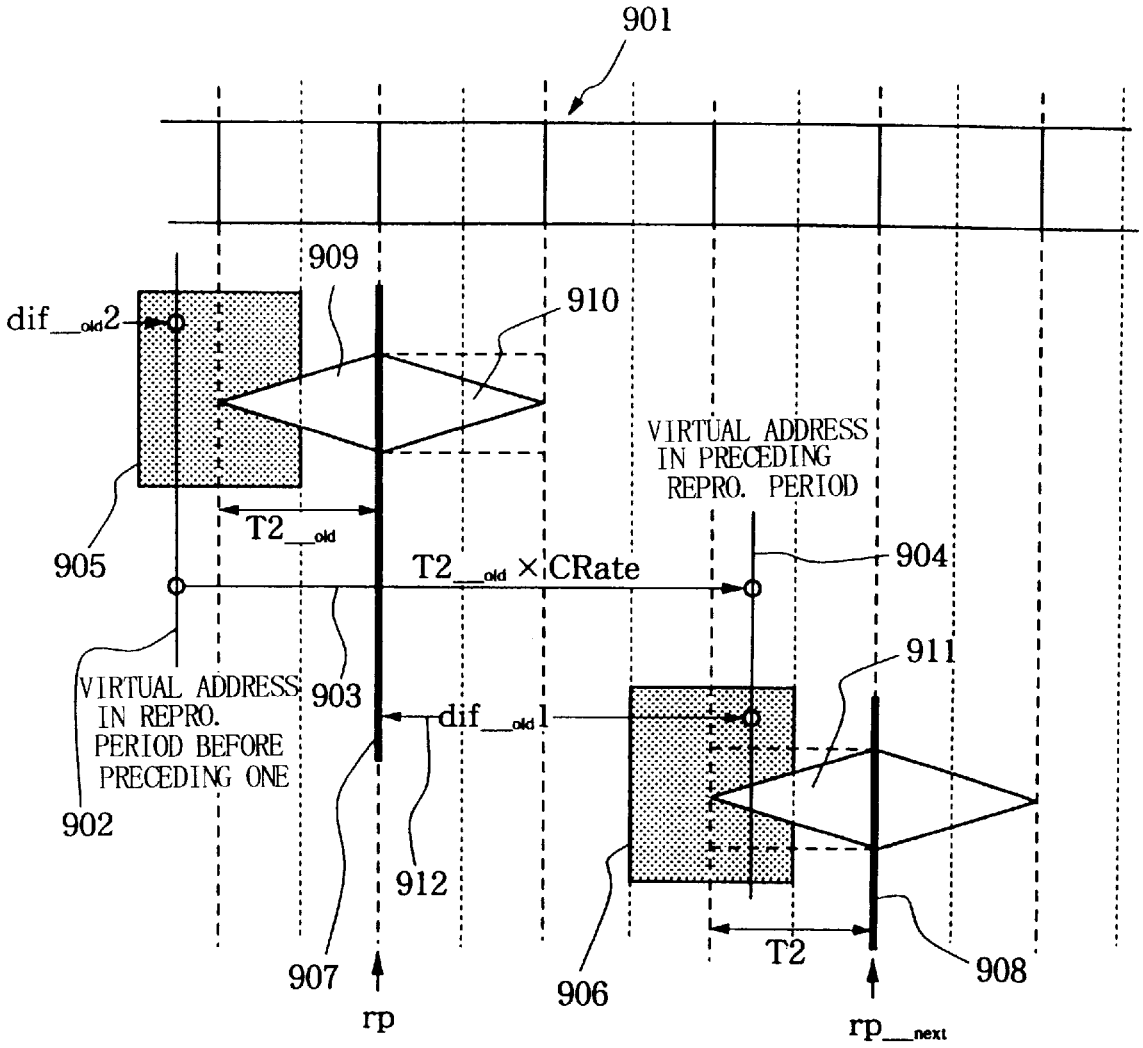
FIG. 36 is a diagram explanatory of the control of FIG. 35 in a more generalized manner, showing a manner in which the actual address is allowed to move back or jump forward by two periods.

In relation to FIG. 35, the address calculator 302 has been described as selecting one of the stretch (S) process for allowing the actual read address to be moved back by one period of the waveform, the normal (N) process for allowing the actual read address to advance in the normal manner, and the compression (C) process for allowing the actual read address to jump by one period. In an alternative, the actual address may be allowed to move back or jump by two or more periods. FIG. 36 shows an example where the actual address is allowed to move back or jump by two periods.

More specifically, in FIG. 36, a location pointed to by the ideal pointer determines a data division to be read out in the second cross-fading channel in the next reproduction period; that is, one of the data divisions which has its start point closest to the ideal pointer location is selected as the data division to be read out in the second cross-fading channel in the next reproduction period.

Assuming that the ideal pointer (virtual read address) in the reproduction period before the preceding one was at location 902 within area 905, a fading-in waveform region 906 was read out in the second cross-fading channel in the preceding reproduction period. Thus, "rp" is at location 907 in the current reproduction period, and a fading-out waveform region 910 is read out in the first cross-fading channel in the current reproduction period.

In the preceding reproduction period, the ideal pointer has advanced over an amount "$T2_{_old}$×CRate" up to location 904. At that time, the accumulated difference dif is $dif_{_old}$1 as denoted at 912 and the ideal pointer is within area 906, so that a fading-in waveform region 911 is read out in the second cross-fading channel in the current reproduction period.

This way, in the current reproduction period, cross-fade synthesis is effected between the waveform region 910 read out in the first cross-fading channel and the waveform region 911 read out in the second cross-fading channel, so that the read pointer rp is allowed to jump over two periods to "$rp_{_next}$" location as denoted at 908.

The advancing amount (increment) of the virtual address in each of the reproduction periods may be made greater or smaller than the example of FIG. 36, by varying the value of time-axis stretch/compression ratio CRate. According to the illustrated example, the data division to be read out in the second cross-fading channel in each of the reproduction periods may be allowed to freely Jump in the forward or backward direction.

Figure 37:
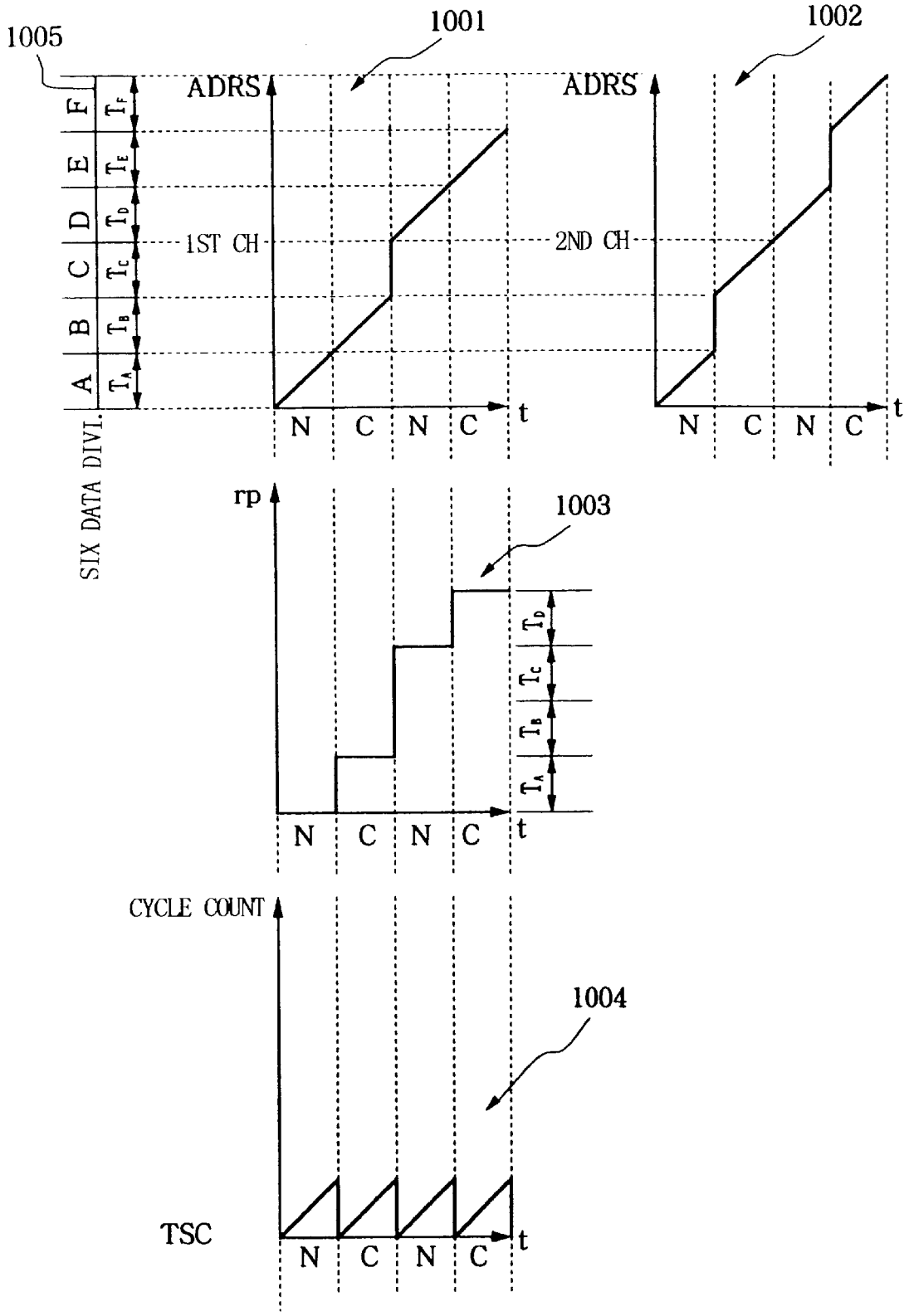
FIG. 37 is a diagram showing a detailed example of the TSC control of FIG. 30 when time-axis stretch/compression ratio CRate is 1.5.

FIG. 37 is a diagram showing an example of control when time-axis stretch/compression ratio CRate is 1.5 (as in the readout example 413 of FIG. 31). Reference numeral 1001 represents a manner in which the read address advances in the first cross-fading channel. The horizontal axis represents time in which the normal (N) and compression (C) processes are repeated in this order, one process per reproduction period. The vertical axis represents address (ADRS), and line 1005 representative of waveform data is drawn along the vertical axis to indicate an approximate location in data divisions A to F to be pointed to. Reference numeral 1002 represents a manner in which the read address advances in the second cross-fading channel. Reference numeral 1003 represents a variation in value of the read pointer rp, reference numeral 1004 represents a variation in value of the cycle count CC, which varies in such a manner to cumulatively increase every reproduction period. The read pointer rp advances to sequentially point to data divisions A, B, D and E, as previously noted. Address is generated in the first cross-fading channel in the manner shown at 1001 by adding the value of the read pointer rp and the cycle count CC. Address generated in the second cross-fading channel advances in the manner shown at 1002 to sequentially point to data divisions A, C, D and F. Two waveform regions read out using such addresses are subjected to cross-fade synthesis, and thus a tone waveform is reproduced at a designated pitch for a reproducing tome corresponding to four reproduction periods.

Figure 38:
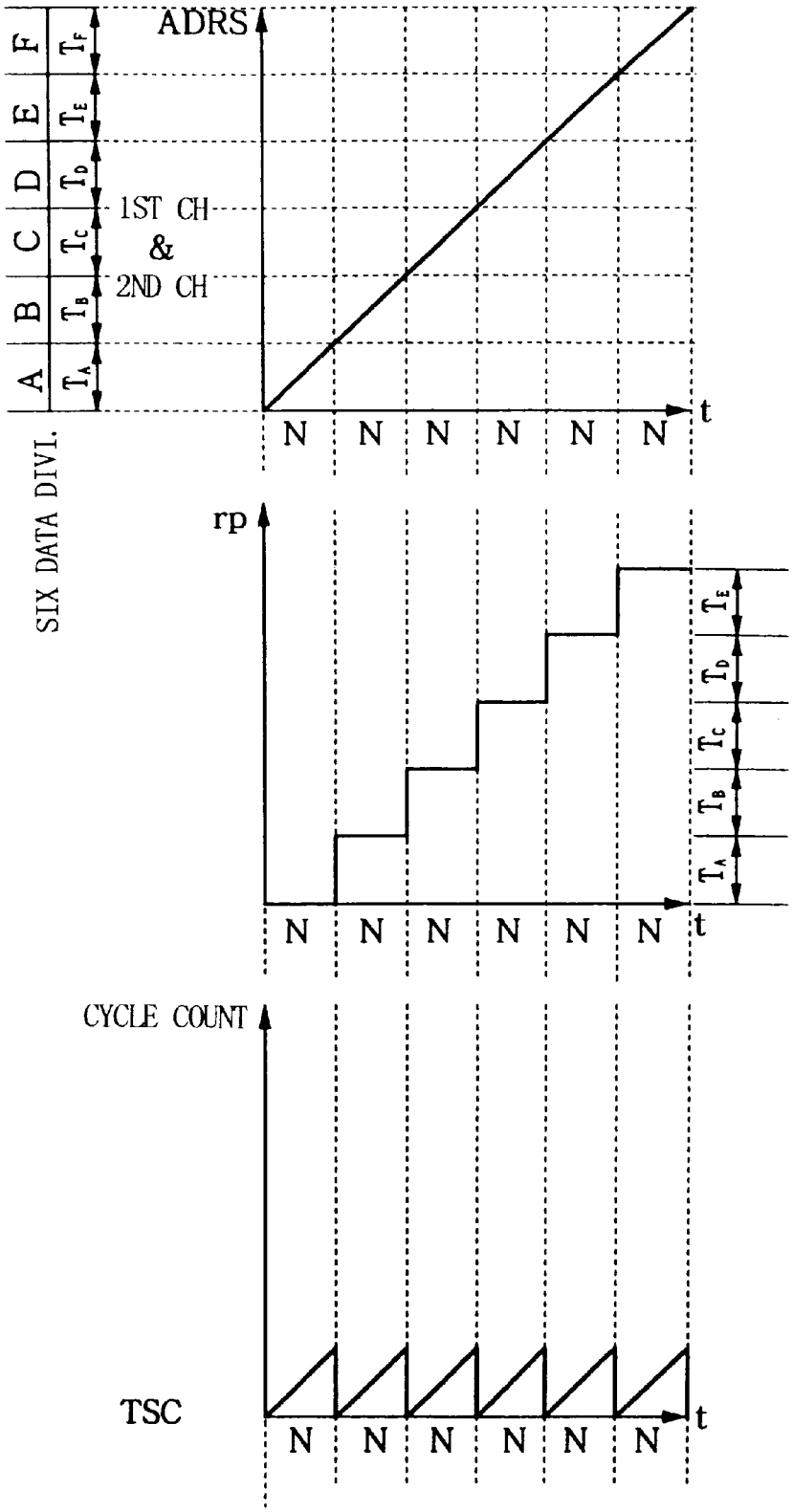
FIG. 38 is a diagram showing a detailed example of the TSC control of FIG. 30 when time-axis stretch/compression ratio CRate is 1.0 for reproduction with an original reproducing time length.
Figure 39:
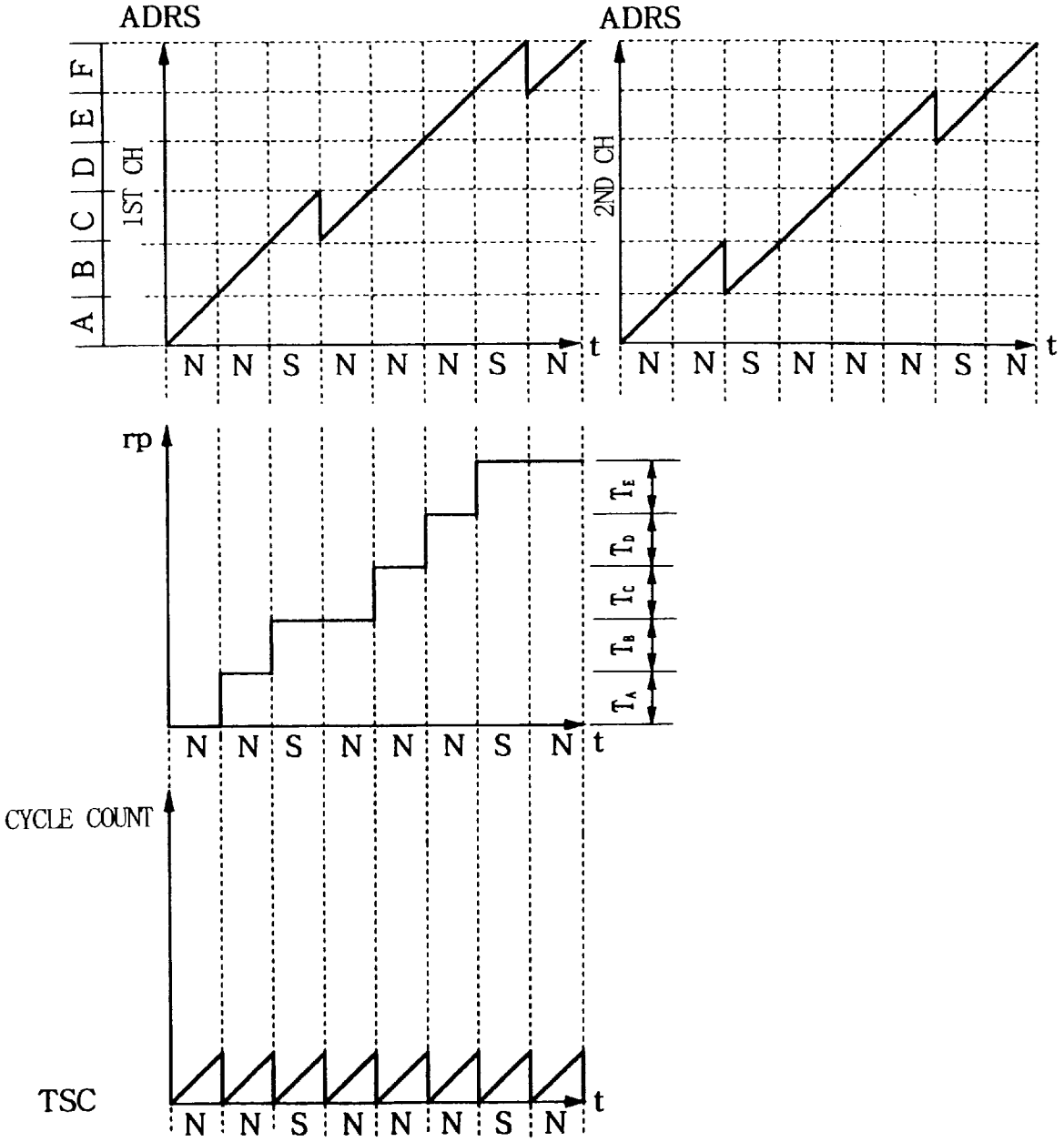
FIG. 39 is a diagram showing a detailed example of the TSC control of FIG. 30 when time-axis stretch/compression ratio CRate is 0.75 for reproduction with a stretched reproducing time length.

FIG. 38 shows an example when time-axis stretch/compression ratio CRate is 1.0 for reproduction with an original reproducing time length, and FIG. 39 shows an example when time-axis stretch/compression ratio CRate is 0.75 for reproduction with a stretched reproducing time length.

It should be obvious that the above-described preferred embodiment employing the waveform generating section 111 arranged in the manner as shown in FIGS. 29 and 30 is applicable to a variety of purposes just like the preferred embodiment employing the waveform generating section 111 of FIG. 2.

For example, the control of the present invention is applicable to a case where a musical tone performed using a performance style, such as vibrato, tremolo, etc., is recorded, for a time length corresponding to one modulation period, in the waveform memory 301. The thus-recorded modulation-imparted waveform data are read out in response to each tone generating instruction. Then, with the control of the present invention, tones having desired pitches and modulation periods can be generated from just one set of the modulation-imparted waveform data, by allowing the actual read pointer to advance at a rate corresponding to a designated pitch while allowing the virtual read pointer to advance at a rate based on a ratio between the original modulation period and the designated modulation period.

The control of the present invention is also advantageously applicable to a situation where a waveform, based on a pitch bend performance on a guitar or the like, is recorded in the waveform memory 301. With the control of the present invention, a bend-imparted waveform having a desired pitch and bend rate can be reproduced from just one set of the bend-imparted waveform data, by controlling the advancing rate of the actual read pointer in accordance with a desired pitch and controlling the advancing rate of the virtual read pointer in accordance with a desired bend rate when reading out the bend-imparted waveform data from the waveform memory 301.

Figure 40A:
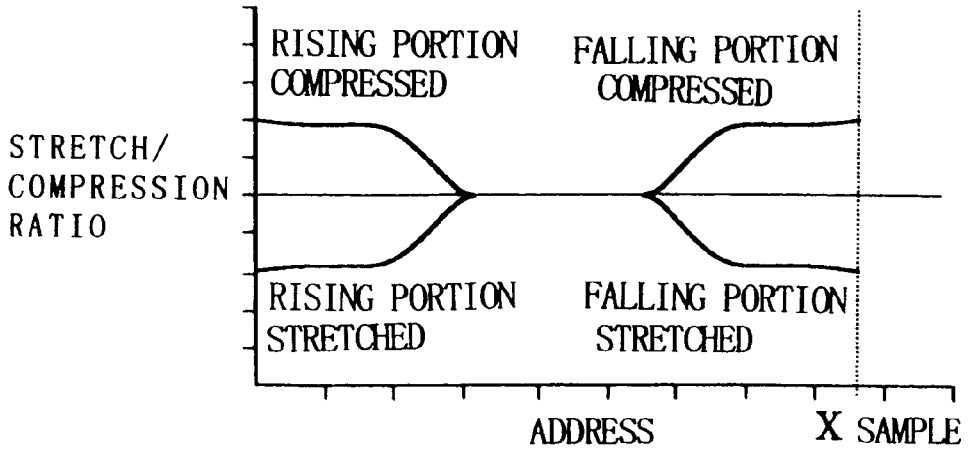
FIGS. 40A and 40B are diagram showing exemplary variations of stretch/compression ratio used in the TSC control of FIG. 30.

Further, with the control of the present invention, the lengths of the rising and falling portions of the waveform data, representing a start to end of a tone, can be controlled independently of each other and irrespective of a reproducing pitch of the tone. FIG. 40A shows exemplary variations of stretch/compression ratio parameter used to stretch and compress reproducing times of only rising and falling portions.

Figure 40B:
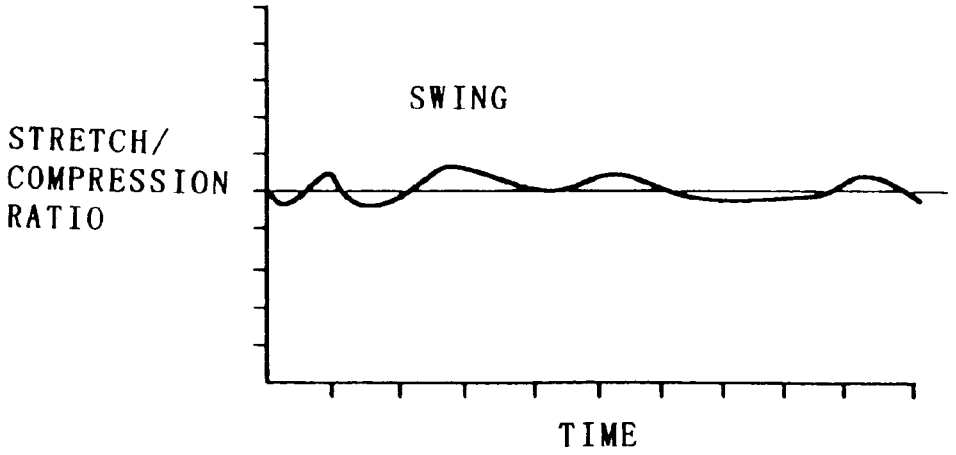

Further, by controlling the variation of the virtual read pointer with a swing waveform such as a noise or chaos waveform, it is possible to impart a variation based on time-axis stretch/compression modulation to a waveform tone color of a PCM tone generator. FIG. 40B shows an example where the stretch/compression ratio is modulated with a swing waveform over time, to thereby achieve a tone color variation. Further, by performing the TSC control using such a swing waveform, it is possible to eliminate monotonousness due to repetitive readout of the looping waveform segment of the waveform data stored in the waveform memory 301, as previously set forth in relation to FIG. 18.

Furthermore, the TSC control of the present invention may be advantageously applied to a case where a waveform generated by a slur performance on a wind instrument, guitar or the like is stored in the waveform memory 301. By performing the TSC control in reading out the slur waveform data, a time length of a transfer (slur time) from one pitch to another can be controlled freely irrespective of the tone pitches.

Moreover, the TSC control of the present invention may be advantageously applied to a case where a waveform of a performance tone, accompanied by pre-struck sound (or ornament), generated by a slur performance on a stringed instrument, wind instrument or the like is stored in the waveform memory 301. By performing the TSC control in reading out the waveform data, a time length of the pre-struck sound can be controlled irrespective of the tone pitch.

Furthermore, where the TSC control of the present invention is applied to a PCM tone generator and a same set of waveform data are to be read out at different reproducing pitches, the TSC control can control the respective tone reproducing time lengths to be equal to each other (the examples of FIGS. 16 and 17).

Also, where the TSC control of the present invention is applied to a PCM tone generator, it can create, from a same set of plural-cycle waveform data, a plurality of tone color waveforms having different reproducing time lengths.

Moreover, by applying the TSC control of the present invention to a PCM tone generator, one set of waveform data stored in the waveform memory 301 can be read out with its reproducing time length variably controlled in accordance with a designated note length.

Although a reproducing time length based on repetitive readout would result in a monotonous tone color in the looping waveform segment, the TSC control of the present invention is capable of varying the tone color in the looping waveform segment to thereby eliminate the monotonous, by appropriately controlling the stretch/compression ratio. The TSC control can be applied to a variety of applications other than the above-mentioned.

According to the present invention, a resampling technique may be used to previously process respective sizes of individual data divisions of a plural-cycle waveform before being stored into the waveform memory. Whereas the preferred embodiments have been described above as carrying out cross-fade synthesis even in the normal (N) process, the cross-fade synthesis is not necessary in the normal (N) process as obviously understood from the foregoing and hence may be omitted. However, because the aforesaid control of the present invention, where cross-fade synthesis is effected only "apparentlyt" in the normal (N) process, can be arranged to unconditionally perform the cross-fade synthesis and thus can eliminate the need to determine, in consideration of contents of a time-axis stretch/compression control parameter, whether or not the cross-fade synthesis should be effected. This arrangement can significantly simplify the necessary control and construction.

Furthermore, as previously stated, the number of cycles included in each of the data divisions may be just one or two or more. Alternatively, the number of cycles may differ from one data division to another.

Moreover, whereas the preferred embodiments have been described above as controlling the advances of the virtual and actual addresses every reproduction period, the address advance control may be executed at shorter or longer intervals. Also, the reproduction period where the comparative control of the addresses is performed may be changed to another one in the course of reproduction of a waveform.

Also, although the accumulated difference is calculated, in the above-described preferred embodiments, in terms of the number of addresses in the waveform memory, it may be calculated in terms of the number of data divisions using the following equation:

$$dif=dif+\Delta dif$$

In this case, the compression (C) process is selected if $dif \geqq 0.5$ (i.e., if the accumulated difference is greater than one half of the reproduction period);

the stretch (S) process is selected if $dif \geqq -0.5$ (i.e., if the accumulated difference is greater than one half of the reproduction period); and otherwise (i.e., if the accumulated difference is smaller than one half of the reproduction period), the normal (N) process is selected.

Further, Adif is calculated as follows:

for the stretch (S) process, $\Delta dif=CRate$;

for the normal (N) process, $\Delta dif=CRate-1$; and for the compression (C) process $\Delta dif=CRate-2$.

It is also important to note that whereas the respective start points of the individual data divisions are set to be in same phase in terms of one kind of phase value (amplitude value and varying slope) in the above-described preferred embodiments, they may be set to be in same phase in terms of two or more kinds of phase value, in which case one data division may be connected at any one phase-value point to another data division upon termination of a corresponding reproduction period.

Further, whereas the preferred embodiments have been described as using fading-in and fading-out waveform data regions fixedly in cross-fade synthesis, the two waveform data regions may be used alternately as the fading-in and fading-out waveform data regions.

[Patternization of Timewise Variations of TSC Control Parameter]

Parameter for the TSC control may be variably set in response to real-time performance operation or may be present in corresponding relations to various tone colors and effects, as set forth above. It is preferred that timewise variations of the stretch/compression control parameter for use in the TSC control be patternized in that the patternization easily achieves desired timewise variations of the TSC control and permits programming such that the time-axis stretch and compression control is effected for a predetermined tone generating period (e.g., optionally-selected partial period such as a rising or falling portion of a tone or a whole tone generating period). FIGS. 41 and 42 show examples of such timewise variation patterns of the TSC control parameter.

Figure 41A:
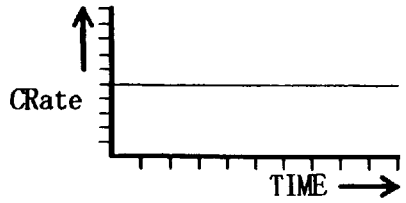
FIGS. 41A to 41F are graphs showing examples of timewise variation patterns of control parameters that are stored in tables for use in the TSC control of the present invention.
Figure 41D:
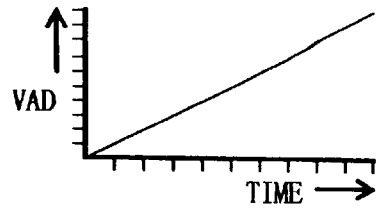
Figure 41B:
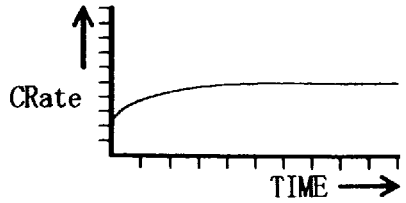
Figure 41E:
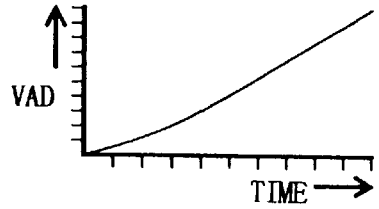
Figure 41C:
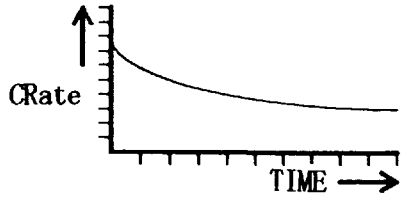

Specifically, FIGS. 41A to 41C show timewise variation patterns of the TSC control parameter (i.e., stretch/compression ratio CRate) used in the scheme where the TSC control is carried out using the stretch/compression ratio CRate (namely, where the TSC control is carried out using the waveform generating section 111 as shown in FIGS. 29 and 30). The starting point of the horizontal time axis represents, for example a tone-generation starting point. More specifically, FIG. 41A shows an example where the value of the stretch/compression ratio CRate is fixed rather than varying over time. FIG. 41B shows another example where the stretch/compression ratio CRate gradually increases from a small value in an attack portion and then becomes substantially fixed in value in a succeeding sustain portion. Using this pattern, the TSC control is executed such that the generated tone presents a greatest time-axis stretch at its initial portion and then gradually returns to the original time-axis locations. FIG. 41C shows still another example where the stretch/compression ratio CRate gradually decreases from a great value in an attack portion and then becomes substantially fixed in value in a succeeding sustain portion. Using this pattern, the TSC control is executed such that the generated tone presents a greatest time-axis compression at its initial portion and then gradually returns to the original time-axis locations.

Figure 41F:
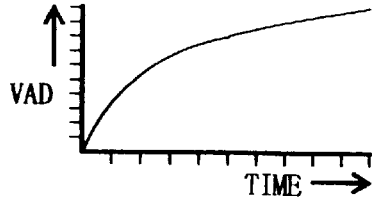
Figure 42A:
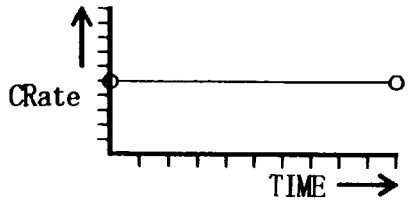
FIGS. 42A to 42F are graphs showing examples of timewise variation patterns of control parameters that are generated in a broken-line-graph like manner for use in the TSC control of the present invention.
Figure 42D:
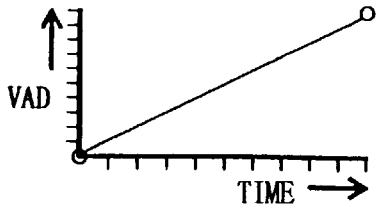
Figure 42B:
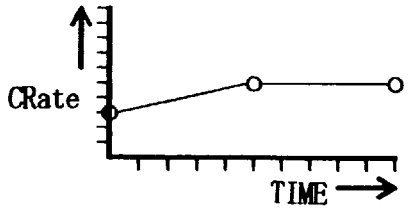
Figure 42E:
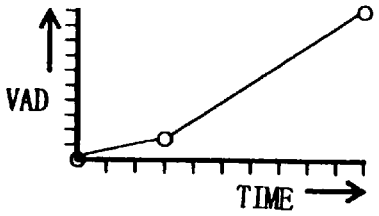
Figure 42C:
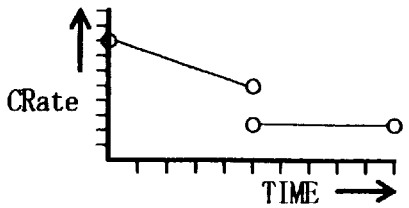
Figure 42F:
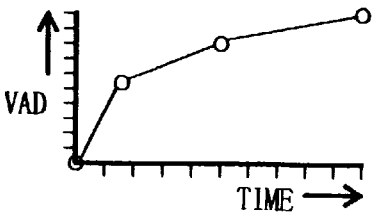

FIGS. 41D to 41F show timewise variation patterns of the TSC control parameter (i.e., virtual read address VAD) used in the scheme where the TSC control is carried out using the virtual read address VAD (namely, where the TSC control is carried out using the waveform generating section 111 as shown in FIG. 2). Examples of FIGS. 41D, 41E and 41D are similar to the above-described examples of FIGS. 41A, 41B and 41C, respectively, except that the virtual read address VAD is used as the TSC control parameter.

It is most preferable that the timewise variation patterns of the TSC control parameter (i.e., stretch/compression ratio CRate or virtual read address VAD) as shown in FIG. 41 may be prestored in a table format in memory. Note that where timewise variation patterns of the virtual read address VAD are prestored as in the examples of FIGS. 41D, 41E and 41F, the virtual read address calculator 17 may be arranged to multiply a time function of the virtual read address VAD read out from the table by "pitch information" rather than accumulating the "pitch information" at a sampling frequency. It should be obvious that timewise variation patterns of stretch/compression ratio SCR (FIG. 2) may be prestored in the manners shown in FIGS. 41A, 41B and 41C, instead of the timewise variation patterns of the virtual read address VAD being directly prestored in the manners shown in FIGS. 41D, 41E and 41F.

FIG. 42 shows various examples where timewise variation patterns of the TSC control parameter similar to those of FIG. 41 are generated generally like broken-line graphs using an arithmetic operator such as an envelope generator. Specifically, FIGS. 42A to 42F show examples where timewise variation patterns of the TSC control parameter, similar to those of FIGS. 41A to 41F are created by real time arithmetic operations, instead of using a table or memory.

The examples shown in FIGS. 41 and 42 are just for illustrative purposes, and various other patterns than the illustrated examples may of course be prestored or arithmetically created.

Figures 43A, 43B, 44:
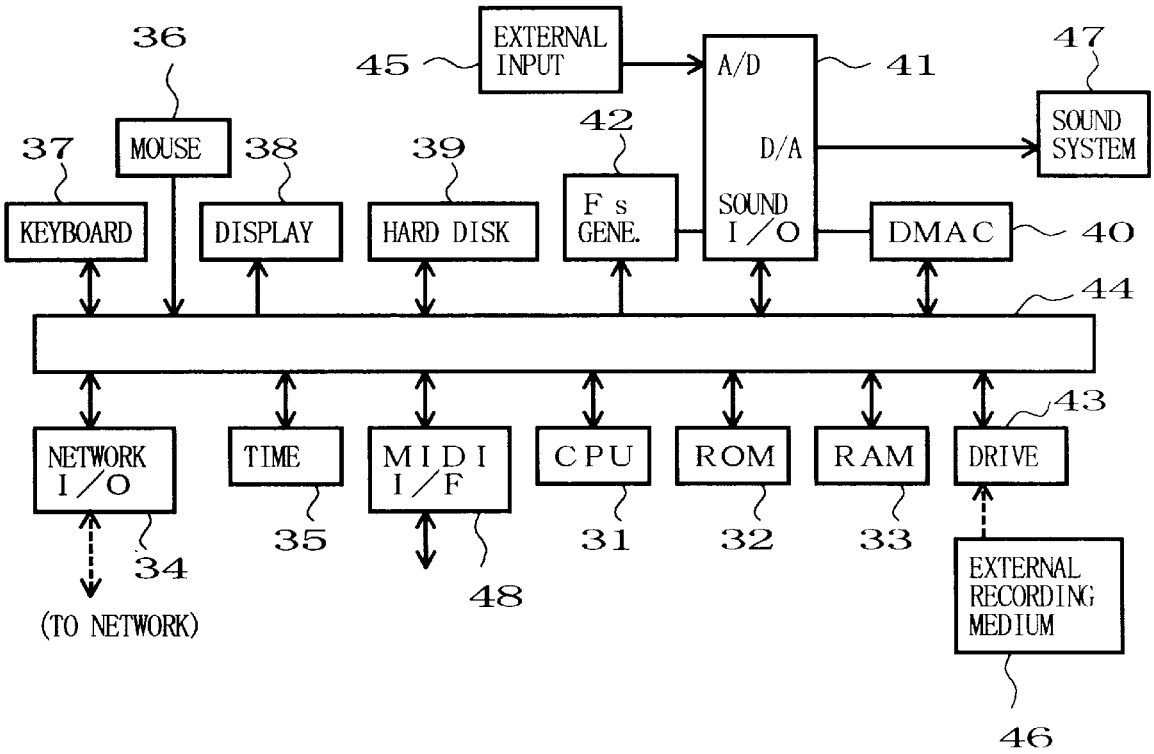
FIGS. 43A and 43B are diagrams showing examples of tone color control using any of the timewise variation patterns of the TSC control parameter as shown in FIGS. 41 and 42, each showing an exemplary arrangement of a control information table corresponding to a given tone color.
FIG. 44 is a block diagram showing an example of an overall hardware setup employed in a tone generator based on computer software.

Further, FIGS. 43A and 43B show examples of tone color control using any of the timewise variation patterns of the TSC control parameter as shown in FIGS. 41 and 42, each showing an exemplary arrangement of a control information table corresponding to a tone color.

More specifically, FIG. 43A shows an example of various control information corresponding to tone color name "A". Here, the TSC control is carried out using the waveform generating section 111 as shown in FIG. 30. According to this example, "waveform data file 1" is designated as waveform-data-file specifying information and "CRate variation 2" is designated as TSC-control-parameter-pattern specifying information. This control information table also includes various setting information such as tone volume envelope (EG) setting information. Here, the above-mentioned "CRate variation 2" specifies a predetermined one of the timewise variations shown in FIGS. 41A to 41C and FIGS. 42A to 42C. Namely, according to this example, plural-cycle waveform data of "waveform data file 1" are designated and read out from the waveform memory 301 (FIG. 30) as a tone waveform corresponding to tone color name "A", and the TSC control is carried out in a time-varying fashion according to "CRate variation 2" to thereby create a desired waveform. In some application, another form of CRate variation than "CRate variation 2" may be designated while the same "waveform data file 1" is designated. Namely, according to this example, it is possible to provide an increased number of variations of tone color by using different forms of CRate variation while using the same data file.

FIG. 43B shows an example of various control information corresponding to tone color name "B". Here, the TSC control is carried out using the waveform generating section 111 as shown in FIG. 2. According to this example, "waveform data file 2" is designated as waveform-data-file specifying information and "VAD variation 3" is designated as TSC-control-parameter-pattern specifying information. This control information table also includes various setting information such as tone volume envelope (EG) setting information. Here, the above-mentioned "VAD variation 3" specifies a predetermined one of the timewise variations shown in FIGS. 41D to 41F and FIGS. 42D to 42F. Namely, according to this example, plural-cycle waveform data of "waveform data file 2" are designated and read out from the waveform memory 10 (FIG. 2) as a tone waveform corresponding to tone color name "B", and the TSC control is carried out in a time-varying fashion according to "VAD variation 3" to thereby create a desired waveform. In this case as well, another form of VAD variation than "VAD variation 3" may be designated while the same "waveform data file 2" is designated. Namely, according to this example, it is possible to provide an increased number of variations of tone color by using different forms of VAD variation while using the same data file.

[TSC Control Using Software Tone Generator]

Whereas the tone generator unit 103 including the waveform generating section 111, in the preferred embodiments, has been described as being implemented by dedicated hardware, it may be implemented by software.

Namely, to this end, a software system, so to speak a "TSC control program", is built in such a manner to achieve desired one of the various forms of the TSC control of the present invention having been so far described in relation to FIGS. 2 to 43, and plural-cycle waveform data are stored in memory. Then, through operation of the thus-built software system (TSC control program), the waveform data are read out from the memory in a manner based on the above-described TSC control.

FIG. 44 is a block diagram showing an example of an overall hardware configuration employed in the tone generator based on computer software. The hardware configuration may be implemented using a personal computer.

In the illustrated tone generator system, a CPU (Central Processing Unit) 31 of a personal computer is employed as a main control unit, which runs a predetermined "TSC control program" for performing TSC control similar to that performed by the tone generator unit 103 of FIG. 1. When necessary, the CPU 31 is capable of executing any other programs, including one similar to the processing program executed by the control unit 102 of FIG. 1, concurrently with the TSC control program.

To the CPU 31 are connected, via a data and address bus 44, various components, such as a ROM (Read Only Memory) 32, a RAM (Random Access Memory) 33, a network I/O (Input/Output device) 34, a timer 35, a mouse 36, a keyboard 37, a display 38, a hard disk 39, a DMAC (Direct Memory Access Controller) 40, a sound I/O 41, a sampling clock generator circuit 42, an external memory drive 43 and a MIDI interface 48.

The sound I/O 41 is an sound input/output device called a CODEC, which contains an analog-to-digital converter (ADC), an input FIFO (First-In-First-Out) buffer connected to the ADC and an output FIFO buffer connected with a digital-to-analog converter (DAC). Analog audio signal is supplied via an external audio signal input terminal 45 to the ADC within the sound I/O 41, where the signal is converted into digital representation in accordance with sampling clock pulses Fs of a predetermined frequency (e.g., 48 kHz) generated by the sampling clock generator circuit 42. The resultant A/D-converted audio signal is then fed to the input FIFO buffer. As long as any data is present in the input FIFO buffer, the sound I/O 41 operates to feed a recording-process requesting signal to the DMAC 40. In response to the recording-process requesting signal, the DMAC 40 reads out the waveform data from the input buffer and stores the read-out waveform data into an internal memory, such as the RAM 33, by way of the bus 44. The waveform data thus stored in the RAM 33 are then subjected to preliminary operations, as earlier described, so that they can be adjusted to be appropriately read out in accordance with the TSC control and divided into a plurality of data divisions for management purposes. A number of sets of such waveform data may be prestored in the hard disk 39. Thus, in this embodiment, the ROM 32, RAM 33 or hard disk 39 corresponds to the waveform memory 10 of FIG. 2 or the waveform memory 301 of FIG. 301.

The "TSC control program" may be prestored in any of the ROM 32, RAM 33 or hard disk 39.

An external recording medium 46, such as a floppy disk, CD-ROM (Compact Disk-Read Only Memory) or MO (Magneto Optical disk), is removably attached to the external memory drive 43, and the external memory drive 43 writes and data data to and from the attached recording medium 46. The external recording medium 46 may be used to store the "TSC control program", other programs, waveform data and/or automatic performance sequence data.

Further, the tone generator system may be connected to a communication network via the network I/O 34 so that it receives the "TSC control program", other programs and/or waveform data from an external server computer (not shown) and stores them into the RAM 33, hard disk 39 or external recording medium 46.

The CPU 31 executes the "TSC control program", stored in, for example, the RAM 33, to perform the TSC control as in the above-described embodiments, to thereby read out TSC-controlled waveform data from the waveform memory 32, 33 or 39. Then, the CPU 31 temporarily writes the read-out waveform data into an output buffer within the RAM 33. In synchronism with reproduction sampling clock pulses from the sound I/O 41, the DMAC 40 reads out samples of the TSC-controlled waveform data, one sample per clock pulse, from the output buffer in accordance with the conventional direct memory access scheme and feeds the samples to the sound I/O 41. In turn, the sound I/O 41 temporarily writes the TSC-controlled waveform data into the output FIFO buffer provided therein, from which the waveform data are given to the DAC for D/A conversion. The resultant D/A-converted waveform data are then audibly reproduced through the sound system 47.

It is also important to note that all the functions of the tone generator unit 103 need not necessarily be implemented by the software tone generator and may be arranged as a hybrid type that comprises a combination of software and hardware tone generators. For instance, the waveform data readout from the waveform memory according to the TSC control may be executed through software processing, while the cross-fade synthesis may be executed by dedicated hardware circuitry.

The present invention as has been described thus far affords a variety of advantageous results as set forth below.

When applied to a tone generator based on waveform data readout from a waveform memory, the present invention can perform optional variable control of the data readout rate (pitch) and simultaneously perform control for optionally stretching and compressing the waveform data along a time axis independently of the readout rate. Thus, by introducing, as one independent tone control factor, the control for stretching and compressing the waveform data in the time axis direction, the present invention achieves the superior benefit that it can impart expression to a tone to be generated and effectively enhance expression and controllability of the tone, even with a simple structure that can effectively save limited memory capacity by allowing a same set of stored waveform data to be shared for a plurality of different tone pitches.

Further, when applied to the case where high-quality waveform data of a plural-cycle waveform corresponding to an optional performance style, such as those with modulation like a vibrato or tremolo, those with pitch modulation like a pitch bend or those with transient pitch fluctuation like a transient tone or ornament, are stored in a waveform memory so that a tone is reproduced by reading out the stored waveform data, the present invention can perform control for stretching and compressing readout locations of the waveform data along a time axis independently of the control of the waveform data readout rate (pitch control of the generated tone). As a result, the present invention can provide a time-axis control parameter as an additional tone control parameter for the optional performance style, thus achieving suitable tone generation and tone control for the optional performance style with enhanced expression and controllability that have never been achieved to date.

Furthermore, by performing the control for stretching and compressing readout locations in a desired portion (whole or part) of the waveform data along the time axis independently of the control of the waveform data readout rate (pitch control of the generated tone) to thereby optionally control a tone-reproducing or tone-generating time length of the desired portion, the present invention achieves a variety of variations of a tone waveform so as to permit tone generation and tone control with enhanced expression and controllability that have never been achieved to date. For example, the present invention can freely perform variable control of a tone-generating time length of a rising portion, falling portion or the like of a generated tone while maintaining the tone at a desired pitch. Also, by variably controlling the entire time length of the generated tone while maintaining the tone at a desired pitch, the present invention can freely control the tone generating time length in conformity to a designated note length or the like.

By selectively generating time-axis stretching/compressing control information of a time-varying characteristic in accordance with information designating a tone color or the like, the present invention achieves a variety of variations of a tone waveform corresponding to the designated tone color or the like and thereby create, through the time axis control, a variety of waveform variations from waveform data of just one plural-cycle waveform.

Moreover, in the case where waveform data of a same waveform portion are read out in a repetitive or looped manner from a waveform memory, the present invention achieves a variety of variations of a tone waveform and can minimize or effectively eliminate monotonousness resulting from the looped readout, by performing the control for stretching and compressing readout locations of a desired portion of the waveform data along the time axis to thereby optionally control a tone-generating time length of the desired portion.

In addition, the present invention achieves a variety of variations of a tone waveform, by performing the control for stretching and compressing readout locations of a desired portion of waveform data along the time axis to thereby impart positive control, such as a swing, to a tone to be generated.

Moreover, even in the course of reproduction of a tone waveform, the present invention achieves a variety of variations of a tone waveform through real-time control, by performing the control for stretching and compressing waveform data along the time axis in real-time response to dynamically changing ratios of compression and stretch along the time axis.

In addition, in the case where any one of a plurality of sets of stored waveform data is selectably used for generation of a tone, the present invention can perform tone control in an even further diversified manner, by sequentially switching, in response to passage of time, the set to be used to another set.

Also, the present invention achieves time-axis stretch and compression control that provides for a smooth waveform variation by performing cross-fade synthesis during the control.

Furthermore, in the case where waveform data divisions to be cross-faded sequentially change, the present invention is arranged to fix the cross-fading (fading-in and fading-out) direction in each of the cross-fading channels so that a transfer always occurs from the waveform data of the first cross-fading channel to the waveform data of the second cross-fading channel. With this arrangement, it is possible to fix a functional waveform of cross-fading coefficient for each of the cross-fading channels and thereby facilitate formation of the functional waveform.

Finally, even when no time-axis stretch or compression is to be carried out, the present invention is arranged to perform cross-fade synthesis between same waveform data read out two cross-fading channels to thereby prevent occurrence of time-axis stretch or compression of the waveform data. In this manner, the present invention performs the cross-fade synthesis at any time only "apparently". As a result, the present invention can be arranged to unconditionally perform the cross-fade synthesis at any time and thus can eliminate the need to determine, in consideration of contents of a time-axis stretch/compression control parameter, whether or not the cross-fade synthesis should be effected. This arrangement can significantly simplify the necessary control and construction.

What is claimed is:

1. A tone generating device comprising:

a waveform memory having stored therein waveform data of a plural-cycle waveform;

a pitch designating section that designates a pitch of a tone to be generated;

a control information generating section that generates control information specifying, in a time function, an address location of the waveform data to be read out from said waveform memory;

an address generating section that generates a read address advancing at a rate corresponding to the pitch designated by said pitch designating section;

a control unit that makes a comparison between the address location specified by the control information and a location of the read address generated by said address generating section and controls shifting of the read address in accordance with a result of the comparison; and a section that reads out the waveform data on the basis of the read address controlled by said control unit.

2. A tone generating device as recited in claim 1 wherein the waveform data stored in the waveform memory are divided into a plurality of data divisions and managed in such a manner that respective first waveform data of the data divisions have substantially the same amplitude and substantially the same slope, and wherein when a difference between the address location specified by the control information and the location of the read address generated by said address generating section has exceeded a predetermined value, said control unit shifts the read address by an amount corresponding to one or more of the data divisions.

3. A tone generating device as recited in claim 1 which further comprises a cross-fading section that, when a shift of the read address is to be carried out by said control unit, performs cross-fade synthesis between the waveform read out from said waveform memory on the basis of the read address generated before the shift and the waveform read out from said waveform memory on the basis of the read address generated after the shift.

4. A tone generating device comprising:

a waveform memory having stored therein waveform data of a plural-cycle waveform having a modulation effect imparted thereto;

a pitch designating section that designates a pitch of a tone to be generated;

a section that generates control information to control a time axis of modulation;

a control unit that designates, in response to passage of time, discrete locations of the waveform data to be read out from said waveform memory with a time axis of the waveform data controlled, by said control unit, to be stretched or compressed in accordance with the control information; and a readout section that reads out from said waveform memory the waveform data at the locations designated by said control unit at a rate corresponding to the pitch designated by said pitch designating section.

5. A tone generating device comprising:

a waveform memory having stored therein waveform data of a plural-cycle waveform;

a pitch designating section that designates a pitch of a tone to be generated;

a section that generates control information in correspondence with a predetermined portion of the waveform data to be repetitively read out from said waveform memory;

a control unit that designates, in response to passage of time, discrete locations of the waveform data to be read out from said waveform memory with a time axis of the waveform data controlled, by said control unit, to be stretched or compressed in accordance with the control information; and a readout section that reads out the waveform data from said waveform memory at a rate corresponding to the pitch designated by said pitch designating section, wherein when the predetermined portion is to be read out repetitively, said readout section reads out the waveform data at the locations designated by said control unit at the rate corresponding to the designated pitch.

6. A tone generating device comprising:

a waveform memory having stored therein waveform data of a plural-cycle waveform;

a pitch designating section that designates a pitch of a tone to be generated;

a section that generates control information varying with time;

a control unit that designates, in response to passage of time, discrete locations of the waveform data to be read out from said waveform memory with a time axis of the waveform data controlled, by said control unit, to be stretched or compressed in accordance with the control information; and a readout section that reads out from said waveform memory the waveform data at the locations designated by said control unit at a rate corresponding to the pitch designated by said pitch designating section.

7. A tone generating device comprising:

a waveform memory having stored therein waveform data of a plural-cycle waveform having a tonal characteristic variation imparted thereto over a predetermined period based a predetermined style of performance;

a pitch designating section that designates a pitch of a tone to be generated;

a section that generates control information to control a tone generating period based on the predetermined style of performance;

a control unit that designates, in response to passage of time, discrete locations of the waveform data to be read out from said waveform memory with a time axis of the waveform data controlled, by said control unit, to be stretched or compressed in accordance with the control information; and a readout section that reads out from said waveform memory the waveform data at the locations designated by said control unit at a rate corresponding to the pitch designated by said pitch designating section.

8. A tone generating device as recited in claim 7 wherein the tonal characteristic variation imparted to the waveform data are a variation of at least one of tone pitch, color and volume.

9. A tone generating device as recited in claim 7 wherein said control information designates either or both of start and end points of the tone generating period based on the predetermined style of performance, and a time length of the variation.

10. A tone generating device as recited in claim 7 wherein said control information designates one of start and end points of the tone generating period based on the predetermined style of performance, and a rate of the variation.

11. A tone generating device comprising:

a waveform memory having stored therein first waveform data representative of a first waveform, second waveform data representative of a second waveform, and third waveform data of a plural-cycle third waveform having a tonal characteristic variation imparted thereto to interconnect said first waveform and said second waveform;

a pitch designating section that designates a pitch of a tone to be generated;

a section that, when a transfer from said first waveform to said second waveform is instructed, performs control such that said first waveform and said second waveform are read out with said third waveform inserted therebetween;

a section that generates control information to control a time over which said third waveform is to be used;

a control unit that designates, in response to passage of time, discrete locations of at least part of said third waveform to be read out from said waveform memory with a time axis of said third waveform data controlled, by said control unit, to be stretched or compressed in accordance with the control information; and a readout section that reads out the waveform data from said waveform memory at a rate corresponding to the pitch designated by said pitch designating section, wherein when said third waveform data are to be read out, said readout section reads out said third waveform data at the locations designated by said control unit at the rate corresponding to the designated pitch.

12. A tone generating device comprising:

a waveform memory having stored therein waveform data of a plural-cycle waveform;

a pitch designating section that designates a pitch of a tone to be generated;

a section that generates control information in correspondence with a predetermined partial tone generating period;

a control unit that designates, in response to passage of time, discrete locations of the waveform data to be read out from said waveform memory with a time axis of the waveform data controlled, by said control unit, to be stretched or compressed in accordance with the control information; and a readout section that reads out from said waveform memory the waveform data at the locations designated by said control unit at a rate corresponding to the pitch designated by said pitch designating section.

13. A tone generating device comprising:

a waveform memory having stored therein waveform data of a plural-cycle waveform;

a pitch designating section that designates a pitch of a tone to be generated;

a color designating section that designates a color of the tone to be generated;

a section that generates control information varying in a manner corresponding to the color designated by said color designating section, in response to passage of time from a tone-generation starting point;

a control unit that designates, in response to passage of time, discrete locations of the waveform data to be read out from said waveform memory with a time axis of the waveform data controlled, by said control unit, to be stretched or compressed in accordance with the control information; and a readout section that reads out from said waveform memory plural cycles of the waveform data corresponding to the designated color at a rate corresponding to the pitch designated by said pitch designating section, wherein said readout section reads out the waveform data at the locations designated by said control unit at the rate corresponding to the designated pitch, wherein the waveform data of a plural-cycle waveform stored in said waveform memory is shared for at least two different colors and the control information for the at least two different colors is arranged in different manners.

14. A tone generating device comprising:

a waveform memory having stored therein waveform data of a plural-cycle waveform;

a pitch designating section that designates a pitch of a tone to be generated;

a section that generates control information in real time during generation of a tone;

a control unit that designates, in response to passage of time, discrete locations of the waveform data to be read out from said waveform memory with a time axis of the waveform data controlled, by said control unit, to be stretched or compressed in accordance with the control information; and a readout section that reads out from said waveform memory the waveform data at the locations designated by said control unit at a rate corresponding to the pitch designated by said pitch designating section.

15. A tone generating device comprising:

a waveform memory having stored therein plural different sets of waveform data of plural-cycle waveforms;

a pitch designating section that designates a pitch of a tone to be generated;

a waveform designating section that designates any one of the sets of waveform data, said waveform designating section sequentially switching the designated set to another one of the sets in response to passage of time;

a section that generates control information;

a control unit that designates, in response to passage of time, discrete locations of the set of waveform data, designated by said waveform designating section, to be read out from said waveform memory with a time axis of the set of waveform data controlled, by said control unit, to be stretched or compressed in accordance with the control information; and a readout section that reads out from said waveform memory the waveform data at the locations designated by said control unit at a rate corresponding to the pitch designated by said pitch designating section.

16. A tone generating device comprising:

a waveform memory having stored therein waveform data of a plural-cycle waveform;

a pitch designating section that designates a pitch of a tone to be generated;

a section that generates control information to control a time length over which a tone is to be generated;

a control unit that designates, in response to passage of time, discrete locations of the waveform data to be read out from said waveform memory with a time axis of the waveform data controlled, by said control unit, to be stretched or compressed in accordance with the control information; and a readout section that reads out from said waveform memory the waveform data at the locations designated by said control unit at a rate corresponding to the pitch designated by said pitch designating section.

17. A method of generating a tone on the basis of readout from a waveform memory having stored therein waveform data of a plural-cycle waveform, said method comprising:

a step of designating a pitch of a tone to be generated;

a step of generating control information specifying, in a time function, an address location of the waveform data to be read out from said waveform memory;

a step of generating a read address advancing at a rate corresponding to the pitch designated by said step of designating a pitch;

a step of making a comparison between the address location specified by the control information and a location of the read address generated by said step of generating a read address and controlling shifting of the read address in accordance with a result of the comparison; and a step of reading out the waveform data on the basis of the read address controlled by said step of controlling.

18. A method as recited in claim 17 wherein the waveform data stored in the waveform memory are divided into a plurality of data divisions and managed in such a manner that respective leading waveform data of the data divisions have substantially the same amplitude and substantially the same slope, and wherein when a difference between the address location specified by the control information and the location of the read address has exceeded a predetermined value, said control step shifts the read address by an amount corresponding to one or more of the data divisions.

19. A method as recited in claim 17 which further comprises a step of, when a shift of the read address is to be carried out by said shift step, performing cross-fade synthesis between the waveform read out from said waveform memory on the basis of the read address generated before the shift and the waveform read out from said waveform memory on the basis of the read address generated after the shift.

20. A method of generating a tone on the basis of readout from a waveform memory having stored therein waveform data of a plural-cycle waveform, said method comprising:

a step of designating a pitch of a tone to be generated;

a step of generating control information;

a control step of designating, in response to passage of time, discrete locations of the waveform data to be read out from said waveform memory with a time axis of the waveform data controlled, by said control step, to be stretched or compressed in accordance with the control information; and a step of reading out from said waveform memory the waveform data at the locations designated by said control step at a rate corresponding to the pitch designated by said step of designating, whereby a tone is generated which has the designated pitch and waveform data of a characteristic controlled, by said control step, to be stretched or compressed along a time axis in accordance with the control information.

21. A machine-readable storage medium containing a group of instructions for causing said machine to perform a method for generating a tone on the basis of readout from a waveform memory having stored therein waveform data of a plural-cycle waveform, said method comprising the steps of:

designating a pitch of a tone to be generated;

generating control information specifying, in a time function, an address location of the waveform data to be read out from said waveform memory;

generating a read address advancing at a rate corresponding to the pitch designated by said step of designating a pitch;

comparing the address location specified by the control information with a location of the read address generated by said step of generating a read address;

controlling a shifting of the read address in accordance with a result of the step of comparing; and reading out the waveform data from said waveform memory on the basis of the read address controlled by said step of controlling a shifting.

22. A machine-readable storage medium containing a group of instructions for causing said machine to perform a method for generating a tone on the basis of readout from a waveform memory having stored therein waveform data of a plural-cycle waveform, said method comprising the steps of:

designating a pitch of a tone to be generated;

generating control information corresponding to a stretching or a compression of the waveform;

designating, in response to passage of time, discrete locations of the waveform data to be read out from said waveform memory at a point along the time axis determined by said control information; and reading out from said waveform memory the waveform data at the locations designated by said step of designating discrete locations at a rate corresponding to the pitch designated by said step of designating a pitch of a tone.

23. A tone generating device comprising:

a waveform generating section that generates waveform data in two channels;

a waveform designating section that designates waveform data to be generated in a first one of said two channels of said waveform generating section and waveform data to be generated in a second one of said two channels of said waveform generating section;

a cross-fade synthesis section that executes cross-fade synthesis such that a transfer occurs from the waveform data generated in said first channel to the waveform data generated in said second channel;

a first control section that sequentially instructs said waveform generating section to generate additional waveform data having an optional length and controls said cross-fade synthesis section to execute the cross-fade synthesis for a period corresponding to the length of the additional waveform data; and a second control section that after completion of the cross-fade synthesis by said cross-fade synthesis section, controls designation by said waveform designating section in such a manner that the waveform data having been so far generated in said second channel are generated in said first channel and said additional waveform data are generated in said second channel.

24. A tone generating device comprising:

a waveform memory having stored therein waveform data of a plural-cycle waveform;

a pitch designating section that designates a pitch of a tone to be generated;

a waveform designating section that designates, in response to passage of time, discrete locations of the waveform data to be read out from said waveform memory with a time axis of the waveform data controlled to be stretched or compressed, so as to identify first waveform data at currently designated locations and second waveform data at following locations having been controlled to be stretched or compressed relative to the currently designated locations;

a readout section that reads out, from said waveform memory, said first and second waveform data designated by said waveform designating section, to output said first and second waveform data through first and second channels, respectively;

a cross-fade synthesis section that always executes cross-fade synthesis such that a transfer occurs from said first waveform data supplied through said first channel to said second waveform data supplied through said second channel; and a control unit that after completion of the cross-fade synthesis by said cross-fade synthesis section, controls designation by said waveform designating section in such a manner that the waveform data having been so far generated in said second channel are outputted by said readout section through said first channel and the waveform data at new locations having been controlled to be stretched or compressed relative to the locations of said second waveform data are outputted by said readout section through said second channel.

25. A tone generating device comprising:

a waveform memory having stored therein waveform data of a plural-cycle waveform;

a pitch designating section that designates a pitch of a tone to be generated;

a waveform designating section that designates, in response to passage of time, discrete locations of the waveform data to be read out from said waveform memory with a time axis of the waveform data controlled to be stretched or compressed, so as to identify first waveform data at current locations and second waveform data at following locations having been controlled to be stretched or compressed relative to said first waveform data;

a readout section that reads out, from said waveform memory, said first and second waveform data designated by said waveform designating section, to output said first and second waveform data through first and second channels, respectively;

a cross-fade synthesis section that executes cross-fade synthesis such that a transfer occurs from one of said first and second waveform data supplied through one of said first and second channels to another of said first and second waveform data; and a control unit that after completion of the cross-fade synthesis by said cross-fade synthesis section, controls designation by said waveform designating section in such a manner that said second waveform data continue to be outputted by said readout section through a same one of said first and second channels as having been so far used and the waveform data at new locations having been controlled to be stretched or compressed relative to the locations of said second waveform data are outputted by said readout section through another of said first and second channels and also changes a cross-fading direction in said cross-fade synthesis section.

26. A tone generating device comprising:

a waveform memory having stored therein waveform data of a plural-cycle waveform;

a pitch designating section that designates a pitch of a tone to be generated;

a control unit that designates, in response to passage of time, discrete locations of the waveform data to be read out from said waveform memory with a time axis of the waveform data controlled, by said control unit, to be stretched or compressed;

a waveform designating section that, in response to designation by said control unit, designates a first part of the waveform data at current locations and a second part of the waveform data at locations following the current locations when stretch of the waveform data is to be executed, designates the first part of the waveform data at current locations and a second part of the waveform data at locations preceding the current locations when compression of the waveform data is to be executed, and designates a same part of the waveform data at current locations as first and second part of the waveform data when neither stretch nor compression is to be executed;

a readout section that reads out from said waveform memory said first and second part of the waveform data designated by said control unit at a rate corresponding to the pitch designated by said pitch designating section; and a cross-fade synthesis section that executes cross-fade synthesis such that a transfer occurs from said first part of the waveform data to said second part of the waveform data.

27. A waveform data cross-fading method comprising:

a step of generating a plurality of cycles of first waveform data;

a step of, at predetermined timing, starting generation of second waveform data that has a same phase as said first waveform data generated at said predetermined timing;

a step of generating a first coefficient decreasing from an initial value of one to a final value of zero over a predetermined period and simultaneously generating a second coefficient increasing from an initial value of zero to a final value of one over said predetermined period; and a step of controlling a length of said predetermined period to conform to a one-cycle length of said second waveform data.

28. A waveform reproducing device comprising:

a waveform memory having stored therein waveform data of a plurality of waveform portions;

a tone-generation instructing section that instructs generation of a tone and designates a pitch of the tone;

a section that generates control data to control an advance of readout locations of the waveform portions;

an address generating section that generates read addresses advancing at a rate corresponding to the pitch designated by said tone-generation instructing section;

a readout section that reads out the waveform data of the waveform portions from said waveform memory on the basis of the read addresses;

a control unit that makes a comparison between an advance of the readout locations designated on the basis of the control data and an advance of locations of the read addresses generated by said address generating section and selects, on the basis of a result of the comparison, addresses of a specific one of the waveform portions to be next read out, so as to perform control such that said address generating section starts generating the selected addresses of the specific waveform portion at a point where a phase of the waveform data read out on the basis of the read addresses coincides with a phase of the waveform data designated by the selected addresses; and a section that reproduces a waveform on the basis of the waveform data read out by said readout section.

29. A waveform reproducing device as recited in claim 28 wherein one of the waveform portions selected at one time and another of the waveform portions selected next time are interconnected by cross-fade.

30. A waveform reproducing device comprising:

a waveform memory having stored therein waveform data of a plurality of waveform portions;

a tone-generation instructing section that instructs generation of a tone and designates a pitch of the tone;

a section that generates time-varying control data to control an advance of readout locations of the waveform portions;

an address generating section that generates read addresses advancing at a rate corresponding to the pitch designated by said tone-generation instructing section;

a readout section that reads out the waveform data of the waveform portions from said waveform memory on the basis of the read addresses;

a control unit that, for each predetermined reproduction period, makes a comparison between an advance of virtual waveform portion locations designated on the basis of the control data and an advance of waveform portion locations designated by the read addresses generated by said address generating section and selects, on the basis of a result of the comparison, a specific one of the waveform portions to be next read out, so as to perform control such that said address generating section starts generating addresses of the specific waveform portion in a next reproduction period; and a section that reproduces a waveform on the basis of the waveform data read out by said readout section.

31. A waveform reproducing device as recited in claim 30 wherein one of the waveform portions selected at one time and another of the waveform portions selected next time are interconnected by cross-fade.

32. A method of reproducing a waveform using a waveform memory having stored therein waveform data of a plurality of waveform portions, said method comprising:

a tone-generation instructing step of instructing generation of a tone and designating a pitch of the tone;

a step of generating control data to control an advance of readout locations of the waveform portions;

an address generating step of generating read addresses advancing at a rate corresponding to the pitch designated by said tone-generation instructing step;

a readout step of reading out the waveform data of the waveform portions from said waveform memory on the basis of the read addresses;

a control step of making a comparison between an advance of the readout locations designated on the basis of the control data and an advance of locations of the read addresses generated by said address generating step and selects, on the basis of a result of the comparison, addresses of a specific one of the waveform portions to be next read out, so as to perform control such that said address generating step starts generating the selected addresses of the specific waveform portion at a point where a phase of the waveform data read out on the basis of the read addresses coincides with a phase of the waveform data designated by the selected addresses; and a step of reproducing a waveform on the basis of the waveform data read out by said readout step.

33. A machine-readable storage medium containing a group of instructions for causing said machine to perform a method for reproducing a waveform using a waveform memory having stored therein waveform data of a plurality of waveform portions, said method comprising the steps of:

instructing generation of a tone;

designating a pitch of the tone;

generating control data to control an advance of readout locations of the waveform portions;

generating read addresses advancing at a rate corresponding to the pitch designated by said step of instructing generation of a tone;

reading out the waveform data of the waveform portions from said waveform memory on the basis of the read addresses;

comparing an advance of the readout locations designated on the basis of the control data with an advance of locations of the read addresses generated by said step of generating read addresses;

selecting, on the basis of a result of the step of comparing, addresses of a specific one of the waveform portions to be next read out, so as to generate the selected addresses of the specific waveform portion at a point where a phase of the waveform data read out on the basis of the read addresses coincides with a phase of the waveform data designated by the selected addresses; and reproducing a waveform on the basis of the waveform data read out by said step of reading out the waveform data.

34. A method of reproducing a waveform using a waveform memory having stored therein waveform data of a plurality of waveform portions, said method comprising:

a tone-generation instructing step of instructing generation of a tone and designating a pitch of the tone;

a step of generating time-varying control data to control an advance of readout locations of the waveform portions;

an address generating step of generating read addresses advancing at a rate corresponding to the pitch designated by said tone-generation instructing step;

a readout step of reading out the waveform data of the waveform portions from said waveform memory on the basis of the read addresses;

a control step of, for each predetermined reproduction period, making a comparison between an advance of virtual waveform portion locations designated on the basis of the control data and an advance of waveform portion locations designated by the read addresses generated by said address generating step and selects, on the basis of a result of the comparison, a specific one of the waveform portions to be next read out, so as to perform control such that said address generating step starts generating addresses of the specific waveform portion in a next reproduction period; and a step of reproducing a waveform on the basis of the waveform data read out by said readout step.

35. A machine-readable storage medium containing a group of instructions for causing said machine to perform a method for reproducing a waveform using a waveform memory having stored therein waveform data of a plurality of waveform portions, said method comprising the steps of:

instructing generation of a tone;

designating a pitch of the tone;

generating time-varying control data to control an advance of readout locations of the waveform portions;

generating read addresses advancing at a rate corresponding to the pitch designated by said step of instructing generation of a tone;

reading out the waveform data of the waveform portions from said waveform memory on the basis of the read addresses;

comparing, for each of a predetermined reproduction period, an advance of virtual waveform portion locations designated on the basis of the time-varying control data and an advance of waveform portion locations designated by the read addresses generated by said step of generating read addresses;

selecting, on the basis of a result of the step of comparing, a specific one of the waveform portions to be next read out, so as to generate addresses of the specific waveform portion in a next reproduction period; and reproducing a waveform on the basis of the waveform data read out by said step of reading out the waveform data.

36. A waveform generating device comprising:

a storage section that stores therein waveform data of a plurality of waveforms arranged in a time series;

a pitch designation section that presents tone pitch information designating a reproduced tone pitch;

a control information generation section that generates control information varying over time on the basis of a given variation rate that is unrelated to the reproduced tone pitch; and a reproduction section including a readout section that reads out the waveform data from said storage section in response to the control information and the tone pitch information and at a given readout rate unrelated to said variation rate of the control information, said reproduction section reproducing the waveform data read out by said readout section at the reproduced tone pitch corresponding to said pitch information.

37. A waveform generating device as recited in claim 36 which further comprises a control data supply section, wherein said control data supply section supplies control data to said control information generating section to change the variation rate of the control information, and wherein said control information generation section changes the variation rate of the control information in accordance with the control data supplied via said control data supply section.

38. A waveform generating device as recited in claim 37 wherein said control information generation section includes an arithmetic operator and controls an inclination of the control information generated by said arithmetic operator in accordance with the control data supplied via said control data supply section.

39. A waveform generating device as recited in claim 36 wherein said readout section reads out a waveform segment including at least one wave cycle present at a time position indicated by the control information, in cycles corresponding to the tone pitch information and at a given readout rate unrelated to the variation rate of the control information.

40. A waveform reproduction device comprising:

a storage section that stores therein waveform data of a tone with vibrato imparted thereto;

a setting section that sets a vibrato-imparted segment of the waveform data as a loop segment; and a reproduction section that repeatedly reproduces the loop segment set by said setting section, wherein said reproduction section stretches or compresses said waveform data in accordance with control information.

41. A waveform reproduction device as recited in claim 40 wherein said storage section prestores therein segment information indicative of the loop segment along with the waveform data, and said setting section sets the loop segment from among the waveform data in accordance with the segment information.

42. A waveform reproduction device as recited in claim 40 wherein said reproduction section includes:

a position information generation section that sequentially generates said control information in the form of position information, said position information sequentially varying at an optionally-set variation rate to designate a position in the waveform data according to an advance along a time axis;

a reproduction pitch designation section that designates a reproduction pitch; and a waveform reproduction section that, in cycles corresponding to the reproduction pitch designated by said reproduction pitch designation section, reads out the waveform data at and around the position indicated by the position information to thereby reproduce a waveform.

43. A waveform reproduction device as recited in claim 42 wherein said position information generation section sequentially generates the position information in such a manner that once the position information reaches an end point of the loop segment by advancing in the loop segment in a forward direction along the time axis, the position information jumps back to a start point of the loop segment and again advances in the forward direction.

44. A waveform generating device comprising:

a control register storing pitch information and stretch/compression information;

a memory coupled to said control register, wherein said memory is adapted to store waveform data of a plurality of waveforms arranged in a time series, and wherein said memory is adapted to receive said pitch information from said control register;

a processor coupled to said control register, wherein said processor is adapted to receive pitch information and stretch/compression information from said control register, and wherein said processor generates control information designating a virtual readout address varying over time on the basis of a given variation rate that is unrelated to the reproduced tone pitch; and a waveform data readout section coupled to said memory and said processor, wherein said waveform data readout section reads out the waveform data from said memory according to said control information received from said processor.

45. A method of generating a tone on the basis of a readout from a waveform memory having stored therein waveform data of a plural-cycle waveform, said method comprising the steps of:

storing waveform data of a plurality of waveforms arranged in a time series;

designating tone pitch information representative of a reproduced tone pitch;

generating control information varying over time on the basis of a given variation rate that is unrelated to the reproduced tone pitch; and reading out the waveform data from said storage section in response to the control information and the tone pitch information, at a given readout rate unrelated to said variation rate of the control information, and at the reproduced tone pitch corresponding to said tone pitch information.

46. A waveform reproduction device comprising:

a memory adapted to store waveform data of a plurality of waveforms with vibrato characteristics imparted to at least one segment thereof;

a processor coupled to said memory, wherein said processor designates a vibrato-imparted segment of the waveform data as a loop segment; and a waveform data readout section coupled to said memory and said processor, wherein said waveform data readout section repeatedly reads out said loop segment designated by said processor, and wherein said readout section stretches or compresses said waveform data in accordance with control information.

47. A method of reproducing a waveform using a waveform memory having stored therein waveform data of a plurality of waveform portions, said method comprising the steps of:

imparting vibrato characteristics to at least one segment of waveform data for a plurality of waveforms;

storing said waveform data;

designating a vibrato-imparted segment of said waveform data as a loop segment;

reading out said loop segment; and stretching or compressing said waveform data in accordance with control information.

* * * * *